US010746387B2

(12) United States Patent
Beausoleil

(10) Patent No.: US 10,746,387 B2
(45) Date of Patent: Aug. 18, 2020

(54) LOW VOLTAGE SECURITY LIGHTING SYSTEMS FOR PERIMETER FENCES HAVING TACTICAL GLARE CAPABILITIES

(71) Applicant: Mind Head LLC, Ridgewood, NJ (US)

(72) Inventor: David M. Beausoleil, Ridgewood, NJ (US)

(73) Assignee: Mind Head LLC, Ridgewood, NJ (US)

( * ) Notice: Subject to any disclaimer, the term of this patent is extended or adjusted under 35 U.S.C. 154(b) by 167 days.

(21) Appl. No.: 15/941,502

(22) Filed: Mar. 30, 2018

(65) Prior Publication Data

US 2018/0283666 A1 Oct. 4, 2018

Related U.S. Application Data

(60) Provisional application No. 62/480,012, filed on Mar. 31, 2017.

(51) Int. Cl.

| | |
|---|---|
| ***F21V 23/00*** | (2015.01) |
| ***E04H 17/20*** | (2006.01) |
| ***F21V 33/00*** | (2006.01) |
| ***F21V 21/116*** | (2006.01) |
| ***F21S 8/08*** | (2006.01) |

(Continued)

(52) U.S. Cl.

CPC ..... *F21V 23/008* (2013.01); *E04H 17/00* (2013.01); *E04H 17/20* (2013.01); *F21S 8/085* (2013.01); *F21V 21/088* (2013.01); *F21V 21/116* (2013.01); *F21V 33/006* (2013.01); *E04H 2017/006* (2013.01); *F21V 21/22* (2013.01); *F21V 21/26* (2013.01); *F21V 21/29* (2013.01); *F21V 23/0471* (2013.01); *F21V 29/505* (2015.01); *F21V 29/76* (2015.01);

(Continued)

(58) Field of Classification Search

CPC ..... F21V 23/008; F21V 21/116

See application file for complete search history.

(56) References Cited

U.S. PATENT DOCUMENTS 1,806,773 A 5/1931 Waters
3,210,536 A * 10/1965 Elmer ..... F21V 17/02 362/297

(Continued)

FOREIGN PATENT DOCUMENTS

WO 2010087697 8/2010

*Primary Examiner* — Evan P Dzierzynski

(74) *Attorney, Agent, or Firm* — Doherty IP Law Group LLC

(57) ABSTRACT

A light fixture for a security lighting system mounted onto a perimeter fence includes an elongated pipe having a lower pipe section, an upper pipe section, and an articulating joint coupling a lower end of the upper pipe section with an upper end of the lower pipe section for enabling the upper and lower pipe sections to articulate relative to one another. The light fixture has a junction box secured to the lower end of the lower pipe section, and a clamping element coupled with the junction box for securing the light fixture to a post of the perimeter fence. The light fixture has a glare shroud secured to the upper end of the rigid upper pipe section, the glare shroud having a reflective concave surface that forms an underside of the glare shroud that faces toward the junction box, and one or more LEDs secured to the reflective concave surface of the glare shroud, whereby each LED has an optical lens configured to pass light having a beam angle of 137-156 degrees.

30 Claims, 32 Drawing Sheets

(51) Int. Cl.

| | |
|---|---|
| ***F21V 21/088*** | (2006.01) |
| ***E04H 17/00*** | (2006.01) |
| *F21W 131/10* | (2006.01) |
| *F21V 21/22* | (2006.01) |
| *F21V 21/26* | (2006.01) |
| *F21Y 115/10* | (2016.01) |
| *F21V 21/29* | (2006.01) |
| *F21V 29/505* | (2015.01) |
| *F21Y 105/10* | (2016.01) |
| *F21V 29/76* | (2015.01) |
| *F21V 23/04* | (2006.01) |

(52) U.S. Cl.
CPC ..... *F21W 2131/10* (2013.01); *F21Y 2105/10* (2016.08); *F21Y 2115/10* (2016.08)

(56) References Cited

U.S. PATENT DOCUMENTS

| | | | |
|---|---|---|---|
| 3,222,509 | A | 12/1965 | Thedford |
| 3,251,985 | A | 5/1966 | Krupnick |
| 3,428,798 | A | 2/1969 | Hilzen |
| 4,626,974 | A | 12/1986 | Dean |
| 4,870,548 | A | 9/1989 | Beachy et al. |
| 4,984,143 | A | 1/1991 | Richardson |
| 5,429,340 | A | 7/1995 | Young et al. |
| 5,718,403 | A | 2/1998 | Ott et al. |
| 5,887,856 | A | 3/1999 | Everly, III |
| 6,106,134 | A | 8/2000 | Bomas |
| 6,250,771 | B1 | 6/2001 | Sharrah et al. |
| 6,523,982 | B1 | 2/2003 | Haddad |
| 6,722,637 | B2 | 4/2004 | Burkart et al. |
| 6,796,683 | B2 | 9/2004 | Wood et al. |
| 6,933,680 | B2 | 8/2005 | Oskorep et al. |
| 6,964,510 | B2 | 11/2005 | Galli |
| 7,063,441 | B2 | 6/2006 | Kramer et al. |
| 7,137,721 | B1 | 11/2006 | Rao et al. |
| 7,204,606 | B2 | 4/2007 | Brass et al. |
| 7,534,975 | B1 | 5/2009 | Sharrah et al. |
| 7,543,968 | B2 | 6/2009 | Chen |
| 7,587,860 | B1 | 9/2009 | Ilyas et al. |
| 7,618,150 | B2 | 11/2009 | Chien |
| 7,661,837 | B1 | 2/2010 | Pever et al. |
| 7,901,096 | B2 | 3/2011 | Klepp |
| 8,029,149 | B2 | 10/2011 | Klepp |
| 8,066,403 | B2 | 11/2011 | Sanfilipo et al. |
| 8,300,293 | B2 | 10/2012 | Violonchi |
| 8,534,867 | B1 | 9/2013 | Beadle et al. |
| D691,313 | S | 10/2013 | Beausoleil |
| 8,845,124 | B2 | 9/2014 | Beausoleil et al. |
| 9,115,857 | B2 | 8/2015 | Beausoleil |
| 9,140,414 | B1 | 9/2015 | Beausoleil |
| 9,360,197 | B2 | 6/2016 | Beausoleil et al. |
| 9,593,832 | B2 | 3/2017 | Beausoleil et al. |
| 9,648,688 | B2 | 5/2017 | Beausoleil et al. |
| 9,777,909 | B2 | 10/2017 | Beausoleil et al. |
| 2001/0052595 | A1 | 12/2001 | Hulett |
| 2002/0021573 | A1 | 2/2002 | Zhang |
| 2002/0148183 | A1 | 10/2002 | Grant |
| 2002/0176250 | A1 | 11/2002 | Bohler et al. |
| 2003/0016532 | A1 | 1/2003 | Reed |
| 2003/0066992 | A1 | 4/2003 | Burkart et al. |
| 2003/0075712 | A1 | 4/2003 | Lin |
| 2003/0206411 | A9 | 11/2003 | Dowling et al. |
| 2004/0095772 | A1 | 5/2004 | Hoover et al. |
| 2004/0124328 | A1* | 7/2004 | Cvek ..... F16M 11/10 248/280.11 |
| 2004/0233676 | A1 | 11/2004 | Matts et al. |
| 2005/0122714 | A1 | 6/2005 | Matthews et al. |
| 2005/0252753 | A1 | 11/2005 | Leo |
| 2006/0039160 | A1 | 2/2006 | Cassarly et al. |
| 2006/0187656 | A1 | 8/2006 | Kuelbs et al. |
| 2007/0070530 | A1 | 3/2007 | Seo et al. |
| 2007/0222399 | A1 | 9/2007 | Bondy et al. |
| 2007/0229250 | A1 | 10/2007 | Recker et al. |
| 2008/0099751 | A1 | 5/2008 | Chen |
| 2008/0296545 | A1 | 12/2008 | Chef |
| 2008/0310167 | A1 | 12/2008 | Zaderej et al. |
| 2009/0021952 | A1 | 1/2009 | McBride et al. |
| 2009/0185377 | A1 | 7/2009 | Johnson |
| 2010/0097206 | A1 | 4/2010 | Jung et al. |
| 2010/0208466 | A1 | 8/2010 | Luo et al. |
| 2010/0259200 | A1 | 10/2010 | Beausoleil |
| 2010/0327766 | A1 | 12/2010 | Recker et al. |
| 2010/0327768 | A1 | 12/2010 | Kong et al. |
| 2011/0080749 | A1 | 4/2011 | Roth |
| 2011/0101192 | A1* | 5/2011 | Lee ..... F16C 11/106 248/346.03 |
| 2013/0077327 | A1 | 3/2013 | Butler et al. |
| 2013/0343057 | A1 | 12/2013 | Quadri et al. |
| 2014/0119022 | A1 | 5/2014 | Beausoleil |
| 2014/0293601 | A1* | 10/2014 | Beausoleil ..... F21V 21/088 362/235 |
| 2015/0270442 | A1* | 9/2015 | Chae ..... H01L 33/62 257/88 |
| 2018/0023788 | A1 | 1/2018 | Beausoleil et al. |

* cited by examiner

322

LOW VOLTAGE SECURITY LIGHTING SYSTEMS FOR PERIMETER FENCES HAVING TACTICAL GLARE CAPABILITIES

CROSS-REFERENCE TO RELATED APPLICATIONS

The present patent application claims benefit of U.S. Provisional Application No. 62/480,012, filed Mar. 31, 2017, the disclosure of which is hereby incorporated by reference herein. In addition, the present patent application is related to commonly owned U.S. Pat. Nos. 8,845,124; 9,360,197; 9,593,832; 9,648,688; and 9,777,909, and U.S. Published Patent Application Nos. 2014/010831; 2014/0376228 and 2018/0023788, the disclosures of which are hereby incorporated by reference herein.

BACKGROUND OF THE INVENTION

Field of the Invention

The present patent application is generally related to security lighting, and is more specifically related to security lighting systems for perimeter fences.

Description of the Related Art

Perimeter fencing is used to protect individuals, personal property, building, and critical infrastructure from intrusion, theft, vandalism, and harm. In many instances, a perimeter fence provides a first layer of defense. As many intrusion attempts occur at night in dark conditions, perimeter security lighting is often used in conjunction with perimeter fences to deter, detect, and detain individuals who may attempt to breach a secure perimeter.

According to the Illuminating Engineering Society of North America (IENSA), perimeter security lighting is a vital part of an overall layered security plan. According to IENSA guidelines, an effective security lighting system should: 1) provide a clear view of an area from a distance, allowing movement to be easily detected; 2) deny potential hiding places along frequently traveled foot routes; 3) allow for facial recognition with CCTV systems and on-site security personnel; and 4) deter crime against persons and property.

To date, installing security lighting along fence lines has been limited to installing legacy lighting products, such as roadway lighting, exit ramp lighting, athletic field lighting, parking lot lighting, and building lighting. These legacy products, however, were designed for entirely different applications. For example, pole, street, and parking lot lights were never specifically designed for the camera systems used with perimeter security lighting or to enhance the abilities of on-site security personnel, but were merely adapted to meet the need for "security lighting." In many instances, legacy pole-mounted systems deliver excessive light levels, creating a plethora of problems such as producing shadows in which intruders can hide, generating blinding glare that renders security personnel ineffective, and making the surrounding unlit areas appear even darker than they would in unlit conditions.

Traditional security lighting designs have always been based upon the theory that light is good so more light must be better. Today, many lighting designers continue to develop lighting specifications that use outdated lumen and lux values that were first developed in the 1990s, long before the introduction of light emitting diodes (LEDs), precision optics, and a full understanding of how the human eye responds to various light conditions.

FIG. 1 shows a schematic view of a legacy, prior art security lighting system for a perimeter fence 50. The perimeter fence 50 defines a sterile zone 52 located inside the perimeter fence 50 and an attack zone 54 located outside the perimeter fence 50. In the prior art security light system, lighting fixtures are placed atop tall light poles 56 that are secured inside the perimeter of the perimeter fence 50. The light poles are typically about 25-60 feet tall and the light fixtures are attached at the upper ends of the light poles. As a result, the light fixtures are about 25-60 feet off grade (i.e., 25-60 feet above the ground). Typically, the light poles are placed in concrete footings and are positioned about 10 to 25 feet inside the protective fence line. Typical light pole spacing is usually about three times the height of the light pole (i.e., 25 foot fixture height equals 75 foot pole spacing) 100 or so feet apart from one another along the fence line. The lights in the security lighting system shown in FIG. 1 effectively flood the entire area with lighting both inside and outside the perimeter fence line 50, which results in excessive lighting being used, and which makes it a difficult environment for the human eye to operate. In addition, due to the high mounting of the light fixtures (e.g., 25-60 feet off grade), the light fixtures generate glare at the head of each fixture.

There are many inherent flaws associated with using pole-mounted light fixtures that are mounted 25-60 feet or higher off grade and that are spaced 100 or more feet apart. These flaws include difficulty projecting vertical illuminance on faces for identification, for reading body language, for identifying those who are familiar or threatening, and for capturing images on security cameras. In addition, legacy pole-mounted street lighting fixtures require large concrete footings, construction cranes, bucket trucks, high-voltage power and yearly maintenance. When the pole-mounted fixtures require servicing, which could be in a remote area, the task requires coordinating sophisticated equipment and expert personnel that are very expensive and often times not readily available.

FIG. 2 shows a side view of a prior art security lighting system including a light fixture 58 that is mounted at an upper end of the light pole 56 having a height of between 25-60 feet. The security lighting system generates light on an area to be lit, however, it also generates excessive light that spills outside of the area required to be lit to produce light pollution, which has negative impacts. Light pollution has harmful effects on the health of individuals, the environment, and disrupts the world's ecosystems and natural cycles. In addition, due to the high mounting of the security light fixture 58 off grade, the light fixture 58 generates direct glare that will blind individuals located within the area of the security lighting system.

FIG. 3 shows how glare is created when using prior art security lighting systems including light fixtures mounted atop tall light poles having a height of between 25-60 feet. The light fixtures generate an excessive amount of light that produces direct, blinding glare when individuals face toward the light fixtures. The methodology shown in FIG. 3 uses street, parking lot, highway, off ramp, athletic or wall pack lighting along the perimeter fence line. The lighting fixtures are placed on light poles complete with concrete footings 25-60 feet off grade, and 10-25 feet inside the protected fence line. Typical fixture spacing is usually one hundred or so feet apart from one another along the fence line. Similar to the method used to light a roadway or a parking lot, the lights effectively flood the entire area with light both inside and outside the fence line, which results in very high minimum to maximum and minimum to average lighting lux values. This does not provide effective security lighting because high light levels are coupled with large contrasting light values to create a difficult environment for the human eye to operate. In addition, this method, due to the mounting height of the light fixtures, creates glare at the head of each fixture.

Another disadvantage to using the 25-60 foot light poles shown in FIG. 3 is that the spacing distance between adjacent light poles and the height of the light fixtures results in the delivery of excessive light levels simply because of the physics of distributing light over such a large area. Typically upwards of thirty average lux across the ground surface is delivered (three foot candles) with a ten to one minimum to maximum illuminance level light value (illuminance=light falling on the ground) or a twelve to one minimum to average illuminance, which make the outer unlit areas darker and effectively creates a wall of darkness outside of the illuminated area. This wall of darkness occurs naturally because the iris of the human eye constricts to adjust to the overly bright illuminated areas under the pole lights and the glare given off by the light fixtures, thus making the unlit areas just outside the lit area much darker. In addition, this pole lighting method also creates glare at the head of the fixtures because of the height of the fixture off grade, which further blinds those on both the inside and/or the outside of the fence line, further constricting the iris of the eye. The blinding glare effects both intruder and security guards alike. The legacy pole lighting method is also extremely expensive to install, maintain and operate.

FIG. 4 shows another prior art security lighting system including light fixtures 58' mounted atop a light pole 66' and facing outwardly from a perimeter fence. The light fixtures 58' are pointed outward toward those approaching the fence line in order to blind intruders with direct glare and thus provide security personnel located inside the fence line with a tactical dark cover advantage. A drawback of the system shown in FIG. 4 is that the security personnel located inside the perimeter fence are in the dark and have no lighting to maneuver inside the perimeter fence, which leaves the inside of the fence vulnerable to attack if the exterior wall of light outside the fence is breached and intruders are able to enter the secure dark area. In addition, simply disabling one or two light fixtures creates a gap of darkness into the protected dark area behind the fence line. The human eye is simply unable to effectively scale the lighting brightness range from complete darkness to extreme brightness created using this type of lighting.

Many perimeter fences have an open mesh construction that allows light to pass through the fence and provides for an unobstructed view of a property. An open mesh construction allows for active on-site security monitoring both inside and outside the fence line. With the hardening of perimeter fences at many critical facilities, such as airports, military installations, and substations, the fence height is often increased from 8 feet to 10 feet, and anti-climbing features are incorporated into the fencing to create a nearly impenetrable perimeter fence line.

In many instances, the anti-climbing features include a "louvered mesh" or a tight-wire cell that eliminated any hand hold locations for an intruder to use when attempting to scale the fence. The tight-wire cell design provides a great way to secure a perimeter, but it proves challenging to illuminate this type of fence because the tight-wire cell design allows very little light to pass through. Moreover, mounting light fixtures 25-60 feet on large light poles that are typically spaced 100 or more feet apart unquestionably creates shadows with low plant material and provides intruders with a place to hide. As a result, the legacy security lights create dark shadows, which provide an ideal place for an intruder to hide. The darkness on the outside of the fence starts at the top of the fence and extends outward to the base. Shadow lengths may be as little as ten feet to as much as twenty feet depending upon the mounting height of the light fixture and the distance the pole lights are mounted inside the fence line. Such circumstances can make effective security lighting using legacy pole systems extremely difficult and extremely expensive.

FIG. 5 shows a perspective view of a prior art security lighting system whereby the light fixtures are mounted atop tall poles having a height of between 25-60 feet. In FIG. 5, the perimeter fence 52" is an anti-climb fence having a tight mesh or tight-wire cell design or using the newer non electrically conductive molded thick honeycomb cell composite style that will not allow light to pass when the light hits the fence at anything less than 45 degrees. The light pole 56" of the security lighting system is spaced about 15 feet inside the fence line of the perimeter 52". A first light fixture 58" mounted 25 feet above grade generates a 16 foot triangle of shadow darkness on the outside of the perimeter fence 52". A second light fixture 58B" mounted onto the light pole 56" at 40 feet above grade generates an 11 foot triangle of shadow darkness on the outside of the perimeter fence 52. FIG. 5 illustrates how mounting light fixtures at heights of 25-50 feet off grade will generate shadows on the outside of the perimeter fence, which may enable intruders to hide within these shadows whereby they cannot be observed by the security personnel located inside the perimeter fence.

In spite of the above advances, there is a continuing need for improved security lighting systems for perimeter fences that may be effectively integrated with the human eye and today's security camera technology.

There also remains a need for security lighting systems that mount light fixtures directly atop a fence line.

SUMMARY OF THE INVENTION

The human eye has an amazing ability to function in different light conditions. It has a natural mechanism that adjusts the iris of the eye to open and close automatically to maximize what the eye can see. When walking outside during the day, the iris quickly adjusts and constricts to optimize an individual's sight. If an eye is suddenly exposed to an excessive amount of light, the rods and cones of the eye go into protective mode and limit the light entering the eye. This physiological response to glare or excessive sudden bright light may result in seeing spots (i.e., artifacts) and/or mild disorientation until the eye can adjust.

The opposite response occurs at night when there is little to no light. In dark conditions, the iris naturally opens to its maximum level to allow more light into the eye, allowing individuals to see at night. The human eye does all this (i.e., closing and opening the iris) on its own without any conscious control by a human.

Understanding how the human eye works, it becomes apparent that more light may not necessarily be better when it comes to nighttime security lighting. Thus, when designing a security lighting system, it is important to understand how the human eye works so that a system may be built that capitalizes on this knowledge.

One important factor that has been ignored by security lighting designers is the fact that the human eye will always adjust to accommodate light levels that are very bright. At present, over-lighting has become the industry standard (e.g., the use of pole-mounted security lights), and unnecessary expenses have been made on equipment, energy, and resources that only cause the site to become darker in the surrounding unlit areas, creating hiding places for intruders, which does not enhance safety and security. While legacy lighting designs are adequate for uses such as parking lots and roadways where vehicles are traveling at high speeds, they are no longer acceptable for use in security lighting systems that are used in conjunction with perimeter fences.

Artificial light frequently generates glare. Glare situations may occur at night when the human eye is most sensitive, which is an important factor to consider when designing security lighting systems. Glare is not only a problem for the human eye, but also CCTV cameras used for security monitoring. Virtually all legacy pole-mounted lighting systems create glare.

There are two types of glare: disability glare and discomfort glare. According to the IESNA, disability glare is the effect of stray light in the eye whereby visibility and visual performance are reduced. On the other hand, discomfort glare produces only discomfort and may not interfere with visual performance or visibility.

Disability glare causes the light-sensitive rods and cones of the eye to become temporarily overloaded (i.e., bleaching the receptors of the eye), which renders an individual momentarily blind and susceptible to attack. The resetting of the human eye, or adaptation to darkness, can take anywhere from 15 to 120 seconds depending on the severity. This blindness creates vulnerability for onsite security personnel and should be eliminated or significantly reduced. That being said, disability glare can be a useful tool against intruders.

In addition to eliminating disability glare, utilizing the right light level will allow the eye to adjust to the artificial light and become comfortable in the night setting. This eye/site acclimation allows security personnel to see into the surrounding darkness, become better aware of the property, pick up movements that otherwise would be undetected, and respond more rapidly to threats than in a glare-filled environment.

Reflectivity and changing surface conditions occur frequently. Closed-circuit camera systems struggle with the reflectivity of changing ground conditions caused by rain on plant materials, puddles that create mirrored surfaces, and the reflective value of white snow. Overly-illuminated areas cause these conditions to worsen significantly, which interfere with camera images by creating unwanted glare. Thus, when using security cameras, the presence of glare reduces resolution quality and increases image contrast, making it more difficult to review captured or real time footage.

Vision is perhaps the primary sense that is relied upon by intruders, attackers and criminals. Once as individual is blinded by glaring light, it may take up to two full minutes for the eye to naturally adjust which also might give the intruder pause to reconsider the intended act.

Glare may be used in an active, offensive manner to disable intruders by temporarily blinding and/or disorienting the intruders. Thus, when designing a lighting system for advanced security lighting operations, the elimination of glare for security guards inside a protected perimeter is important, while using glare in an offensive capacity may provide a tactical advantage and dissuade, disrupt, identify, confuse, disorient and/or deter attackers or intruders. Thus, there is a need to a security lighting system having light fixtures that are designed for the dual purpose of using both glare and a glare free zone of light on the perimeter fence line and mounting these fixtures directly on a fence at a low distance off grade.

An important tenant of effective security lighting involves the elimination of blinding glare on security personnel in a nighttime environment. Glare disrupts the human eye and puts it in a state of shock which distorts depth perception, the ability to collect and process images, causes unwanted eye fatigue and makes the person experiencing glare ineffective at identifying intruders and threats which is the entire objective of security lighting in the first place. In addition, the production of an uneven light distribution when using an artificial light source that delivers light levels that have greater than a four to one minimum to maximum level and also to a lesser extent a four to one minimum to average such as the lumens often time delivered by street lights. These high contrasting and uneven light levels creates a difficult environment in which the human eye is to operate at the most efficient level and enables the eye to effectively transition from the extremely bright to dark areas. Ultimately, an overly illuminated area creates extremely dark areas outside the illuminated area footprint which allows intruders places to hide.

Therefore, a need exists to deliver an even distribution of light across the perimeter fence line at a brightness (lux) level that works in conjunction with the low light levels found in natural darkness just outside the foot print of the illuminated lighting area. In one embodiment, a lighting fixture preferably does not emit glare that blinds on site security personnel, which yields them tactically ineffective. In addition, the introduction of a "Tactical Glare Zone" that blinds intruders once they step into a glare zone area will dissuade intruders from attempting to breach a perimeter fence line and make intruders less effective when in this glare zone during an attempted breach/intrusion of the perimeter fence line. These features are a substantial advantage and enhancement to the existing high voltage perimeter fence mounted security lighting systems and far better than the light delivered by the typical street light used for the same purpose.

In one embodiment, the light level that is deployed in the perimeter security lighting system disclosed herein takes into account the sensitivity of the human eye as it moves through ranges of brightness in the illuminated area and also takes into consideration the eye's operating range during night time darkness conditions. Light level examples are provided below.

| Examples of light levels | Lux |
|---|---|
| Twilight (i.e. just after sunset) | 10.75 |
| Deep Twilight 10% of twilight | 1.08 |
| Full Moon | 0.108 |
| Quarter Moon | 0.0108 |
| Starlight | 0.0011 |
| Overcast Night | 0.0001 |

During a full "Harvest Moon" with no clouds in the sky, the horizontal Lux falling on the ground is typically 0.108, which is about one tenth (1/10) of a Lux. Once a human eye has adjusted to this Lux level, the human eye can make out the physical surroundings and navigate through the surroundings. Since the advent of artificial lighting, security lighting designers have been perplexed by the question of how much light is enough.

Most lighting designs use the common horizontal lux or foot candle light distribution plot to design any lighting system layout. This plot is essentially a scaled numeric rendering displaying in a grid format the amount of light that will fall on the "horizontal" ground surface using a chosen lumen fixture, beam spread, fixture spacing and mounting height. The light that hits the horizontal ground surface is referred to as horizontal illuminance. The light that reflects off walls and lands on objects (e.g., a person's face) is referred to as vertical illuminance. Previously, security lighting designers have ignored vertical illuminance, but its use in designing security lighting designs provides a valuable security tool.

According to the IESNA, "one lux of vertical illuminance is sufficient to obtain a 90 percent probability of correct detection of an approaching person (but not facial recognition)." In 2003, the IESNA stated, "Facial recognition can be made at levels as low as 2.5 lux. The IESNA Security Lighting Committee recommends that for facial identification the minimum vertical illuminance should be 5.0 lux."

One inherent flaw when using legacy pole-mounted light fixtures mounted twenty (20) feet or higher above grade and typically spaced 100 or more feet apart is the difficulty projecting vertical illuminance on faces for identification, to read body language, to identify those who are familiar or threatening, and for security camera image capture. In one embodiment, a perimeter fence security lighting system disclosed herein resolves this issue by placing security lighting fixtures about ten to twelve (10-12) feet off grade with spacing of twenty to thirty (20-30) feet apart, which provides light closer to the subject, and better, more directed light that delivers both horizontal and vertical illuminance to enhance both camera imaging and on-site security detection.

Designing a security lighting system extends far beyond simply illuminating a perimeter. It requires precise science that involves analysis, customization, and innovation.

According to independent studies on crime conducted by the Illinois Coalition for Responsible Lighting, shadows, blinding glare, overly bright nighttime illumination, and uneven illumination are key contributors to creating unsafe situations.

In one embodiment, a light fixture for a security lighting system preferably includes an elongated pipe having a lower pipe section and an upper pipe section, and an articulating joint coupling a lower end of the upper pipe section with an upper end of the lower pipe section for enabling the upper and lower pipe sections to articulate relative to one another. In one embodiment, the articulating joint enables to the upper pipe section to selectively be rotated and articulated relative to the longitudinal axis of the lower pipe section.

In one embodiment, the light fixture preferably includes a junction box secured to the lower end of the lower pipe section, and a clamping element coupled with the junction box for securing the light fixture to a post of a fence.

In one embodiment, the light fixture preferably includes a glare shroud secured to the upper end of the rigid upper pipe section, the glare shroud having a reflective concave surface that forms an underside of the glare shroud that faces toward the junction box. In one embodiment, the glare shroud preferably rotates and articulates with the upper pipe section as the upper pipe section rotates and articulates relative to the lower pipe section.

In one embodiment, the light fixture desirably has one or more LEDs secured to the reflective concave surface of the glare shroud, whereby each LED has an optical lens configured to pass light having a beam angle of 137-156 degrees.

In one embodiment, the lower and upper pipe sections are rigid and made of metal.

In one embodiment, the articulating joint is closer to an upper end of the elongated pipe than a lower end of the elongated pipe. In one embodiment, placing the articulating joint closer to the upper end of the elongated pipe enhances the stability of the light fixture when the light fixture is mounted onto a fence post.

In one embodiment, the articulating joint desirably includes a universal ball joint and a locking element moveable between an unlocked position in which the upper pipe section is free to rotate and articulate relative to the lower pipe section and a locked position in which the for upper pipe section is prevented from rotating and articulating relative to the lower pipe section.

In one embodiment, the universal ball joint enables the upper pipe section to rotate 360 degrees about a longitudinal axis of the lower pipe section and articulate 40 degrees in either direction off a plumb line that extends along the longitudinal axis of the lower pipe section. Thus, in one embodiment, the upper pipe section may initially be vertical with the lower pipe section, but may be angulated outwardly up to 40 degrees so that it is positioned outside the fence line and angulated inwardly up to 40 degrees so that it is positioned inside the fence line, and any angles in between 40 degrees outward and 40 degrees inward.

In one embodiment, the junction box preferably contains electrical components including a microprocessor for controlling operation of the light fixture. The junction box may have one or more removable cover plates, which are removed for accessing the electrical components and making electrical connections.

In one embodiment, the light fixture preferably includes a mounting bracket coupled with a rear wall of the junction box. In one embodiment, the mounting bracket has first and second spaced openings that extend from a rear face to a front face of the mounting bracket.

In one embodiment, the clamping element defines a U-shaped element having first and second free ends that pass through the first and second spaced openings that extend from the rear face to the front face of the mounting bracket. Locking nuts may be used for securing the clamping element with the mounting bracket.

In one embodiment, the junction box preferably has a rear wall including a lower edge with two spaced mouse holes formed therein that are configured for assembling the junction box with the mounting bracket. In one embodiment, two screws that are threaded into the mounting bracket are nested into the mouse holes for hanging the junction box on the mounting bracket.

In one embodiment, the reflective concave surface of the glare shroud preferably includes a flat underside surface that extends outwardly from a center of the glare shroud and a sloping underside surface that slopes outwardly and downwardly toward an outer perimeter edge of the glare shroud.

In one embodiment, the one or more LEDs secured to the glare shroud may include a first 2×2 LED matrix secured to a first side of the flat underside surface of the glare shroud, and a second 2×2 LED matrix secured to a second side of the flat underside surface of the glare shroud.

In one embodiment, the light fixture includes conductive wiring connected to the light fixture, and a transformer coupled with the conductive wiring, wherein the transformer produces extra low voltage that does not exceed 50 volts, and wherein the light fixture operates on extra low voltage that does not exceed 50 volts.

As used herein, the terminology extra low voltage (ELV) means an electricity supply voltage in a range that does not exceed 50 volts (e.g., 12-25 volts, 12-50 volts) that carries a low risk of dangerous electrical shock. There are various standards that define Extra-Low Voltage (ELV). The International Electrotechnical Commission (IEC) member organizations and the UK IET (BS 7671:2008) define an ELV device or circuit as one in which the electrical potential between conductor or electrical conductor and earth (ground) does not exceed 50 V AC or 120 V DC (ripple free). EU's Low Voltage Directive applies from 50 V AC or 75 V DC. For a discussion of the industry definition of the terminology "extra-low voltage" see https://en.wikipedia.org/wiki/Extra-low_voltage According to Encyclopedia Magnetica, extra-low voltage or ELV is nominal voltage not exceeding 50 V AC or 120 V DC (ripple-free) between conductors or to earth—as defined for instance by standards EN 61558 or BS 7671. ELV is used in order to reduce the danger of electric shock. With ELV the danger of serious harm is significantly smaller when compared to normal mains voltage (e.g. 220-240V in the UK).

See http://www.encyclopedia-magnetica.com/doku.php/extra-low_voltage

There are three types of ELV systems: SELV, PELV and FELV. The security lighting system disclosed herein may utilize any of the ELV systems outlined in this document.

Such voltages can be generated with the use of a safety isolating transformer as defined in the standard BS 3535.

In a separated extra-low voltage (SELV) system the low-voltage output is electrically separated (galvanically) from earth and other systems. Therefore, a single fault cannot create a risk of an electric shock. There should be no provision for earthing of an SELV circuit.

In certain locations, e.g. swimming pools or for medical apparatus it is the only measure permitted. However, because there is always a risk of electric shock then the requirements can be even more stringent, e.g. nominal voltage limited to 12 V AC or 30 V DC.

SELV voltage can be generated for instance from a battery. However, it can be also generated by means of a SELV transformer, but the construction requires high-integrity equipment and materials. This is in order to ensure adequate isolation from the primary voltage (mains voltage) which is much more dangerous. This is achieved for instance by double insulation or reinforced insulation.

A SELV transformer must be an isolation safety transformer and must comply for instance with the requirements of EN 61558. The design requires special insulation tests to verify the integration of the construction.

By definition, SELV is a unearthed system, so where required overcurrent devices must be fitted in both live conductors.

PELV. In a protective extra-low voltage (PELV) system there is no separation from earth, but otherwise the system satisfies all other requirements for SELV, including the voltage levels. In a PELV transformer (similarly to a SELV transformer) the magnetic core and the enclosure can be connected to earth (see the image).

FELV. A functional extra-low voltage (FELV) system can be used just for functional purposes, for instance for machine control systems. Protection against direct contact (basic protection) must be provided by insulation, barriers and enclosures—this includes a FELV transformer used for generation of voltage in a FELV system. In a FELV transformer, the magnetic core does not have to be earthed.

In one embodiment, a security lighting system desirably includes a perimeter fence having vertical posts spaced from one another along a fence line, the vertical posts having a height of 8-12 feet off grade, and security lighting fixtures mounted on at least some of the spaced vertical posts, whereby the security lights are spaced 10-30 feet from one another and have upper ends defining a height of 9.5-13.5 feet off grade.

In one embodiment, the security lighting system may be mounted onto an existing fence.

In one embodiment, the system preferably includes conductive wiring interconnecting the security lighting fixtures, and a transformer coupled with the conductive wiring, whereby the transformer produces extra low voltage that does not exceed 50 volts.

In one embodiment, each security lighting fixture of the system may include an elongated pipe including a lower pipe section and an upper pipe section, and an articulating joint coupling a lower end of the upper pipe section with an upper end of the lower pipe section for enabling the upper and lower pipe sections to articulate relative to one another.

In one embodiment, a junction box is preferably secured to the lower end of the lower pipe section, and a clamping element is coupled with the junction box for securing the security lighting fixture to one of the vertical posts.

In one embodiment, a glare shroud is secured to the upper end of the rigid upper pipe section, whereby the glare shroud has a reflective concave surface that forms an underside of the glare shroud and that faces toward the junction box.

In one embodiment, one or more LEDs are secured to the reflective concave surface of the glare shroud, whereby each LED is adapted to generate light having a beam angle of 137-156 degrees.

In one embodiment, the lower and upper pipe sections are rigid and made of metal, and the articulating joint is closer to an upper end of the elongated pipe than a lower end of the elongated pipe. Placing the articulating joint closer to the upper end of the elongated pipe enhances the stability of the light fixture so that the upper pipe section does not move once locked in place relative to the lower pipe section.

In one embodiment, the articulating joint preferably includes a universal ball joint and a locking element moveable between an unlocked position in which the rigid upper pipe section is free to rotate and articulate relative to the rigid lower pipe section and a locked position in which the rigid upper pipe section is locked in place and prevented from rotating and articulating relative to the rigid lower pipe section.

In one embodiment, the reflective concave surface of the glare shroud desirably has a flat inner surface that extends outwardly from a center of the glare shroud and a sloping outer surface that surrounds the flat inner surface and that slopes outwardly and downwardly toward an outer perimeter edge of the glare shroud.

In one embodiment, the glare shroud has a convex top surface including heat fins projecting from the convex top surface and a gutter adjacent the outer perimeter of the glare shroud.

In one embodiment, the glare shroud has a first end, a second end, and a longitudinal axis that extends from the first end to the second end. In one embodiment, the glare shroud preferably includes a first drainage opening located at the first end that intersects with the gutter and a second drainage opening located at the second end that intersects with the gutter.

In one embodiment, the one or more LEDs may include a first 2×2 LED matrix secured to a first side of the flat underside surface of the glare shroud, and a second 2×2 LED matrix secured to a second side of the flat underside surface of the glare shroud.

In one embodiment, a security lighting system preferably has a perimeter fence having vertical posts spaced from one another along a fence line and wire mesh interconnecting the vertical posts, whereby the vertical posts have a height of 8-12 feet off grade. In one embodiment, the system desirably includes security lighting fixtures mounted on the spaced vertical posts, whereby the security lights are spaced 10-30 feet from one another and have upper ends positioned at a height of 9.5-13.5 feet off grade.

In one embodiment, conductive wiring interconnects the security lighting fixtures, and the system includes a transformer coupled with the conductive wiring, whereby the transformer produces extra low voltage that does not exceed 50 volts, and whereby the security lighting fixtures operate on extra low voltage that does not exceed 50 volts.

In one embodiment, each security lighting fixture preferably includes an elongated pipe having a lower pipe section and an upper pipe section, and an articulating joint coupling a lower end of the upper pipe section with an upper end of the lower pipe section for enabling the upper and lower pipe sections to articulate relative to one another.

In one embodiment, each light fixture preferably includes a junction box secured to the lower end of the lower pipe section, and a clamping element coupled with the junction box for securing the security lighting fixture to one of the vertical posts.

In one embodiment, each light fixture preferably includes a glare shroud secured to the upper end of the rigid upper pipe section and defining the upper end of the security lighting fixture, and one or more LEDs secured to an underside of the glare shroud, whereby each LED is adapted to generate light having a beam angle of 137-156 degrees.

In one embodiment, the underside of the glare shroud forms a reflective concave surface that faces toward the junction box. In one embodiment, the glare shroud has an outer perimeter, and the system includes a glare shroud extender that is attachable to the outer perimeter of the glare shroud for expanding an outer dimension of the glare shroud. In one embodiment, the glare shroud extender may be made of polymers or rubber.

In one embodiment, the lower and upper pipe sections are rigid and made of metal, and the articulating joint is closer to an upper end of the elongated pipe than a lower end of the elongated pipe.

In one embodiment, the articulating joint preferably includes a universal ball joint moveable between an unlocked position in which the upper pipe section is free to rotate and articulate relative to the lower pipe section and a locked position in which the upper pipe section is prevented from rotating and articulating relative to the lower pipe section.

In one embodiment, the system preferably includes a central processing unit for controlling operation of the system, and a motion sensor in communication with the central processing unit for generating alert signals that are transmitted to the central processing unit.

In one embodiment, each security lighting fixture preferably includes a programmable IP addressable chip that enables the security lighting fixture to communicate wirelessly, via Wi-Fi, and/or by signal over power line, and wherein the programmable IP addressable chips are in communication with the central processing unit.

In one embodiment, the system desirably includes a pin style cable insulator jacket piercing connector for coupling one of the security lighting fixtures with the conductive wiring. The connector may be similar to that shown in U.S. Pat. No. 6,568,952 or similar to the connector sold under the trademark POSI-TAP by Posi-Products of St. Augustine, Fla.

In one embodiment, a perimeter security lighting system preferably includes a plurality of perimeter security lighting fixtures that are mounted onto a perimeter fence, spaced every ten, twenty, or thirty feet apart. The system uses extra low voltage (e.g., an operating range between 12 to 25 volts AC or DC power) and the light fixtures are desirably attached atop a cyclone, panel, chain link, composite, fence posts or other fence systems. The security lighting fixtures may also be installed to the top of a solid wall such as poured concrete or cement block wall using a flange and pipe mount. Prior to the security lighting system disclosed herein, customers seeking perimeter security lighting where required to select one of two popular high voltage methods to illuminate the perimeter fence by adapting available existing high voltage lighting products (e.g., street lights, parking lot lights, highway lights, athletic field lights, and exit ramp lights) that were designed for an entirely different application to fit the need for perimeter security lighting.

In one embodiment, a security lighting system provides a low-voltage, fence-mounted security lighting solution used for perimeter security lighting, which is designed to meet the needs of security professionals, closed circuit camera systems, the outdoor environment, and interaction with the human eye.

Although the security lighting system disclosed herein does not rely on any particular theory of operation, it is based upon the recognition that the human eye does not require a lot of light during nighttime conditions to effectively navigate and survey surroundings at night, and that conventional security lighting systems require excessive amounts of money on excess lumens, power, and infrastructure that produces a light level that is ineffective in most security lighting applications.

In one embodiment, a security lighting system for a perimeter fence generates an evenly-distributed, lower level, glare-free lighting system that matches the optimal and natural light level for the human eye with the proper light levels the onsite camera systems is the goal of any optimized perimeter security lighting system.

In one embodiment, the security lighting system disclosed herein is specifically designed for attached to a perimeter fence including those fence systems using the new tight-wire cells and honeycomb composite cells.

In one embodiment, the security lighting systems disclosed herein use light fixtures that are positioned closer to the ground to avoid unsafe situations that create vulnerability, breaches in security, and poor image capture.

In one embodiment, the security lighting system disclosed herein provides for even illumination on both the inside and the outside of the fence line, thereby eliminating any space where a perpetrator can hide while also producing better camera images and an overall better security lighting solution.

In one embodiment, the security lighting system disclosed herein is easier to install, easier to maintain, and provides a 60-80 percent savings to the end user compared to legacy pole mounted systems.

In one embodiment, the security lighting system disclosed herein recognizes that uniformity of light is far more important than the amount of light falling on the ground. Even, consistent light distribution spread across an entire perimeter fence line is desired to avoid eye fatigue, eyestrain, and quality night camera images. Avoiding contrasting brightness levels, especially total darkness (i.e., "black holes") to full brightness (i.e., "light bombs") is paramount for security personnel and camera systems. Systems that produce black holes and light bombs should be avoided at all costs as security guards will quickly experience eye fatigue thus diminishing their effectiveness. Such extremes of uneven light levels severely reduce an individual's ability to process images and capture site specific threats. The security lighting system disclosed herein provides even and consistent light distribution across an entire fence line or property border eliminating hot spots, black holes, or light bombs with a light level that bleeds off gradually into the darkness to extend the range of the viewing field.

According to the IESNA, light uniformity refers to the evenness of light distribution on surfaces. For security lighting, the smaller the change between the minimum and maximum light levels, the better the eye adapts to the changing light levels at night. This reduces the necessity for eye adjustment when scanning or using an area, making it more comfortable and effective for security guards to do their job while improving the CCTV camera images at the same time. A common uniformity ratio for security lighting is 4:1 minimum to maximum horizontal illumination, i.e., the light falling on the ground. For example, 10 lux divided by 2.5 lux equals the 4:1 ratio.

The human eye has an amazingly effective working range. For example, the brightest full moon (i.e., a harvest moon) is only 0.108 lux, while the typical lux value on a sunny summer day at noon is 107,527 lux. Most high quality 2-megapixel cameras and the human eye operate quite well at between 2 to 4 lux. The security lighting system disclosed herein delivers the right light lux level for both effective camera imaging and optimal eye performance at night with the added benefit of greatly reduced glare for both, which achieves the main objective of producing a more secure site condition.

Legacy pole-mounted light covers much larger areas, but the pole spacing is usually about 100 feet apart. As a result, should a legacy pole-mounted fixture fail, the resulting unlit area is considerable, which creates significant vulnerability to the security of the perimeter. In contrast, in one embodiment, the security lighting system disclosed herein places light fixtures on fence posts that are about 20 feet to 30 feet apart. Should one of the light fixtures fail or break, coverage is not completely lost as the two adjacent light fixtures will provide overlapping or backup light coverage. This redundancy is extremely valuable when properly securing a defensive perimeter.

Combination day/night surveillance cameras operate as two cameras in one, a day light camera during the day and in infrared camera at night. All video surveillance camera systems use some sort of digital storage to record events or perform video analytics, and the cleaner the image, the less storage space that is required on a digital video recorder (DVR) or cloud storage system. Better image quality lowers bandwidth and maintains a high frame rate, providing better real-time video. Even the best night cameras provide noisy images in darkness. This noise on the screen, which resembles snow, is the result of low-light conditions, which can require 50 to 100 percent additional data storage than during daylight image capture. Thus, a need exists to improve surveillance images at night while, at the same time, reducing the data storage requirements of the system. This is especially important when dealing with large surveillance systems as the data space requirement can add up exponentially. The security lighting system disclosed herein applies the right amount of light to enhance camera image quality and also decreases the data storage requirements of the camera system at night.

When selecting a security system, it is important to choose either a passive security system or an active security system. With a passive system, security personnel are made aware of an event after it occurs, and a recorded video must be played to see what happened and to enlist police investigators and insurance companies for assistance. An active system notifies security personnel when an event is underway, allowing personnel to take immediate action before the crime or event is over. For example, a CCTV surveillance system can send a signal to the owner, police, and/or monitoring center during an event and dispatch resources to stop the threat.

When coupling lighting with these proactive solutions, security personnel may gain a tactical advantage by slowing down the threat, exposing the intruder, and causing him or her to pause or retreat. Intruders do not like to be seen. The ability to disorient intruders when they are first detected will usually cause the perpetrator to think twice. This may be accomplished by dimming lights or turning them on or off repeatedly to disorient the intruder.

A good security plan preferably contains layers of security features, and does not rely on any one single security measure for success.

Special Forces use stun grenades to blind, deafen, and disorient combatants. Local police use light to blind possible threats during evening traffic stops. Drivers are often annoyed by high beam light generated by oncoming traffic. Blinding glare is a tool that disables assailants and may be deployed tactically to provide a perimeter security advantage.

In one embodiment, a security lighting system has security lighting fixtures that use precision optics, specific illuminance values, minimum to maximum ratios, electrical efficiency, and security lighting to create low level, uniform lighting that may be used to provide a tactical advantage. In one embodiment, by strategically positioning a precision light beam angle with an accompanying glare shroud and mounting the light fixtures on top of a fence, the security lighting system disclosed herein produces a tactical blinding glare solution in what is termed the "glare zone" as well as a "glare-free observation zone" for on-site security personnel.

In one embodiment, the glare zone extends from 22-45 feet from the fence line, on both the inside and outside of the fence, depending upon the mounting height of the light fixture. Intruders approaching the fence enter the glare zone where they are exposed to blinding disability glare that will likely deter their advance. At the same time, security guards can monitor this activity from a glare-free observation zone, providing a tactical advantage for the guards to remain virtually out of sight while observing anyone in the glare zone. Essentially, the glare-free observation zone is equivalent to a sun visor, allowing the security guards to see more clearly without being exposed to the blinding glare.

In one embodiment, the security lighting system disclosed herein may be integrated to work in unison with existing intrusion detection systems to create effective zones of protection. In one embodiment, during an intrusion, the light fixtures of the security lighting system may be triggered to operate for a specific duration or setting coinciding with the specific detection zone. The lighting may be set for a host of activities when an intrusion occurs such as: 1) Turning on; 2) Turning off; 3) Blinking; 4) Dimming or brightening; and/or 5) Switching from IR to white light.

In one embodiment, the perimeter security lighting system may be include a relay that cycles from full on to total darkness every forty-five (45) seconds, essentially never allowing an intruder's eye to fully reset, and causing extreme visual disorientation. In one embodiment, this feature may be activated via a simple dry contact or power signal provided by any intrusion detection system and may be adjusted by the end user for cycle time and duration settings.

In one embodiment, the security lighting system disclosed herein preferably optimizes the light source and output to enhance the interaction of light with the human eye and improve closed-circuit camera system imaging. In one embodiment, the perimeter security lighting system requires minimal maintenance, and completely eliminates the need to pour concrete footings, install light poles, trench conduit, and backfilling, which reduces installation expenses and material savings by as much as eighty (80) percent compared to legacy pole-mounted systems. In one embodiment, the perimeter security lighting system preferably uses safe low-voltage power, long-life LEDs, and may be custom designed for any size project, or purchased in ready-to-install lighting kits, ranging from 80 to 1200 feet in length.

In one embodiment, the perimeter security lighting system uses low-voltage (e.g., 12 to 24 volt power) so that there is never a need to worry about the risks of installing dangerous high-voltage power on the fence line. Low voltage is safe and easy to install and maintain. Unlike 120 volt, 208 volt, 220 volt and 277 volt systems that bury power lines, in a 12 to 24 volt system, the conductive wires used to power the light fixtures are attached directly to the fence, which significantly reduces installation time and labor expenses. Because the security lighting system is low voltage, it is not necessary to hire a licensed electrician to design and install the lighting, which saves money and allows certified low-voltage technicians to install the system.

Legacy pole-mounted street lighting fixtures require large concrete footings, construction cranes, bucket trucks, high-voltage power and yearly maintenance. When the pole-mounted fixtures require servicing, which could be in a remote area, the task requires coordinating sophisticated equipment and expert personnel that are very expensive and often times not readily available. In contrast, the security lighting system disclosed herein uses safe low-voltage power, requires only a stepladder, a pickup truck, and one man to repair or maintain. Thus, the system disclosed herein may be quickly and easily installed, serviced, and maintained, which is extremely important when considering placing critical high-value perimeter security applications in remote locations.

The perimeter security lighting system disclosed herein is dark-sky compliant. In 1988, the nonprofit International Dark-Sky Association was founded to protect the night skies and advocate for environmentally responsible outdoor light solutions. The perimeter security lighting system disclosed herein meets the Illuminating Engineering Society of North America (IESNA) classification for "full cutoff" optics and reducing high-angle brightness. In other words, the light angles do not exceed 90 degrees, and therefore adhere to the Modern Light Ordinance, which regulates outdoor lighting in North America to help reduce glare, light trespass, and skyglow.

In one embodiment, the perimeter security lighting system disclosed herein uses 50 to 80 percent less material cost than traditional lighting systems; requires 50 to 80 percent less labor cost than traditional lighting systems; uses a safe, low-voltage 12 to 24 volt power supply; uses low 7 to 28-wattage consumption models available to save ongoing energy costs; uses LEDs having a life expectancy of 65,000 hours LEDs; is simple and fast to install; and mounts easily to a fence, a post, a pillar, or a wall.

In one embodiment, the design and installation of the perimeter security lighting system is customized based on the following criteria: 1) the height of the fence or wall; 2) the length of the fence or wall; 3) fence post or column spacing; 4) average lux or lumen value; 5) the location of the power source and voltage; and 6) the intrusion detection system plan selected by the end user.

In one embodiment, a perimeter security lighting system may be provided in a kit containing all of the components that are needed to cover a perimeter fence line having a length of 80 feet, 150 feet, 250 feet, 500 feet, 750 feet, 1000 feet, or 1,200 feet using 120 volt, 208 volt, 277 volt or 220/230 volt power.

In one embodiment, the perimeter security lighting system disclosed herein enables security personnel to use light for obtaining a tactical advantage. This invention involves creating two distinct zones of light with the fixture's optical pattern and fixture light shroud design. In particular one lighting zone acts as a glare free zone and the other zone contains blinding glare. Zone one we will identify as the outer most lighting zone which is the "glare free zone". This zone is designed to create the optimal light level to allow the human eye the ability to seamlessly transition throughout the entire illuminated area and then into the surrounding darkness all in a completely glare free environment and designed around the best low level lighting (lux distribution) level conditions for the human eye to operates in. The second zone which is closest to the fence is designed specifically to create a targeted "Blinding Glare Zone". This "Glare zone" varies in width according to the fixtures placement off grade and encompasses a radius of from 20' to 40' feet from the perimeter fence line.

In one embodiment, a perimeter fence security lighting system provides a wide diameter of evenly distributed light at a low minimum to maximum lux level and minimum to average level across both the inside and outside of the fence line, which allows a human eye to transition from the brighter levels into the lower outer levels of the beam spread produced by the perimeter security light and ultimately into the outer dark areas that are not illuminated. The system accomplishes the above without producing any glare for the on-site guards, and at a lux light level that allows for optimal human nighttime eye function and the additional objective of adequate illumination to enhance the image capture of closed circuit camera systems.

In one embodiment, a security lighting systems includes a plurality of spaced security lighting fixtures that deliver a light level of about 25.52 lux along a fence line of a perimeter fence. Using the industry standard for optimal light delivery (i.e., four to one minimum to maximum light level calculation for optimal eye transition in any illuminated area), calculates to a working illuminated area of roughly 35 feet from the fence line (radius). With a diameter of coverage equal to 70 feet. (+−10% i.e. 25.52 lux/4=6.38 lux with the average at 11.27 lux) This optimal lux level allows for eye transition from the higher to lower light levels being produced by the fixture and then allows an easier transition into the unilluminated surrounding unilluminated darkness. By having the light at the distance bleed off from 3.0 lux at 45 feet, then 2.0 lux at 50 feet, then 1.0 lux at 58 feet, then 0.5 lux at 66 feet. and finally 0.20 lux at 80 feet, then the site lighting will naturally blend into the surrounding darkness and the eye can naturally adjusts into this outer zone of darkness to a harvest moon lux level of 0.108 lux (see the above chart for natural nighttime lux values). The ability for security guards to see into the darkness is very important and the security lighting system disclosed herein achieves this by not over lighting the fence line area with excessive light, using lower lux values to start with, covering a large area, and then bleeding this light off into the natural darkness. This is done by placing the light fixture on the fence at heights that range from seven feet to fifteen feet, and spacing the fixtures apart from ten to thirty feet, using a lower lumen LED configuration and delivering a precision optical patterns ranging from between 137 degrees and 156 degrees depending upon the mounting height of the fixture head. It is important to note that once a site is bathed in excess light it causes the human eye to constrict limiting light entry into the iris which then causes the darkness to be much darker than a constricted iris will be capable of seeing into. High pole mounted fixtures are constrained by the large area of coverage and distance from the ground and simply cannot deliver a low and even light distribution light pattern that is delivered by the security lighting system disclosed herein. In one embodiment, the security lighting system disclosed herein is designed to provide a light level for optimal camera imaging, human eye interaction, glare elimination, the creation of tactical targeted glare zone which ultimately allows the human eye to transition into a full moon darkness setting, which provides for the highest level of security lighting available on any perimeter fence line.

In one embodiment, a security lighting fixture has an LED and a drive circuit that operates the LED Diode that is designed to operate in a range between 10 to 50 Volts using both AC and DC power. In one embodiment, the system operates in an extra low voltage range of about 12-25 volts AC or DC.

In one embodiment, an installer may need the ability to fine tune a design by increasing the beam spread or decreasing the beam spread or adjusting for glare. This may requires either a slightly higher or a slightly lower security lighting fixture height. Having a fixed mounting pipe may limit the installer's options. In one embodiment, a security lighting fixture has a telescoping height adjustment feature. In one embodiment, one pipe above an articulating knuckle is smaller than a pipe connected to the glare shroud, which enables the installer the ability to raise or lower the light fixture if required on site by simply loosening a set screw or a compression nut making the height adjustment and then tightening the set screw or compression nut. In one embodiment, in order to decrease the fixture's height, the lower pipe section under the articulating knuckle may be removed entirely by simply loosening set screws and disconnecting the power wires feeding the LED's from the drivers located in the junction box, removing the pipe, and then reassembling the articulating knuckle to junction box.

In many instances, when a lighting fixture is placed outside during a rain storm water droplets due to capillary action and surface tension will hang along the outer perimeter edge of the glare shroud of a lighting fixture. These hanging rain droplets may comes in contact with the optical pattern of the light exiting lighting fixture and subsequently creates optical prisms and glare points on fixture. This glare is undesirable in a security setting and must be reduced and eliminated. These water droplets may also disrupt the lighting pattern of the fixture. In one embodiment, the glare shroud has a gutter design that is adapted to capture the rain water that would otherwise drain over the edge of the fixture. The gutter design preferably discharges the water that collects atop the glare shroud and directs the water to the left and right sides of the light fixture, thereby eliminating the front or rear facing water droplets that would otherwise be visible to the security personnel and reducing the glare that these water droplets create (allowing for better human eye interaction in a nighttime setting).

In one embodiment, a security lighting fixture has a structure for removing rain water that is collected atop the glare shroud. In one embodiment, the glare shroud channels the rain water along inner fins of a casting that is set lower than the other fins effectively acting like a funnel and connecting to an inner gutter drain line contained inside the fixture's mounting pipe, and discharging the rain water at the bottom of the fixture's wiring compartment or junction box. In one embodiment, the drain feature includes a mesh filter to prevent the inner drain line from collecting debris and plugging up the inner mounting pipe drain line.

In one embodiment, a glare shroud includes water draining channels located at the top of the glare shroud that channel rain water along the top of the glare shroud to either end where it may be drained off on either side of the glare shroud.

These and other preferred embodiments of the present patent application will be described in more detail below.

BRIEF DESCRIPTION OF THE DRAWINGS

FIG. 18-1 shows a magnified view of a lower end of the security lighting fixture shown in FIG. 18.

FIG. 24-1 shows an inner section of the light pattern shown in FIG. 24.

FIG. 24-2 shows an outer section of the light pattern shown in FIG. 24.

DETAILED DESCRIPTION OF PREFERRED EMBODIMENTS

Figure 6:
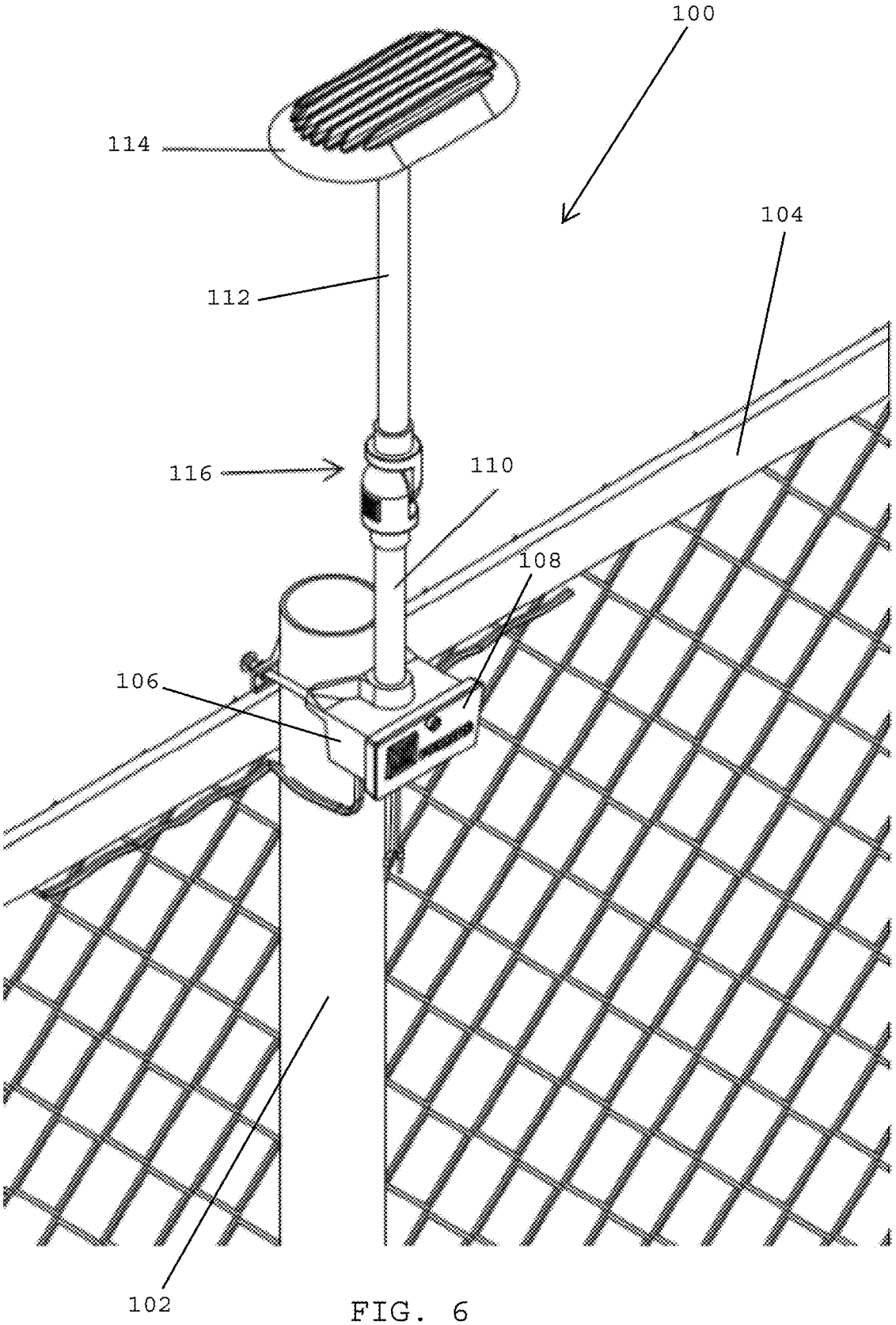
FIG. 6 shows a perspective view of a security lighting system for a perimeter fence, in accordance with one embodiment of the present patent application.

Referring to FIG. 6, in one embodiment, a security lighting system for a perimeter fence preferably includes a security lighting fixture 100 mounted atop a vertical pole 102 of a perimeter fence 104. In one embodiment, the security lighting fixture 100 has a lower end that is mounted onto the vertical pole 102 of the perimeter fence 104. In one embodiment, the lower end of the security lighting fixture 100 preferably includes a junction box 106 that is adapted to contain electrical components and circuitry for providing power to the security lighting fixture and controlling operation of the security lighting fixture. In one embodiment, the lower end of the security lighting fixture 100 preferably includes a front cover 108 that covers the front of the junction box 106. The front cover 108 may be removed for accessing an opening at the front of the junction box 106.

In one embodiment, the security lighting fixture 100 includes a lower pipe section 110 that extends upwardly from the junction box 106. In one embodiment, the lower pipe section extends vertically away from a top surface of the junction box. The security lighting fixture desirably includes an upper pipe section 112 that is located between the lower pipe section 110 and a glare shield 114 that defines an upper end of the security lighting fixture.

The security lighting fixture 100 preferably includes an articulating knuckle 116 or joint that couples an upper end of the lower pipe section 110 with a lower end of the upper pipe section 112. The articulating knuckle 116 enables an on-site installer to change the angle of the upper pipe section relative to the lower pipe section to accommodate for grade changes in the landscape topography in order to align the beam angle of the light generated by the security lighting fixture 100 to better suit the existing grade conditions and/or topography that surrounds the perimeter fence. In many instances, perimeter fences are installed on hillsides with the fence posts installed perfectly level and true at a 90 degree angle when the grade is running up or down hill. In some instances, a perimeter fence may be positioned on a flat grade with the grade on the outside of the perimeter fence going uphill or downhill. By providing an articulating knuckle 116 or articulating joint, the security lighting fixture 100 disclosed in FIG. 6 enables an installer to adjust the orientation of the upper pipe section 112 so that the optics on the underside of the glare shield 114 may be aligned with the existing on-site grade conditions. In one embodiment, the articulating knuckle 116 allows for 360 degree rotation of the glare shroud 114 and angulation adjustment left to right from true 0 degrees to 90 degrees both inside and outside the perimeter fence 104. This adjustability allows the installer to fine tune the orientation of the light pattern emanating from the security lighting fixture so that the light pattern is aligned with the existing grade for fully illuminating the land surface with the beam angle of which the security lighting fixture was designed for. Without the adjustability capability, the light generated by the light fixture may be too bright in some areas and not bright enough in other areas. The lack of adjustability may also cause direct glare to security personnel located in the vicinity of a security light fixture.

In one embodiment, the articulating knuckle 116, positioned between the lower and upper pipe sections 110, 112, preferably enables for very slight and/or minuscule angular lighting adjustments within an adjustment range. Should a situation arise whereby light is required to shine on a wall or other vertical surface, the upper pipe section 112 and the glare shield 114 may be easily rotated a full 90 degrees. This capability allows a light fixture to be attached to a lower pipe section 110 that is not at true and 90 degree plumb to grade, and allows the installer the ability to make slight adjustments so that the security lighting fixture is mounted 90 degrees to grade located at the lower end of the vertical post 102.

In many instances, when a security lighting fixture is placed outside during a rain storm, water droplets, due to capillary action and surface tension, will hang along the outer most bottom edge of the glare shroud 114 (FIG. 6). These hanging rain droplets then come in contact with the optical pattern of the light exiting the security lighting fixture and subsequently create optical prisms and glare points on the security lighting fixture. This glare is undesirable in a security setting and is preferably reduced and eliminated. The water droplets also disrupt the lighting pattern of the security lighting fixture.

Figure 7A:
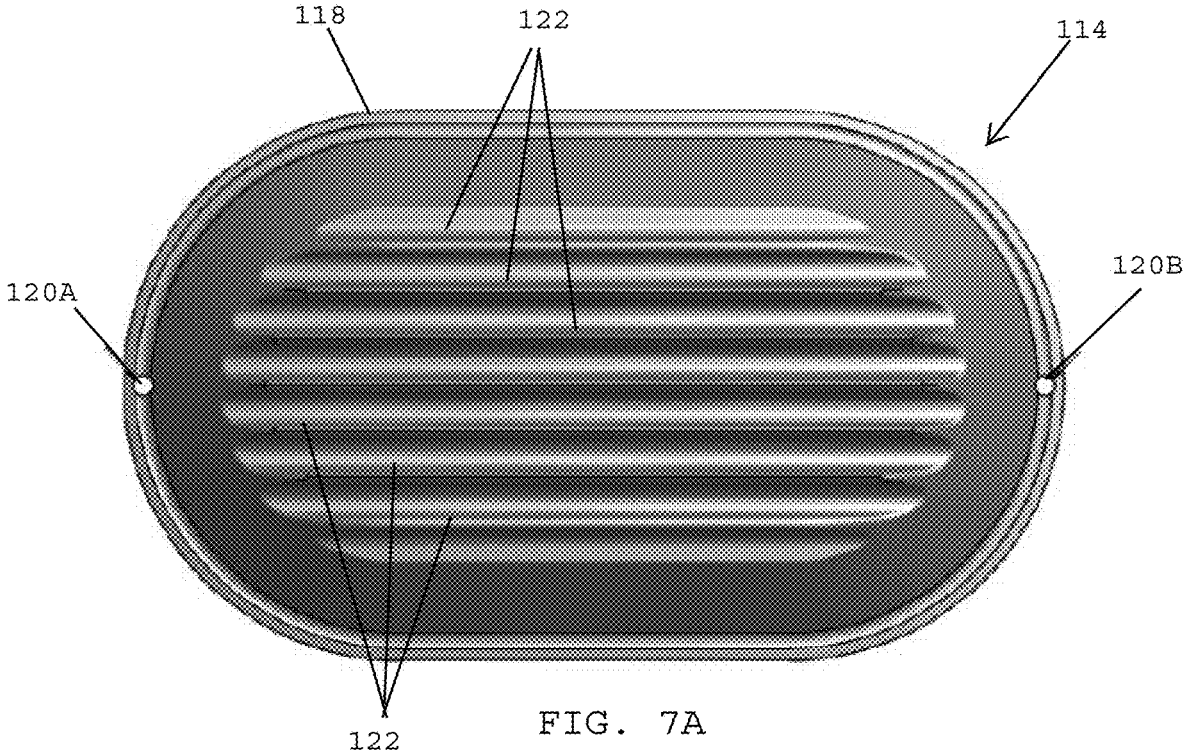
FIG. 7A shows a top plan view of a glare shroud for a security lighting fixture, in accordance with one embodiment.
Figure 7B:
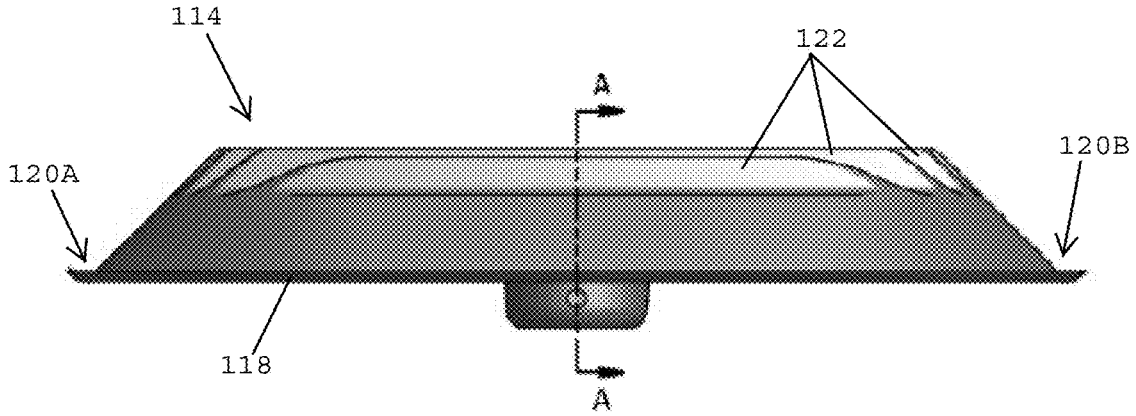
FIG. 7B shows a side elevation view of the glare shroud shown in FIG. 7A.
Figure 7C:
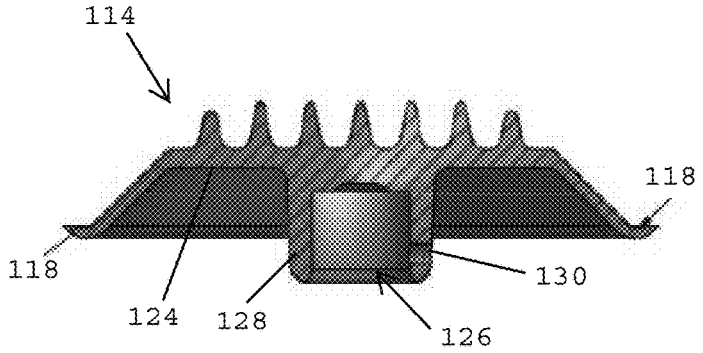
FIG. 7C shows a cross sectional view of the glare shroud shown in FIGS. 7A and 7B.

Referring to FIG. 7A-7C, in one embodiment, the glare shroud 114 preferably has a perimeter edge 118 that is designed to capture the rain water that would otherwise drain over the outer edge 118 of the glare shroud 114. In one embodiment, rain water is collected atop the glare shroud 114 and directed toward drain holes 120A-120B on the left and right sides of the glare shroud 114, thereby eliminating glare from front or rear facing water droplets so as to allow for better human eye interaction in a nighttime setting.

In one embodiment, the glare shroud 114 desirably includes heat fins 122 that are provided over the top side of the glare shroud 114. The heat fins 122 desirable dissipate heat generated by light emitting diodes secured to an underside 124 of the glare shroud 114. In one embodiment, the heat fins 122 extend along the length of the glare shroud 114 and are aligned with the drain holes 120A, 120B so that the depressions between the heat fins direct the collected rain water toward the drain holes.

Referring to FIG. 7C, in one embodiment, the glare shroud 114 preferably includes a centrally located opening 126 provided at an underside of the glare shroud for mounting the glare shroud to an upper end of the upper pipe section 112 (FIG. 6). The glare shroud 114 includes a tubular shaped mounting ring 128 that surrounds the central opening 126, which is adapted to fit over the upper end of the upper pipe section 112 (FIG. 6). The tubular shaped element 128 includes a radially extending opening 130 for enabling a fastener (e.g., a thumb screw) to be passed therethrough for securing the glare shroud 114 to the upper end of the upper pipe section 112.

Figure 8:
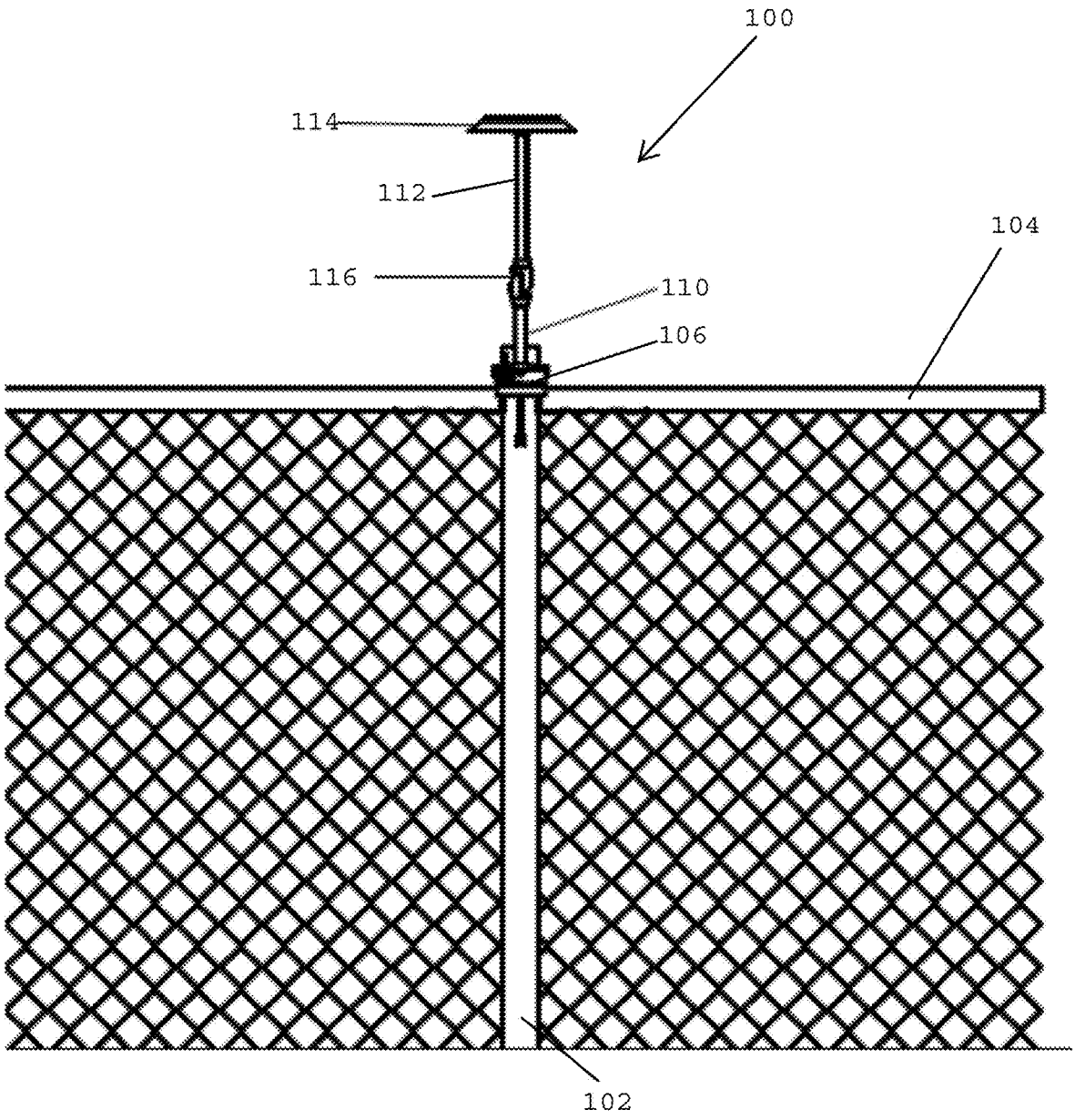
FIG. 8 shows a security lighting fixture mounted onto perimeter fence, in accordance with one embodiment of the present patent application.

Referring to FIG. 8, in one embodiment, the security lighting fixture 100 of FIG. 6 may be secured to a vertical post 102 of a perimeter fence 104. In one embodiment, the security lighting fixture 100 is secured to the upper end of the vertical post 102. In one embodiment, the junction box 106 is mounted to the vertical post 102 using a clamping element and the lower pipe section 110 and upper pipe section 112 project above the upper end of the vertical post 102. The glare shroud 114 is secured to the upper end of the upper pipe section 112. The articulating knuckle 116 is disposed between the upper end of the lower pipe section 110 and the lower end of the upper pipe section 112. As describes herein the articulating knuckle 116 desirably enables the upper pipe section 112 to be articulated and/or angulated relative to the lower pipe section 110 for controlling the orientation of the light beam emitted from the underside of the glare shroud 114.

Figure 9A:
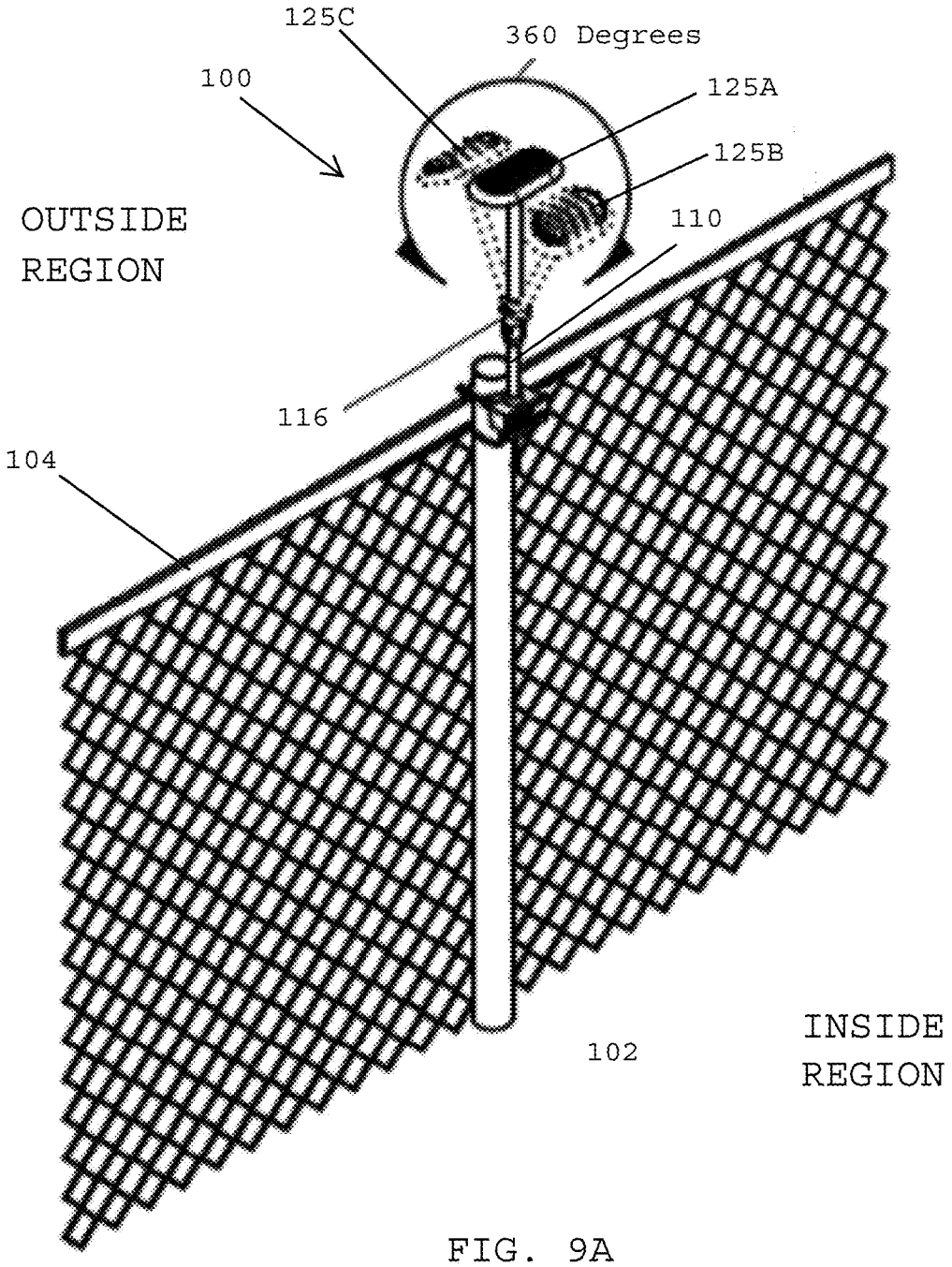
FIG. 9A shows a security lighting fixture mounted onto a perimeter fence, the security lighting fixture having an articulating knuckle, in accordance with one embodiment of the present patent application.

Referring to FIG. 9A, in one embodiment, a security lighting fixture 100 has a lower end mounted onto a vertical post 102 of a perimeter fence 104. The perimeter fence 104 surrounds an area that is being secured to define an inside region located inside the perimeter fence 104 and an outside region located outside the perimeter fence 104. In one embodiment, the articulating knuckle 116 enables the upper pipe section 112 to be rotated relative to the lower pipe section and articulated through an infinite range of different angles relative to the lower pipe section 110. In one embodiment, the range of rotation is 360 degrees and the range of articulation is 40 degrees off plumb. The articulating knuckle preferably includes a locking element for locking the upper pipe section at a selected rotation and/or angle relative to the lower pipe section. FIG. 9A shows the security lighting fixture 100 in a first position 125A in which the longitudinal axis of the upper pipe section 112 is vertically aligned (i.e., plumb) with the longitudinal axis of the lower pipe section 110. FIG. 9A shows the security lighting fixture 100 in a second position 125B in which the upper pipe section 112 is tilted inwardly (i.e., articulated) toward the inside region so that the longitudinal axis of the upper pipe section 112 defines an angle relative to the longitudinal axis of the lower pipe section 110. In the second position 125B, the security lighting fixture 100 has been adjusted to provide more light outside the perimeter fence 104 and less light inside the perimeter fence. The second position 125B may be useful when the grade outside the fence slopes up and away from the fence. The security lighting fixture 100 has a third position 125C in which the upper pipe section 112 is tilted outwardly (i.e., articulated) toward the outside of the perimeter fence 104 so that the upper pipe section 112 defines an angle with the lower pipe section 110. The third position 125C may be useful when the grade outside the fence slopes down and away from the fence. Although FIG. 9A shows only three positions for the upper pipe section 112 relative to the lower pipe section 110, the security lighting fixture may be articulated through an infinite range of angles between 90 degrees to the left and 90 degrees to the right (i.e., a 180 degree range of articulation). The upper pipe section may also be rotated 360 degrees relative to the lower pipe section.

In one embodiment, the glare shroud 114 secured to the upper end of the upper pipe section 112 and the upper pipe section may be rotated 360° about the longitudinal axis of the upper pipe section 112. The glare shroud 114 and the upper pipe section may be rotated to adjust the security lighting fixture 110 to the topography (e.g., grade slopes up, grade slopes down) surrounding the perimeter fence 104.

Figure 9B:
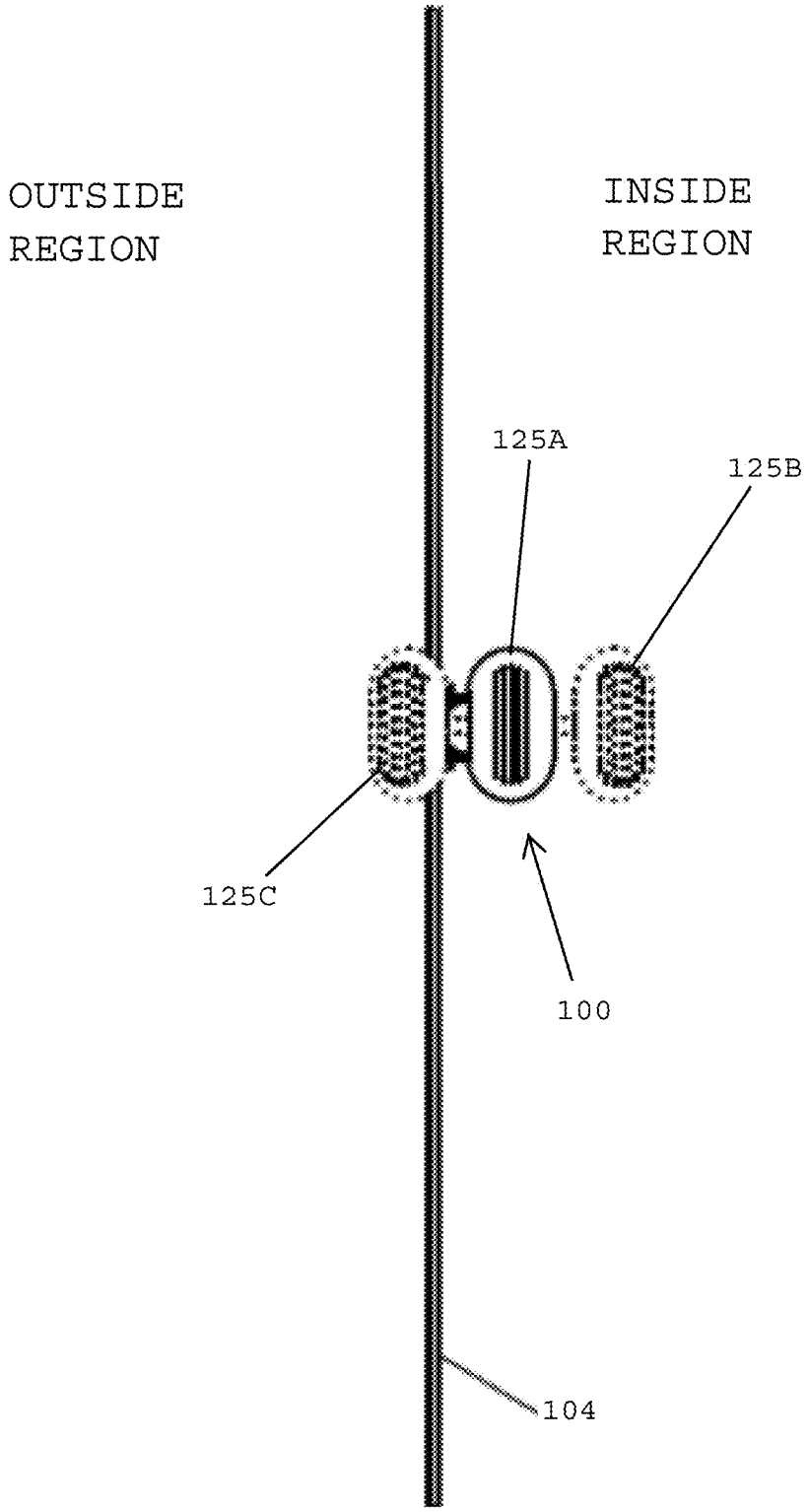
FIG. 9B shows a top view of the security lighting fixture and the perimeter fence shown in FIG. 9A.

FIG. 9B shows the security lighting fixture 100 adjusted into the three positions 125A, 125B, and 125C referenced herein. In the first position 125A, the upper pipe section is in vertical alignment (i.e., plumb) with the lower pipe section. In the second position 125B, the upper pipe section is tilted toward the inside region surrounded by the perimeter fence 104 so that the longitudinal axis of the upper pipe section defines an angle with the longitudinal axis of the lower pipe section. In the third position 125C, the upper pipe section is tilted outwardly into the outside region so that the longitudinal axis of the upper pipe section defines an angle relative to the longitudinal axis of the lower pipe section. Although only three positions are shown in FIG. 9B, in other embodiments, the upper pipe section may be rotated a full 180 degrees relative to the lower pipe section from a 90 degree angle extending toward the outside region to an opposite 90 degree angle extending toward the inside region.

In one embodiment, each of the upper pipe sections of the security lighting fixtures mounted on a perimeter fence may be rotated and/or angulated to a unique orientation relative to the lower pipe section associated therewith to reflect the topography that lies around that particular security lighting fixture. Thus, unique adjustments of rotation and angulation may be made from fixture to fixture as an installer moves along a fence line to customize each light fixture to match the topography that surrounds that particular light fixture.

Figure 9C:
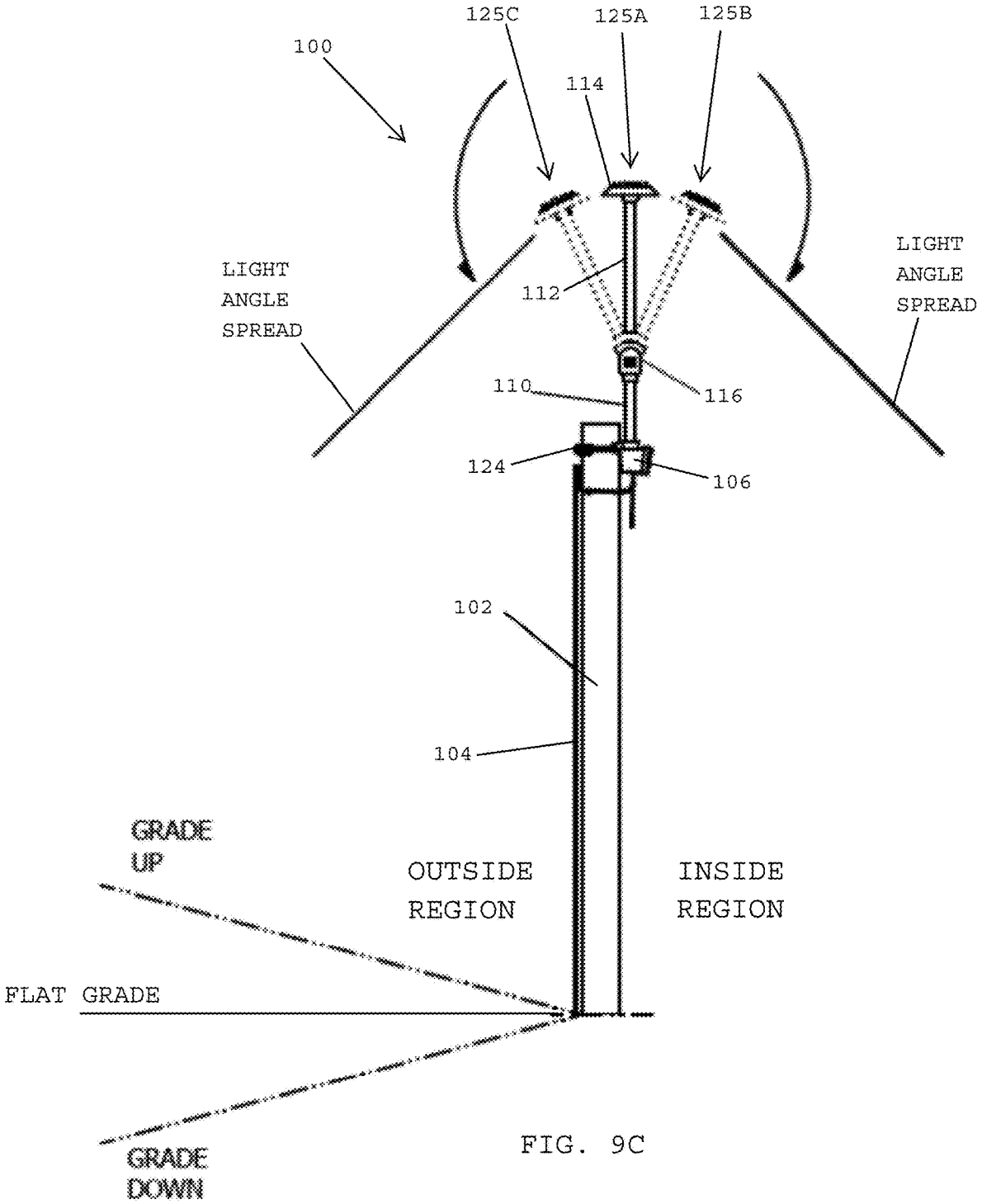
FIG. 9C shows a side view of the security lighting fixture and the perimeter fence shown in FIGS. 9A and 9B.

FIG. 9C shows how the upper pipe section 112 may be adjusted, rotated, angulated and/or articulated relative to the lower pipe section 110 based upon the topography or grade that surrounds the perimeter fence 104. In FIG. 9C, the security lighting fixture 100 is secured to the vertical post 102 of the perimeter fence 104. In one embodiment, the junction box 106 of the security lighting fixture 100 is secured to an upper end of the vertical post 102 using a clamping element 124. In one embodiment, when the grade is flat, the upper pipe section 112 is placed in vertical alignment with the lower pipe section 110 so that both the upper and lower pipe sections 112, 110 extend along a common longitudinal axis. In one embodiment, when the grade extends up and away from the perimeter fence, the upper pipe section 112 is tilted toward the inside region defined by the perimeter fence 104 so that the upper pipe section 112 defines an angle with the longitudinal axis of the lower pipe section 110. In one embodiment, when the grade extends down and away from the perimeter fence, the upper pipe section 112 is moved to the third position 125C whereby the upper pipe section 112 tilts outwardly into the outside region defined by the perimeter fence 104. In the third position 125C, the upper pipe section 112 has a longitudinal axis that defines an angle with the longitudinal axis of the lower pipe section 110. In one embodiment, the glare shroud 114 may be rotated 360° about the longitudinal axis of the upper pipe section 112 for making further optical adjustments to the security lighting fixture 100. In one embodiment, the glare shroud 114 and the upper pipe section 112 rotate together and may be rotated 360° about the longitudinal axis of the lower pipe section 110 for making further optical adjustments to the security lighting fixture 100.

Figure 10:
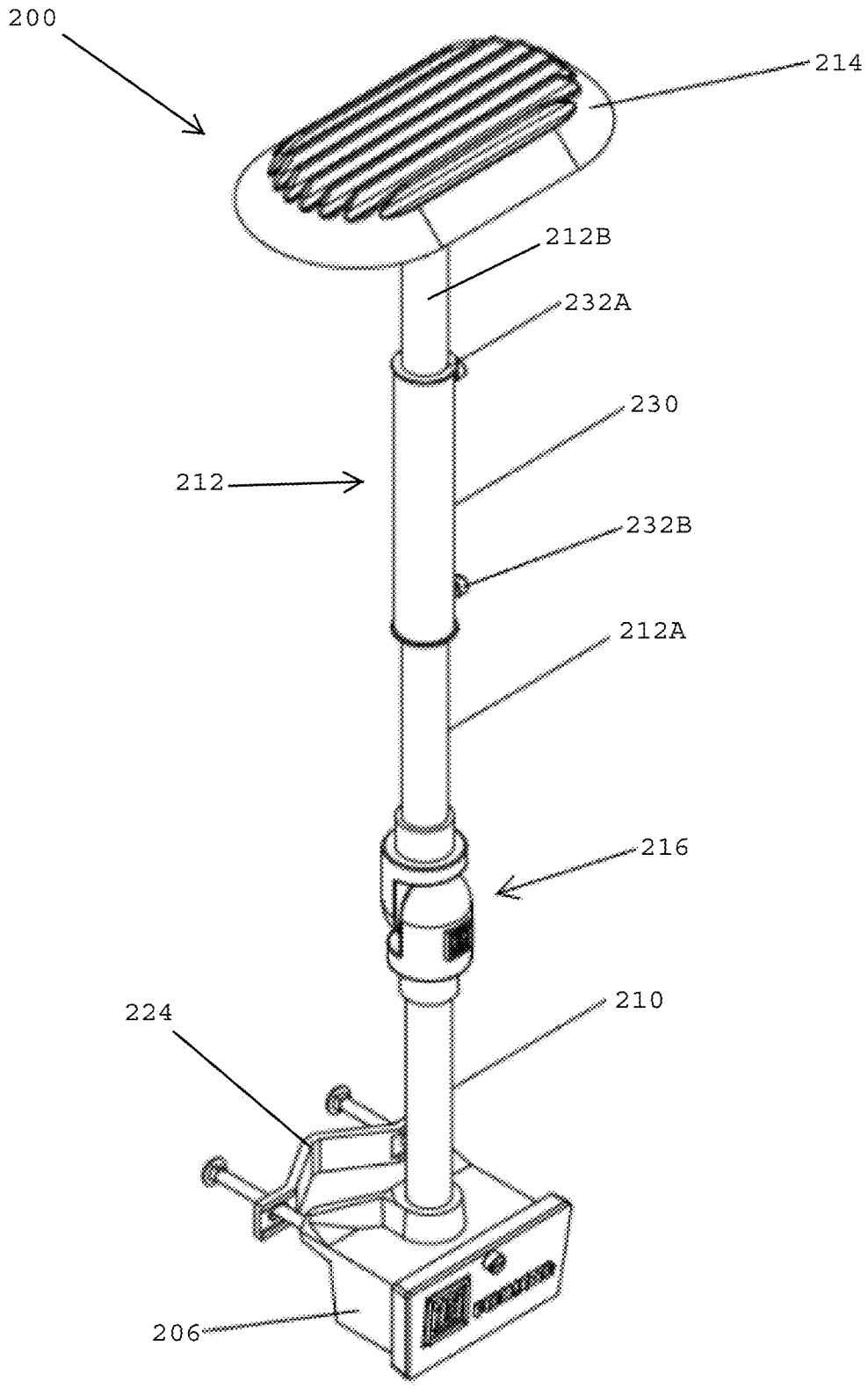
FIG. 10 shows a security lighting fixture for a perimeter fence, in accordance with one embodiment of the present patent application.

Referring to FIG. 10, in one embodiment, a contractor installing a perimeter security lighting system atop a perimeter fence may be required to retain the ability to fine tune a design by increasing the beam spread of the light or decreasing the beam spread of the light. The contractor may also need the ability to adjust for glare generated by the security lighting fixture. In order to accomplish the above-noted goals, the security lighting fixture shown in FIG. 10 includes a telescoping structure that enables a contractor to adjust the height of the light fixture above an upper end of a vertical post of a perimeter fence. In one embodiment, the security lighting fixture has a telescoping height adjustment element 230 so that the height of the glare shroud 214 relative to a junction box 206 may be adjusted.

In one embodiment, a security lighting fixture 200 includes a lower end having a junction box 206 that contains electrical components for providing power to and/or controlling the security lighting fixture. In one embodiment, the security lighting fixture 200 includes a clamping element 224 that is coupled with the junction box 206 for mounting the security lighting fixture onto a post (e.g., a vertical post) of a perimeter fence.

In one embodiment, the security lighting fixture 200 includes a lower pipe section 210 having a lower end secured to the junction box 206. The security lighting fixture 200 includes an upper pipe section 212 that is secured to an upper end of the lower pipe section 210 via an articulating knuckle 216. The articulating knuckle 216 desirably enables the upper pipe section 212 to be angulated relative to the longitudinal axis of the lower pipe section 210. In one embodiment, the upper pipe section 212 has a height adjustment feature including a telescoping adjustment tube 230 that enables first and second upper pipe sections 212A, 212B to slide and telescope relative to the telescoping adjustment tube 230. As a result, the length of the upper pipe section 212, comprising the first upper pip section 212A, the telescoping adjustment tube 230, and the second upper pipe section 212B may be adjusted so that the glare shroud 214 is at a preferred height above the junction box 206 of the security lighting fixture 200. The security lighting fixture 200 preferably includes fastening elements such as thumb screws 232A, 232B that enable an installer to fix the length of the upper pipe section 212 after a desired length adjustment has been made. In one embodiment, the light beam generated by the light fixture increase as the light fixture is positioned closer to the ground and decreases as the light fixture is positioned further away from the ground.

Figure 11:
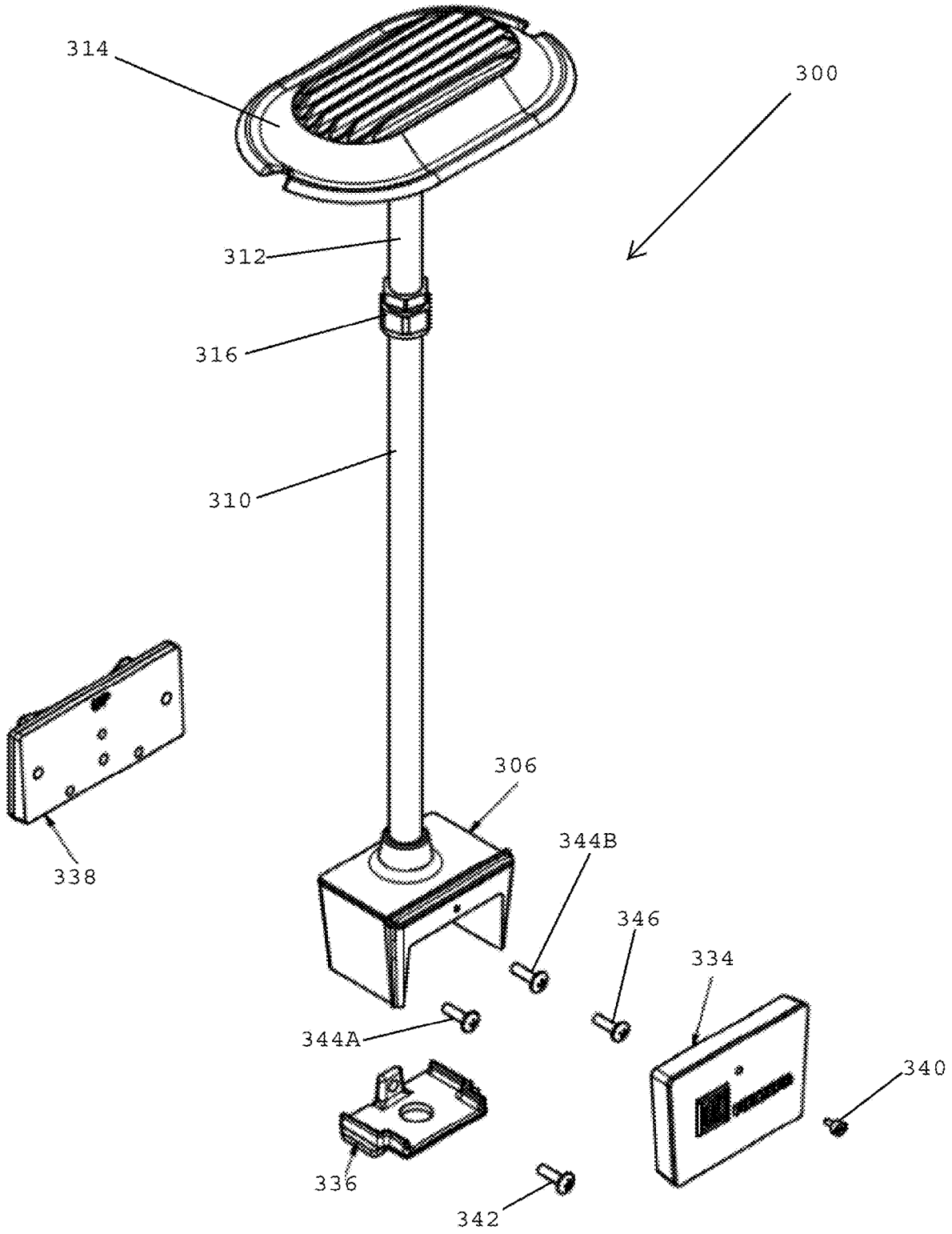
FIG. 11 shows a partially exploded view of a security lighting fixture for a perimeter fence, in accordance with another embodiment of the present patent application.

Referring to FIG. 11, in one embodiment, a security lighting fixture 300 preferably includes a junction box 306 adapted to receive electronic components (e.g., a circuit board, a microprocessor, conductive wiring), a lower pipe section 310 that extends upwardly from the junction box 306, and an upper pipe section 312 having a lower end coupled with the lower pipe section 310 via a universal ball joint 316 that preferably enables the longitudinal axis of the upper pipe section 312 to be angulated in all directions relative to the longitudinal axis of the lower pipe section 310. In one embodiment, a glare shroud 314 is secured to an upper end of the upper pipe section 312.

In one embodiment, the security lighting fixture 300 desirably includes a front cover plate 334 that covers a front opening of the junction box 306 and a bottom cover plate 336 that covers a bottom opening of the junction box 306. The security lighting fixture 300 desirably includes a mounting bracket 338 that is utilized to secure the security lighting fixture 300 to a vertical post of a perimeter fence. In one embodiment, a security lighting system desirably includes a plurality of security lighting fixtures whereby during a first installation stage a plurality of mounting brackets of the respective security lighting fixtures are secured to the posts of a perimeter fence followed by a second installation stage during which the junction boxes of the respective security lighting fixtures are hung onto the previously mounted mounting brackets.

In one embodiment, the security lighting fixture 300 desirably includes a front cover plate thumb screw 340 for securing the front cover plate 334 over the front opening of the junction box 306. In one embodiment, the security lighting fixture 300 preferably includes a bottom cover plate screw 342 for securing the bottom cover plate 336 to a rear wall of the junction box 306 for covering an opening at the bottom of the junction box.

In one embodiment, the security lighting fixture 300 desirably includes mounting screws 344A, 344B, and 346 for mounting the junction box 306 to the mounting bracket 338. In one embodiment, between the first and second stages discussed above, the mounting screws 344A, 344B are attached to the front face of the mounting bracket 338 so that the junction box 306 may be hung onto the mounting bracket.

FIGS. 12A-12D show the security lighting fixture 300 of FIG. 11 after it has been fully assembled, in accordance with one embodiment of the present patent application. The security lighting fixture 300 preferably includes the junction box 306 having the front cover plate 334 secured over the front opening of the junction box. The front cover plate thumb screw 340 is utilized to secure the front cover plate 334 to the front of the junction box 306. The security lighting fixture 300 desirably includes the mounting bracket 338 that is secured to a rear wall of the junction box 306. A U-shaped clamping element 350 is coupled with the mounting bracket 338 for preferably securing the security lighting fixture 300 to a vertical post of a perimeter fence.

In one embodiment, the security lighting fixture 300 preferably includes the lower pipe section 310 that is coupled to the upper pipe section 312 via a universal ball joint 316 that enables the longitudinal axis of the upper pipe section 312 to be angulated through an infinite range of angles relative to the longitudinal axis of the lower pipe section 310. The light fixture 300 includes the glare shroud 314 that is secured to the upper end of the upper pipe section 312. The glare shroud 314 preferably includes heat fins 322 that project from a top side of the glare shroud and drainage slots 320A, 320B provide at the ends of the outer perimeter 318 of the glare shroud 314. As will be described in more detail herein, an underside of the glare shroud 314 desirably contains a plurality of light emitting diodes having optics that generate light that extends outwardly from the glare shroud 314 at predetermined beam spread angles for providing light on both sides of a perimeter fence.

The universal ball joint 316 allows for both front to back, and left to right adjustment of the fixture head at any angulation from 0 degrees to 50 degrees off 90 degrees. The articulating feature enables an on-site installer to adjust and modify for grade changes in the landscape topography in order to align the beam spread angle of the security lighting fixture to better match the existing grade conditions and correct glare to better suit the end users requirement for where they want the blinding glare zone to commence. In many instances, perimeter fences are installed on hillsides with the fence posts installed perfectly level and true at a 90 degree angle when the grade is running up or down hill. In some installations, the fence will reside on a flat grade with the grade on the outside of the fence going uphill or downhill. By allowing the installer to adjust the 90 degree plane of the lighting fixture's mounting pipe this allows the optics to align with the existing on site grade condition or as required by the customer. In one embodiment, the articulation is accomplished by way of the ball and socket adjustment knuckle capable of three hundred sixty degree rotation of the fixture head and angulation adjustment left to right from true 0° to 50° both inside and outside the perimeter fence. The articulating structure enables the installer to fine tune the light pattern on site so the light pattern is aligned with the existing grade fully illuminating the land surface with the beam angle the fixture was designed for, otherwise light would be too hot in some areas and too low in other areas and also cause glare to those on site security personnel. Moreover, the universal ball joint preferably allows for very slight, even miniscule angular lighting adjustments to a full 50 degree adjustment range. This feature allows the security lighting fixture to be attached to a fence post that is not at true and 90 degree plumb to grade, and allows the installer the ability to make slight adjustments so the light fixture head is mounted 90 degree grade to accommodate poorly or improperly installed fence posts.

Figure 12A:
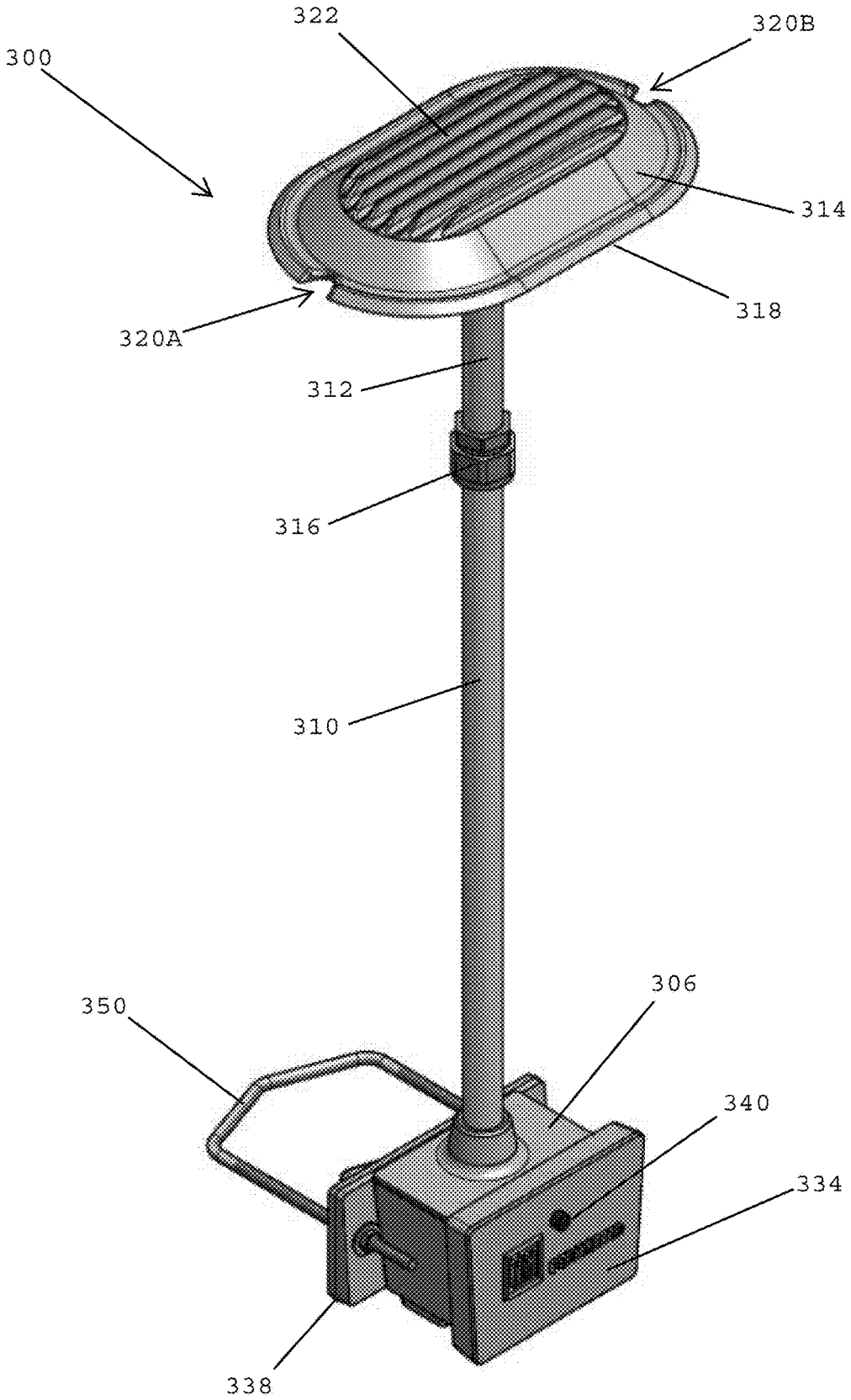
FIG. 12A shows a perspective view of the security lighting fixture shown in FIG. 11.
Figure 12B:
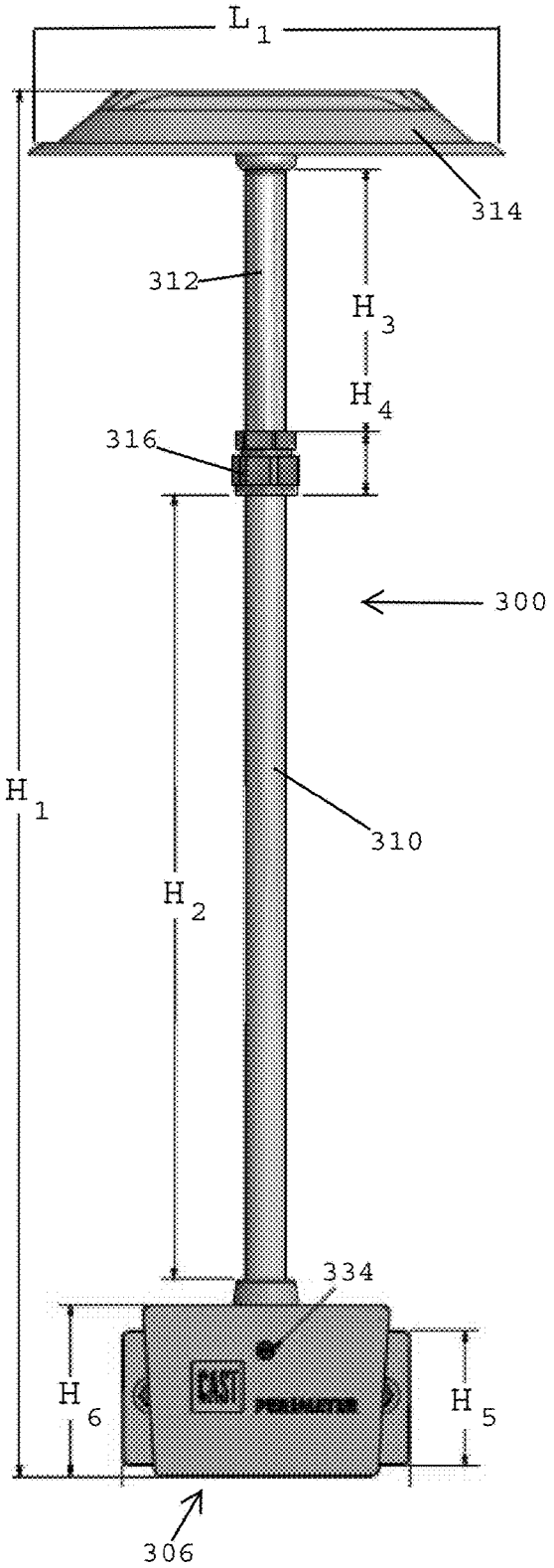
FIG. 12B shows a front elevation view of the security lighting fixture shown in FIG. 12A.

Referring to FIG. 12B, in one embodiment, the security lighting fixture 300 has a height $H_1$ of about 25-30 inches and more preferably about 28.33 inches. In one embodiment, the lower pipe section 310 has a height $H_2$ of about 15-20 inches and more preferably about 16.07 inches. In one embodiment, the upper pipe section 312 has a height $H_3$ of about 4-7 inches and more preferably about 5.39 inches. In one embodiment, the universal ball joint 316 has a height $H_4$ of about 1-1.50 inches and more preferably about 1.26 inches. In one embodiment, the junction box 306 has a height $H_5$ of about 2.3 inches and more preferably about 2.75 inches. In one embodiment, the front cover plate 334 has a height $H_6$ of about 3.4 inches and more preferably about 3.48 inches. In one embodiment, the glare shroud 314 has a length $L_1$ of about 9-10 inches and more preferably about 9.48 inches.

Figure 12C:
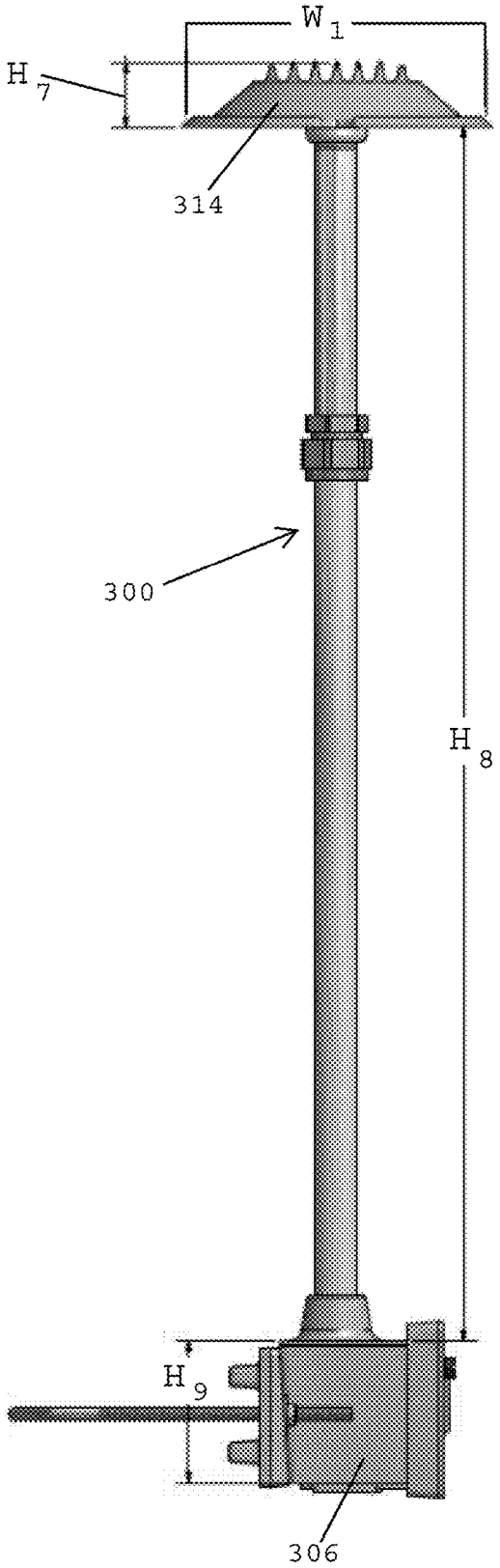
FIG. 12C shows a left side view of the security lighting fixture shown in FIGS. 12A and 12B.

Referring to FIG. 12C, in one embodiment, the glare shroud 314 has a width $W_1$ of about 5.5-6.5 inches and more preferably about 5.94 inches. In one embodiment, the glare shroud 314 has a height $H_7$ of about 1.0-1.5 inches and more preferably about 1.27 inches. In one embodiment, the distance between the top surface of the junction box 306 and the underside of the glare shroud 314 defines a height $H_8$ of about 20-25 inches and more preferably about 23.93 inches. In one embodiment, the rear end of the junction box 306 defines a height $H_9$ of about 2.5-3.0 inches and more preferably about 2.80 inches.

Figure 12D:
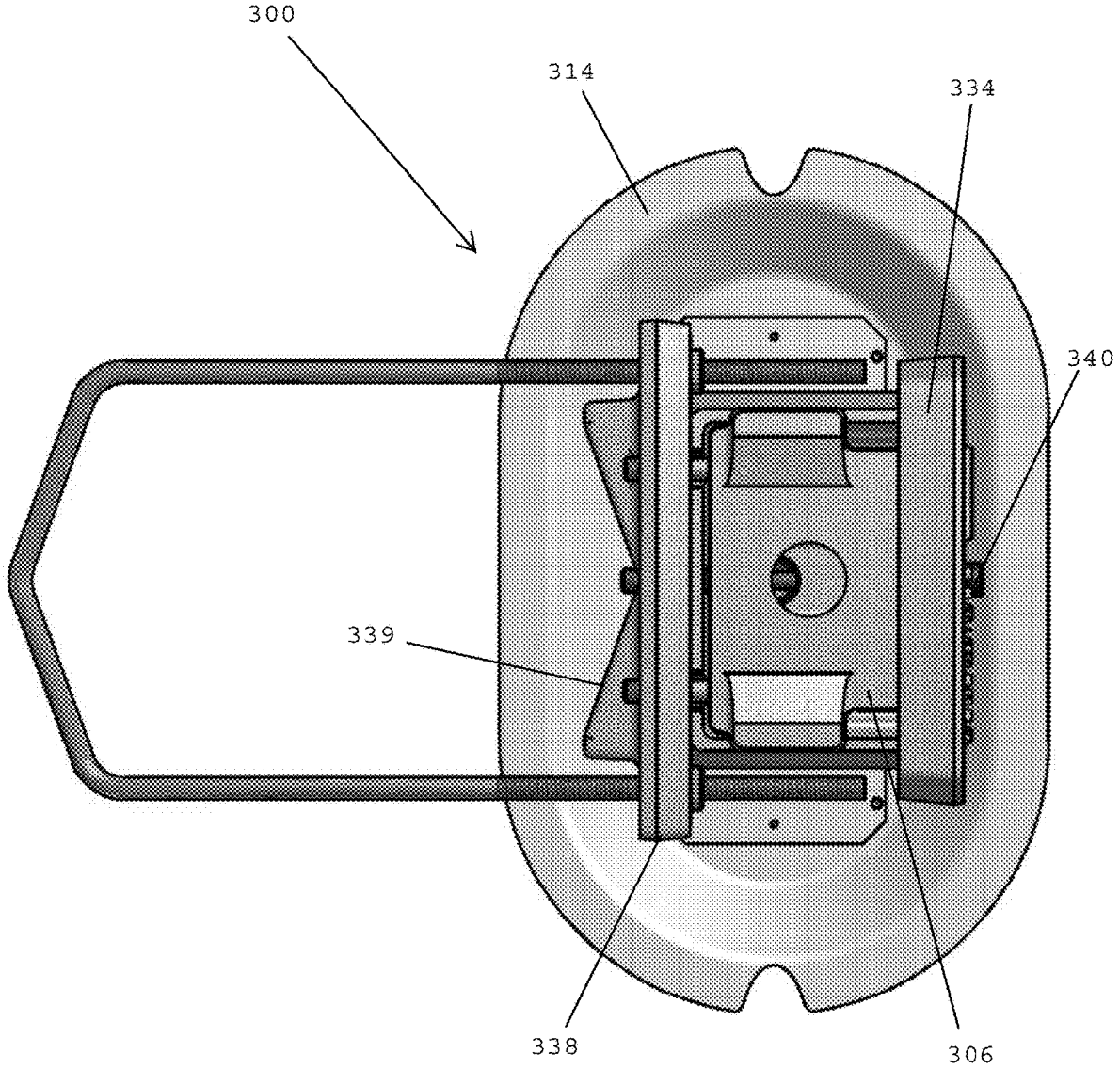
FIG. 12D shows a bottom view of the security lighting fixture shown in FIGS. 12A-12C

Referring to FIG. 12D, in one embodiment, the mounting bracket 338 has a rear face 339 having a V-shape for abutting against an outer surface of a round fence post. The free ends of the U-shaped clamping element pass through the mounting bracket 338 and are secured using nuts for securing the mounting bracket to the fence post. The mounting bracket may also be modified to fit square, I beam, and other fence post configurations.

Figure 13:
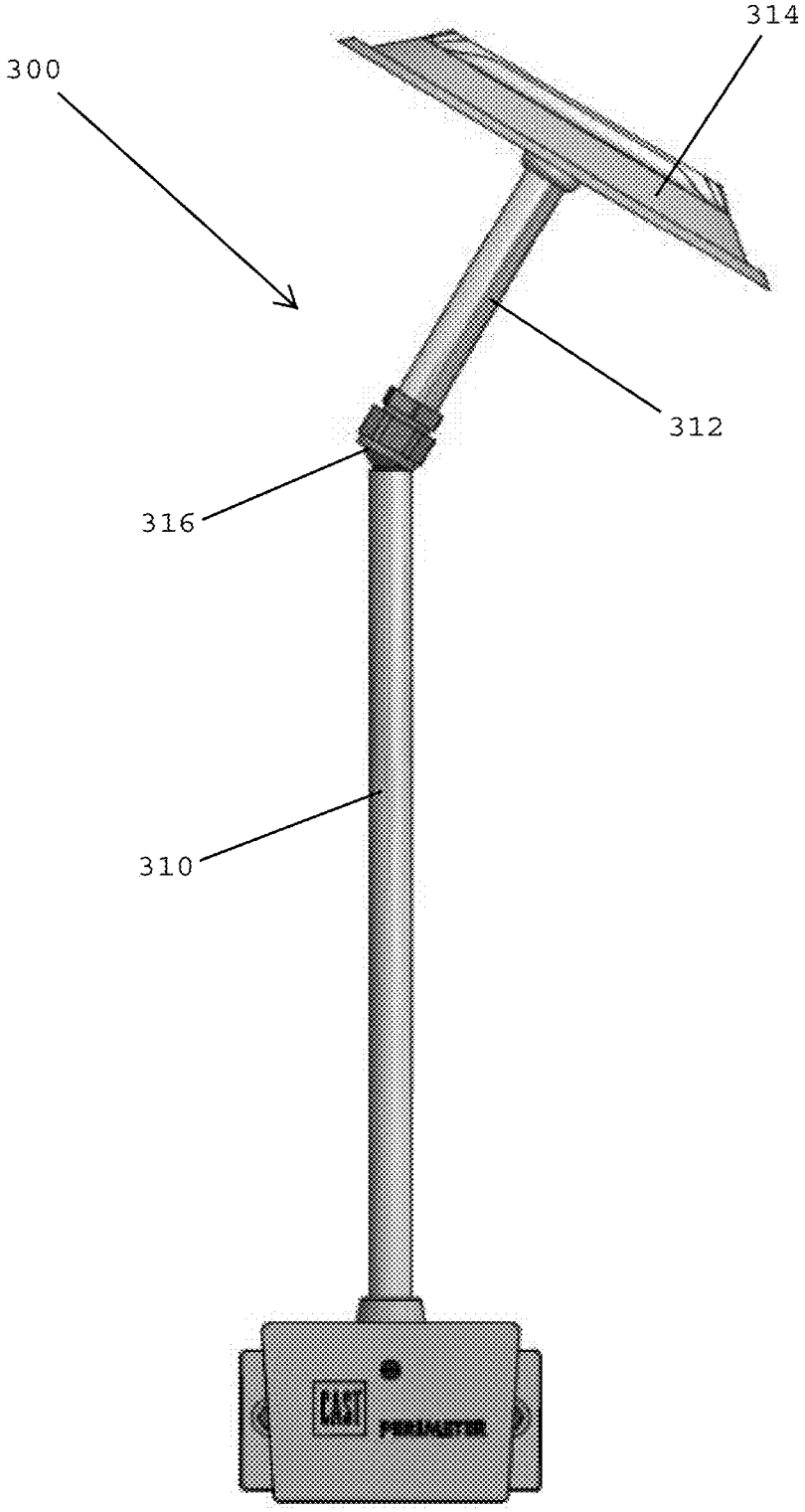
FIG. 13 shows a front elevation view of the security lighting fixture of FIGS. 12A-12D, with an upper end of the security lighting fixture articulated relative to a lower end of the security lighting fixture.

Referring to FIG. 13, in one embodiment, the universal ball joint 316 located between the lower pipe section 310 and the upper pipe section 312 enables the upper pipe section 312 to be angulated in all directions relative to the longitudinal axis of the lower pipe section 310. As a result, the upper pipe section 312 and the glare shroud 314 may be oriented at an infinite number of angles and positions relative to the lower pipe section 310. In one embodiment, the universal ball joint 316 also enables the upper pipe section 312 and the glare shroud 314 to be rotated 360 degrees about the longitudinal axis of the lower pipe section 310. Although the present application is not limited by any particular theory of operation, it is believed that the provision of the universal ball joint 316 enables the security lighting fixture 300 to be adjusted to an infinite number of topographies for customizing the light beam angle generated by the light fixture so that the light beam angle matches the area topography.

Figure 14A:
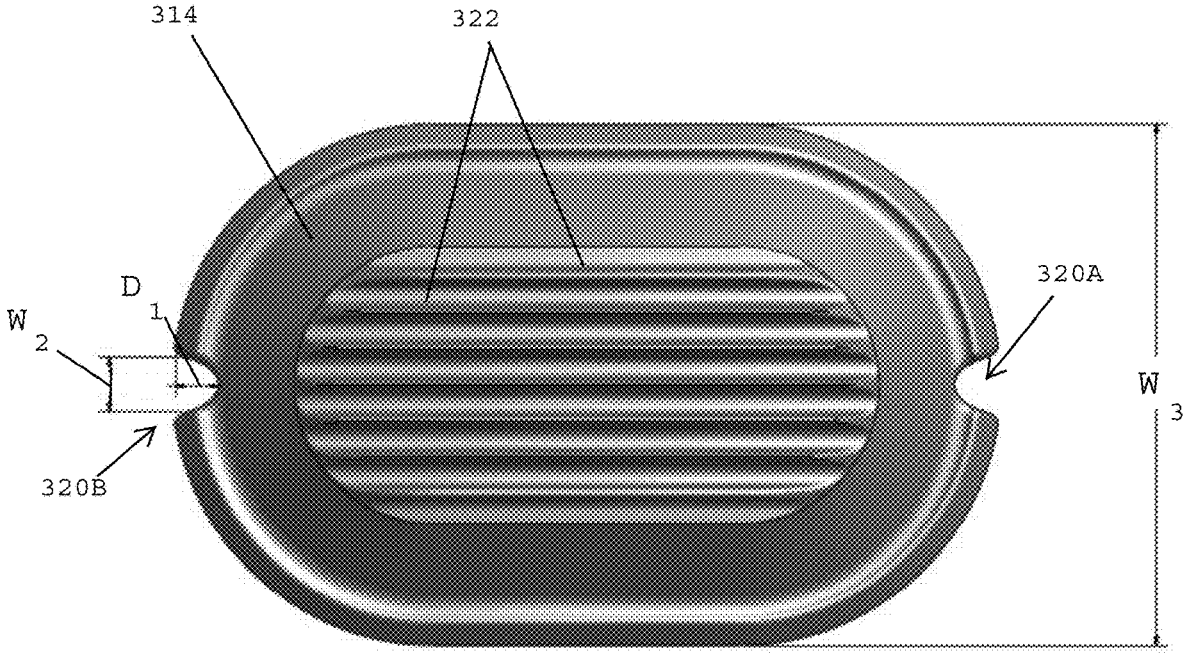
FIG. 14A shows a top plan view of a glare shroud for the security lighting fixture shown in FIGS. 12A-12D.

Referring to FIG. 14A, in one embodiment, the glare shroud 314 preferably includes an outer perimeter edge 318 that extends about the outer perimeter of the glare shroud. The outer perimeter 318 defines a gutter that desirably collects rain water and directs the rain water toward drainage slots 320A, 320B provided at the ends of the glare shroud 314. In one embodiment, the drainage slots 320A, 320B have a width $W_2$ of about 0.50-0.75 inches or more preferably about 0.65 inches, and a depth $D_1$ of about 0.40-0.60 inches and more preferably about 0.51 inches.

Figure 14B:
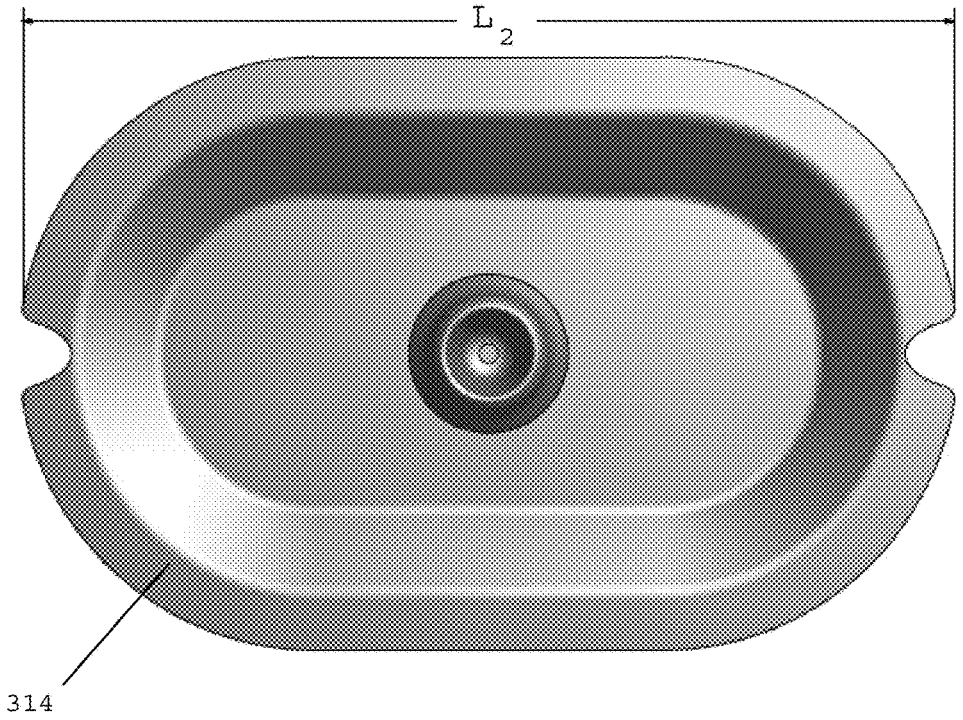
FIG. 14B shows a bottom view of the glare shroud of FIG. 14A.

Referring to FIGS. 14A and 14B, in one embodiment, the glare shroud 314 has a length $L_2$ of about 9-10 inches and more preferably about 9.70 inches, and a width $W_3$ of about 5-7 inches and more preferably about 6.17 inches.

Figure 14C:
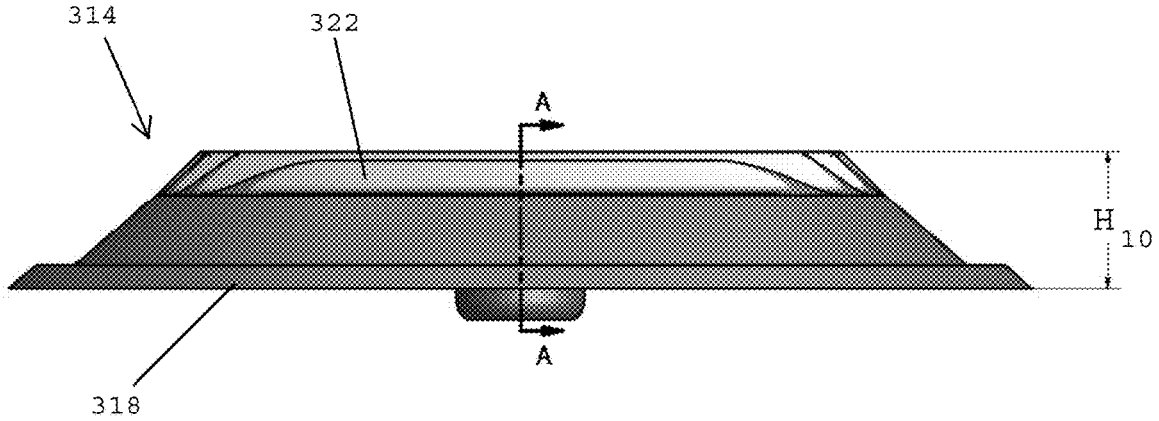
FIG. 14C shows a side elevation view of the glare shroud shown in FIGS. 14A and 14B.

Referring to FIG. 14C, in one embodiment, the glare shroud 314 has a height $H_{10}$ extending from the upper ends of the heat fins 322 to the lower end of the outer perimeter 318 of about 1.00-1.50 inches and more preferably about 1.29 inches.

Figure 14D:
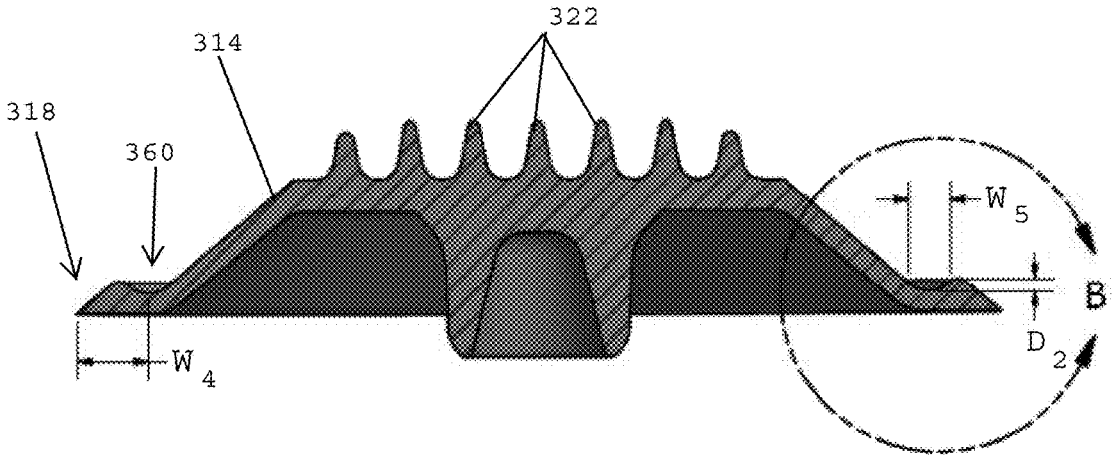
FIG. 14D shows a cross sectional view of the glare shroud shown in FIG. 14C.
Figure 14E:
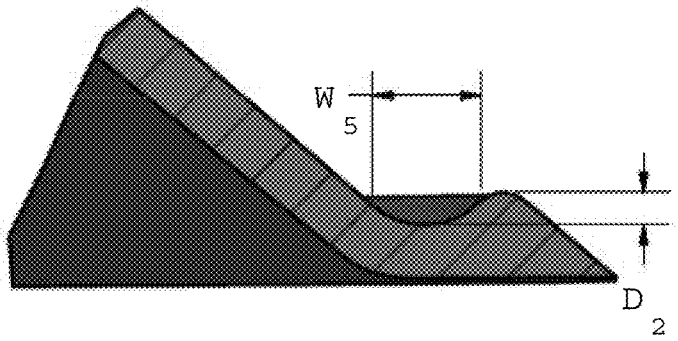
FIG. 14E shows a magnified view of a section of an outer perimeter of the glare shroud shown in FIG. 14D.

Referring to FIGS. 14D and 14E, in one embodiment, the outer perimeter 318 of the glare shroud 314 defines a gutter 360 having a width $W_4$ of about 0.4-0.5 inches and more preferably about 0.48 inches. In one embodiment, the gutter 360 has a width $W_5$ of about 0.25 inches and a depth $D_2$ of about 0.10 inches.

Figure 15:
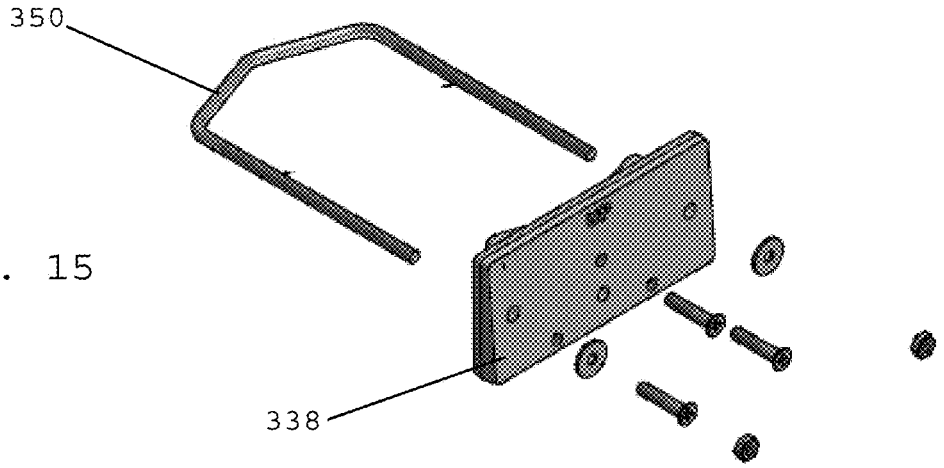
FIG. 15 shows a perspective view of a mounting bracket, a clamping element, and securing elements for a security lighting fixture, in accordance with one embodiment of the present patent application.

Referring to FIG. 15, in one embodiment, the mounting bracket 338 and the U-shaped clamping element 350 are utilized for securing the security lighting fixture 300 (FIGS. 12A-12D) to a vertical post of a perimeter fence.

Figure 16A:
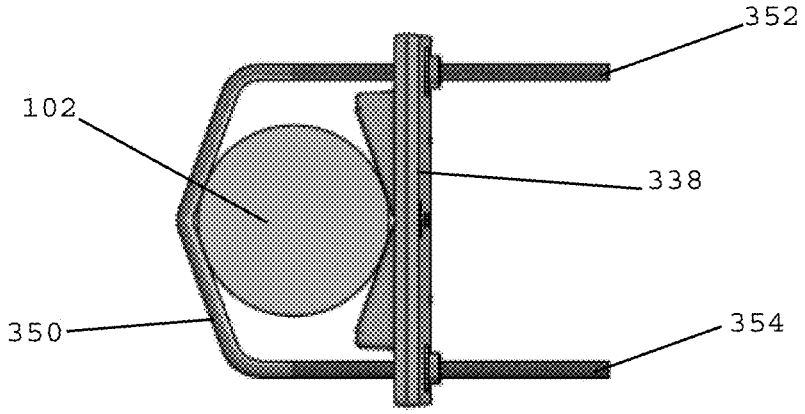
FIG. 16A shows a top plan view of the mounting bracket and clamping element of FIG. 15 secured to a vertical pole of a perimeter fence, in accordance with one embodiment of the present patent application.
Figure 16B:
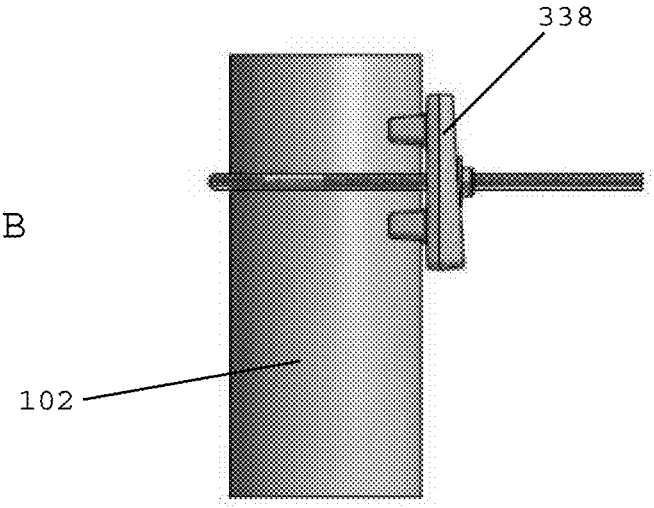
FIG. 16B shows a side view of the mounting bracket, the clamping element and the vertical pole of FIG. 16A.

Referring to FIGS. 15 and 16A-16B, in one embodiment, the V-shaped rear face of the mounting bracket 338 is abutted against a vertical post 102 and free ends 352, 354 of the U-shaped clamping element 350 are passed through openings in the mounting bracket 338. The free ends 352, 354 of the clamping element 350 are preferably threaded for receiving internally threaded nuts. In one embodiment, washers and internally threaded nuts are passed over the free ends 352, 354 of the coupling element 350 and the nuts are tightened for firmly securing the mounting bracket 338 to the vertical post 102, whereby the post is located between the rear face of the mounting bracket and the U-shaped clamping element.

Figure 17:
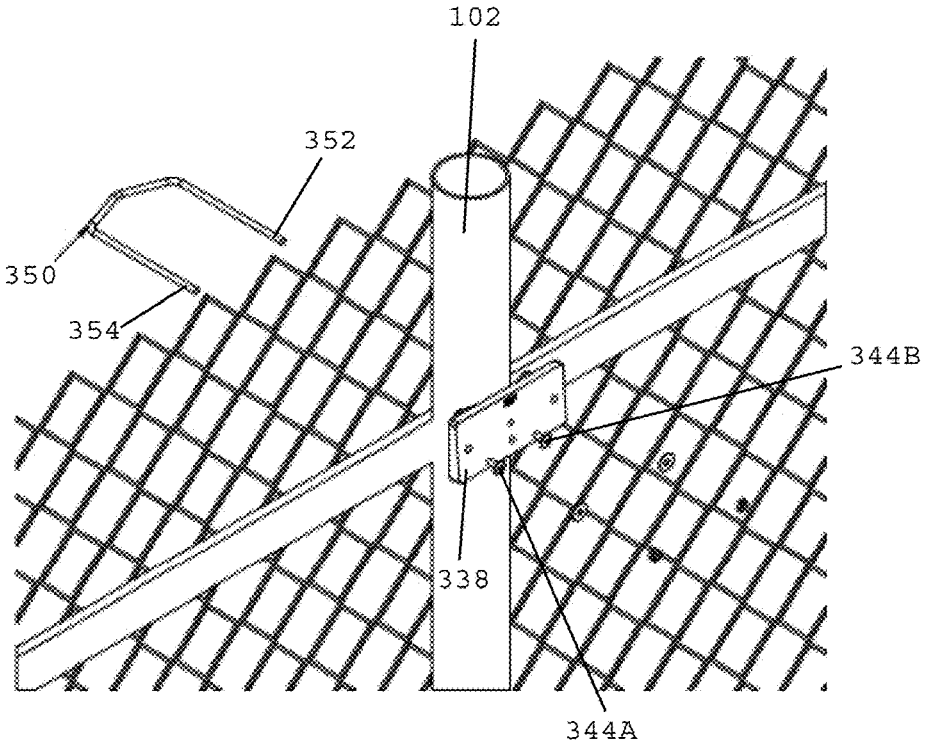
FIG. 17 shows a first step of a method of securing a security lighting fixture to a vertical pole of a perimeter fence, in accordance with one embodiment of the present patent application.
Figure 18:
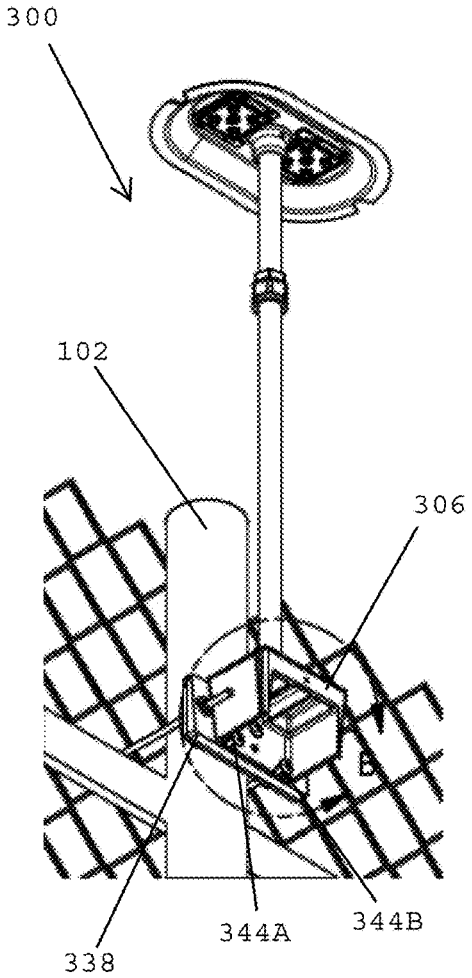
FIG. 18 shows a second step of a method of securing a security lighting fixture to a vertical pole of a perimeter fence, in accordance with one embodiment of the present patent application.
Figures 1, 18:
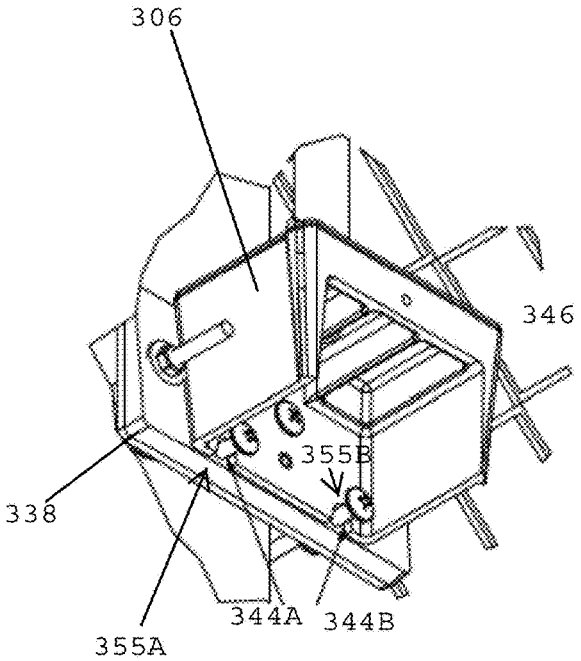

FIG. 17 shows the mounting bracket 338 being positioned adjacent the vertical post 102. Referring to FIGS. 17 and 18, the free ends 352, 354 of the clamping element 350 are passed through openings in the mounting bracket 338 and internally threaded nuts are passed over the free ends 352, 354 of the U-shaped clamping element for securing the mounting bracket 338 to the vertical post 102. In one embodiment, the junction box 306 at the lower end of the light fixture 300 may be hung onto the mounting bracket 338 for securing the security lighting fixture 300 to the vertical post 102.

Figure 1:
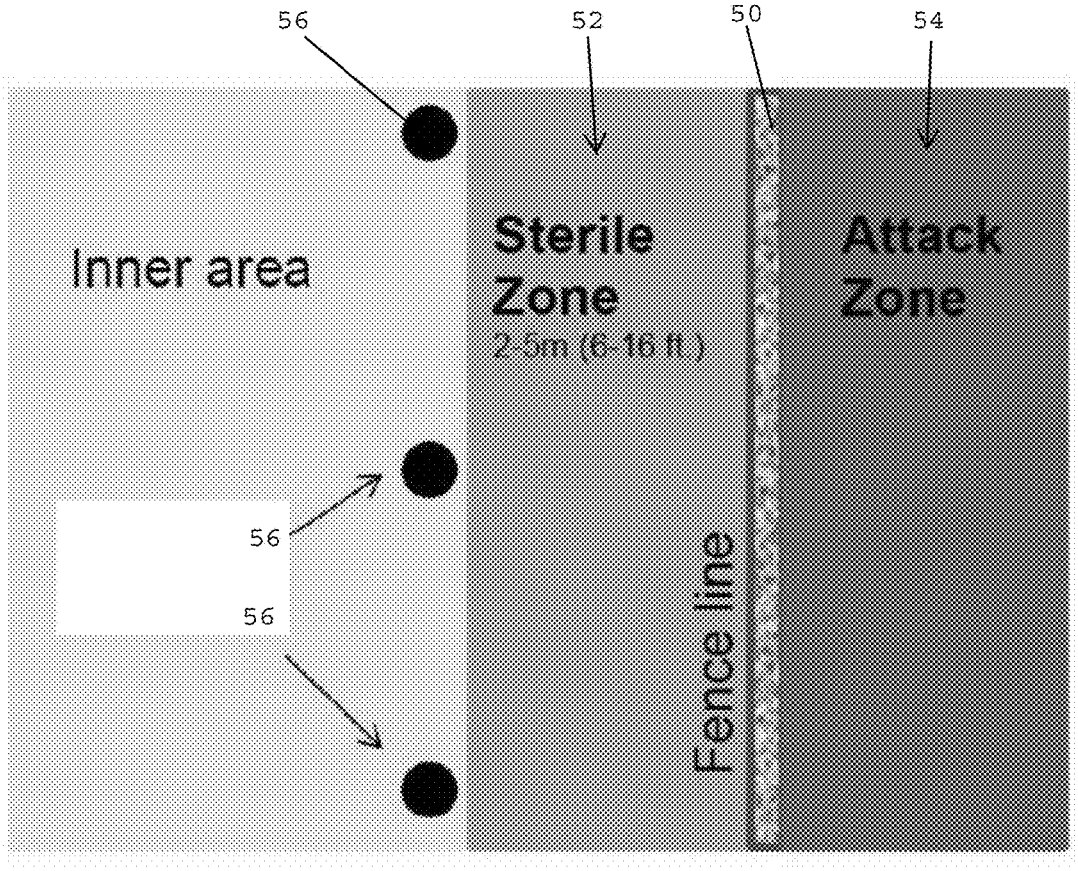
FIG. 1 PRIOR ART
FIG. 1 shows a schematic view of a prior art security lighting system for a perimeter fence.
Figure 2:
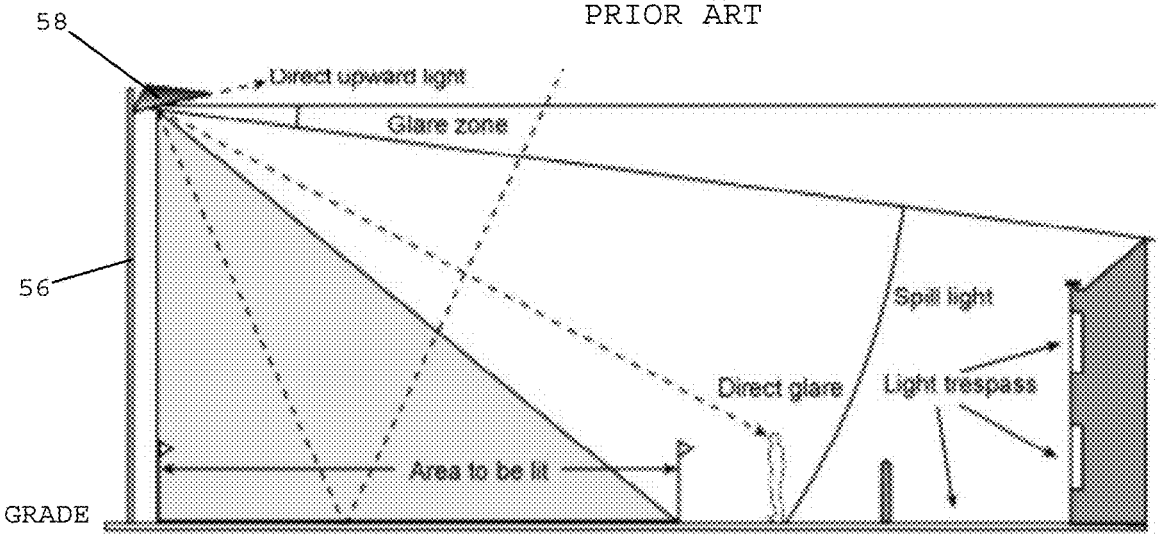
FIG. 2 PRIOR ART
FIG. 2 shows a side view of a prior art lighting system.
Figure 3:
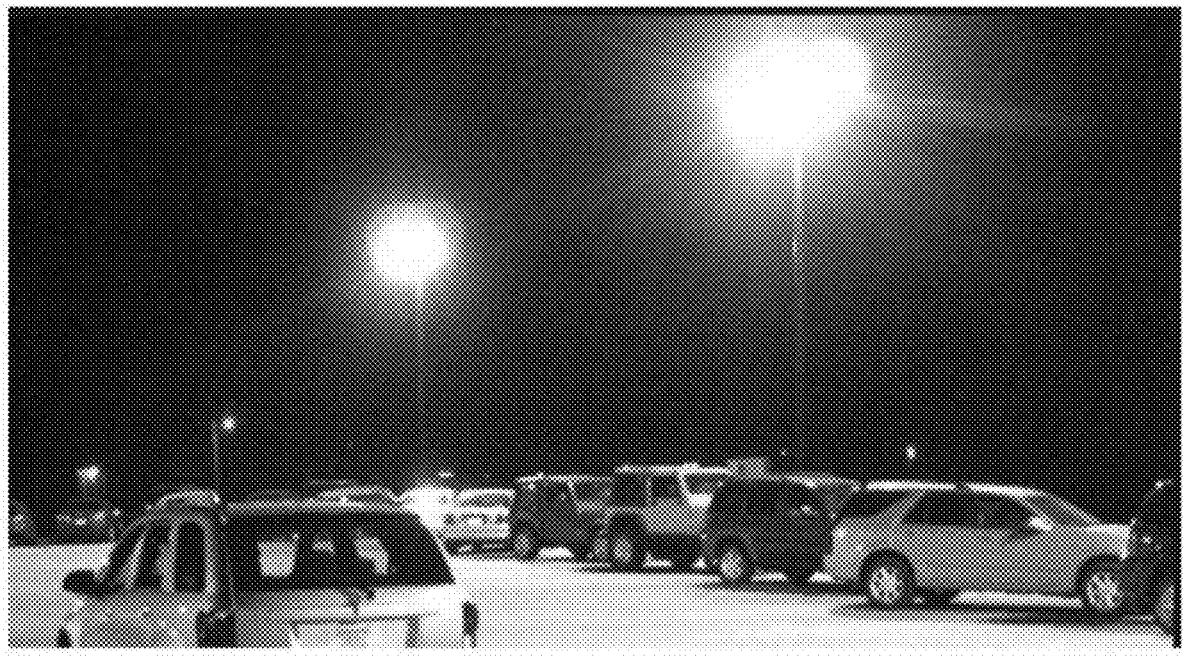
FIG. 3 PRIOR ART
FIG. 3 shows a prior art parking lot lighting system including lights mounted atop light poles.
Figure 4:
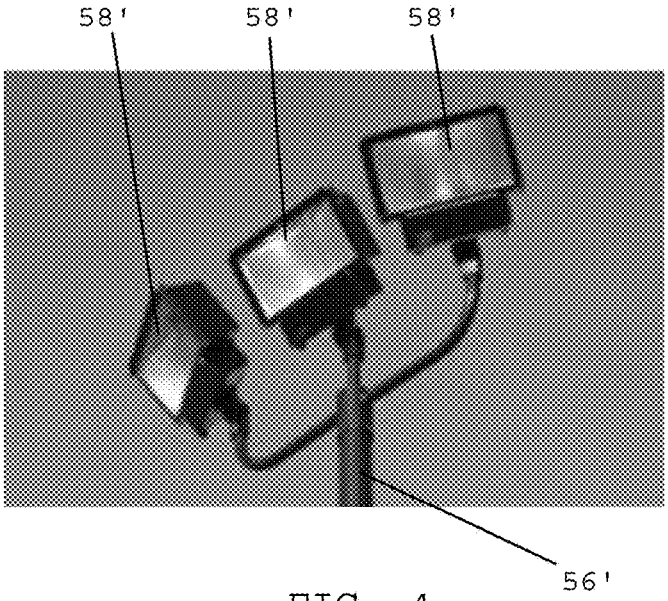
FIG. 4 PRIOR ART
FIG. 4 shows a prior art security lighting system including light fixtures mounted atop a light pole.
Figure 5:
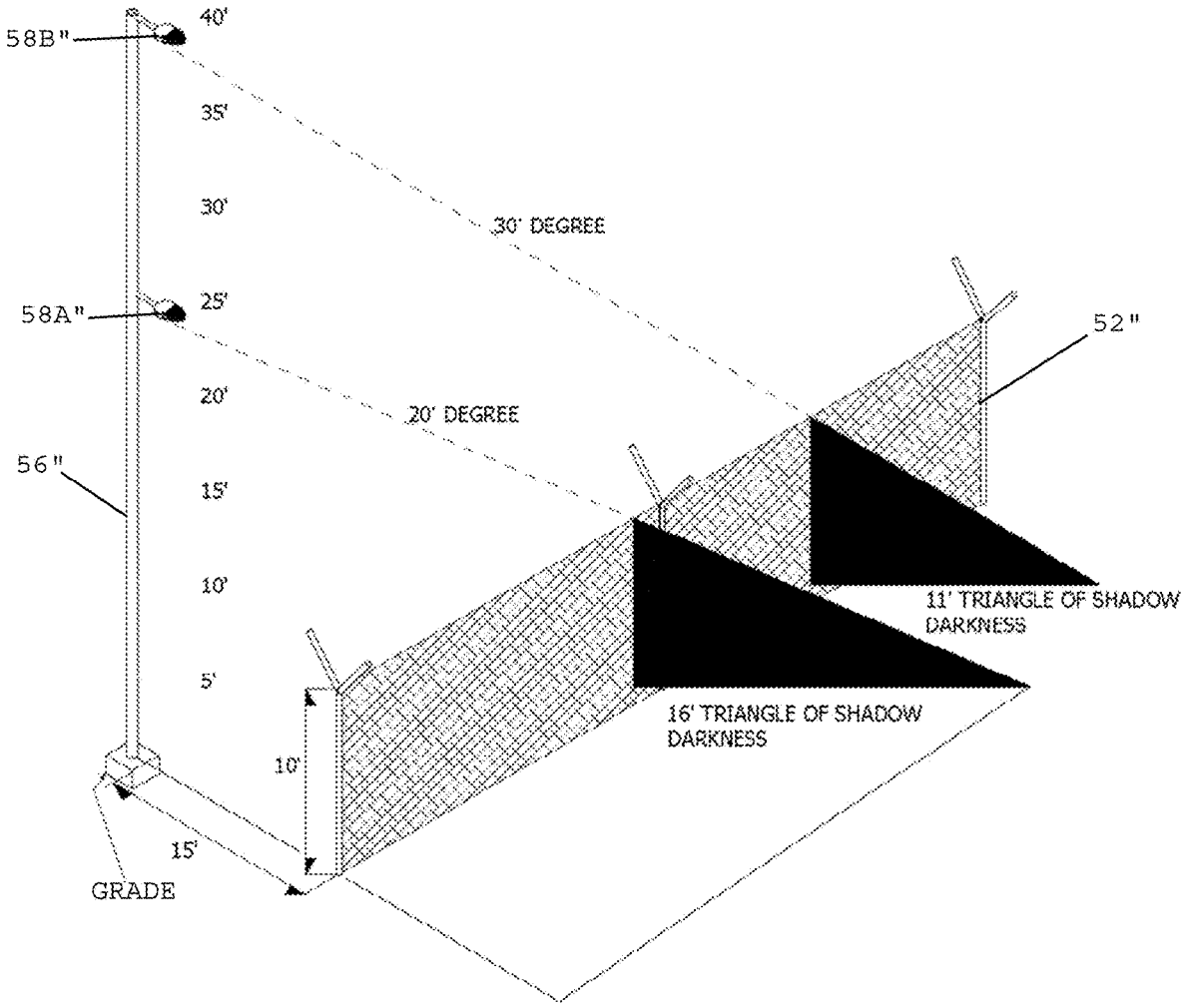
FIG. 5 PRIOR ART
FIG. 5 shows a prior art security lighting system for a perimeter fence.

Referring to FIGS. 17, 18 and 18-1, in one embodiment, threaded fasteners 344A, 344B are partially threaded into openings formed in the mounting bracket 338. The threaded fasteners 344A, 344B are desirably not fully tightened so that a portion of the threaded shaft of the threaded fasteners extends inwardly from the front face of the mounting bracket 338.

Referring to FIG. 18-1, in one embodiment, the rear wall of the junction box 306 has a lower edge with spaced slots 355A, 355B that are adapted to receive the portions of the threaded shafts of the threaded fasteners 344A, 344B that are exposed and extend inwardly from the front face of the mounting bracket 338. The spaced slots 355A, 355B may be referred to as "Mouse Holes" because they have an arcuate shape and the appearance of mouse holes formed in a wall adjacent a floor. The "Mouse Holes" allow the junction box to be hung onto the threaded fasteners 344A, 344B for initial assembly of the light fixture with the mounting bracket 338. As a result, the junction box 306 may be hung onto the partially tightened threaded fasteners 344A, 344B for initially coupling the junction box 306 with the mounting bracket 338. As a result, an initial moveable coupling is formed between the junction box 306 and the mounting bracket 338. If an installer is satisfied that the junction box 306 has been properly coupled and aligned with the mounting bracket 338, the installer may tighten the threaded fasteners 344A, 344B. A third threaded fastener 346 may also be passed through the rear wall of the junction box 306 and into an opening in the front face of the mounting bracket 338 for further securing the junction box 306 to the mounting bracket 338.

Figure 19:
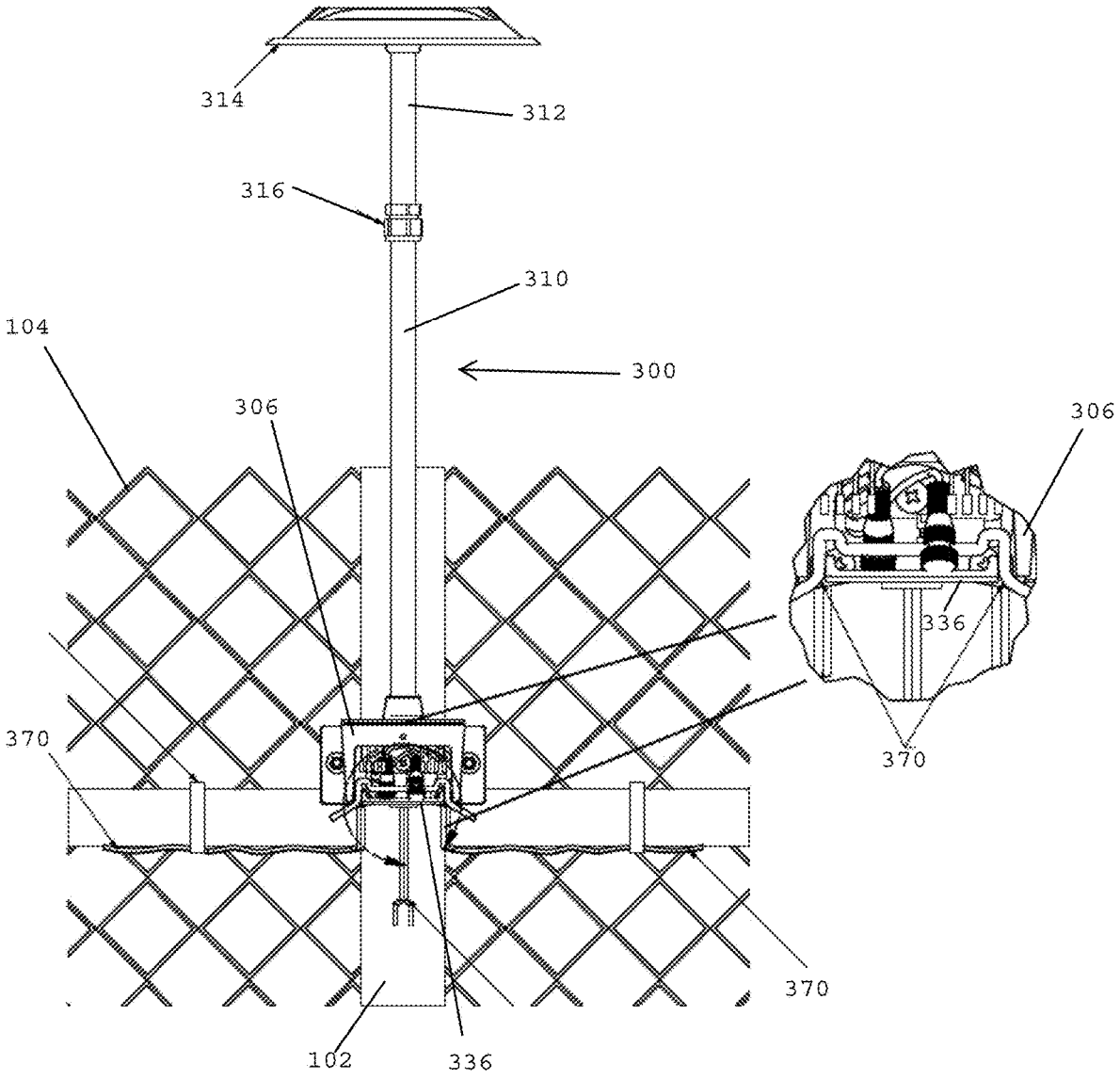
FIG. 19 shows a third step of a method of securing a security lighting fixture to a perimeter fence, in accordance with one embodiment of the present patent application.

Referring to FIG. 19, in one embodiment, after the junction box 306 has been secured to the mounting bracket 338, the lower pipe section 310 of the security lighting fixture 300 preferably extends upwardly from an upper end of the junction box 306. The upper pipe section 312 preferably extends above the lower pipe section 310 and is coupled with the lower pipe section 310 via the universal ball joint 316. The glare shroud 314 is secured to the upper end of the upper pipe section 312.

In one embodiment, electrical power is provided to the security lighting fixture 300 by stringing conductive wire 370 along the length of the perimeter fence 104. In one embodiment, the bottom cover plate 336 may be lowered for passing the conductive wires into the junction box 306. A magnified view of a portion of FIG. 19 shows the conductive wires 370 nested in slots located between the bottom plate 336 and the side walls of the junction box 306.

Figure 20:
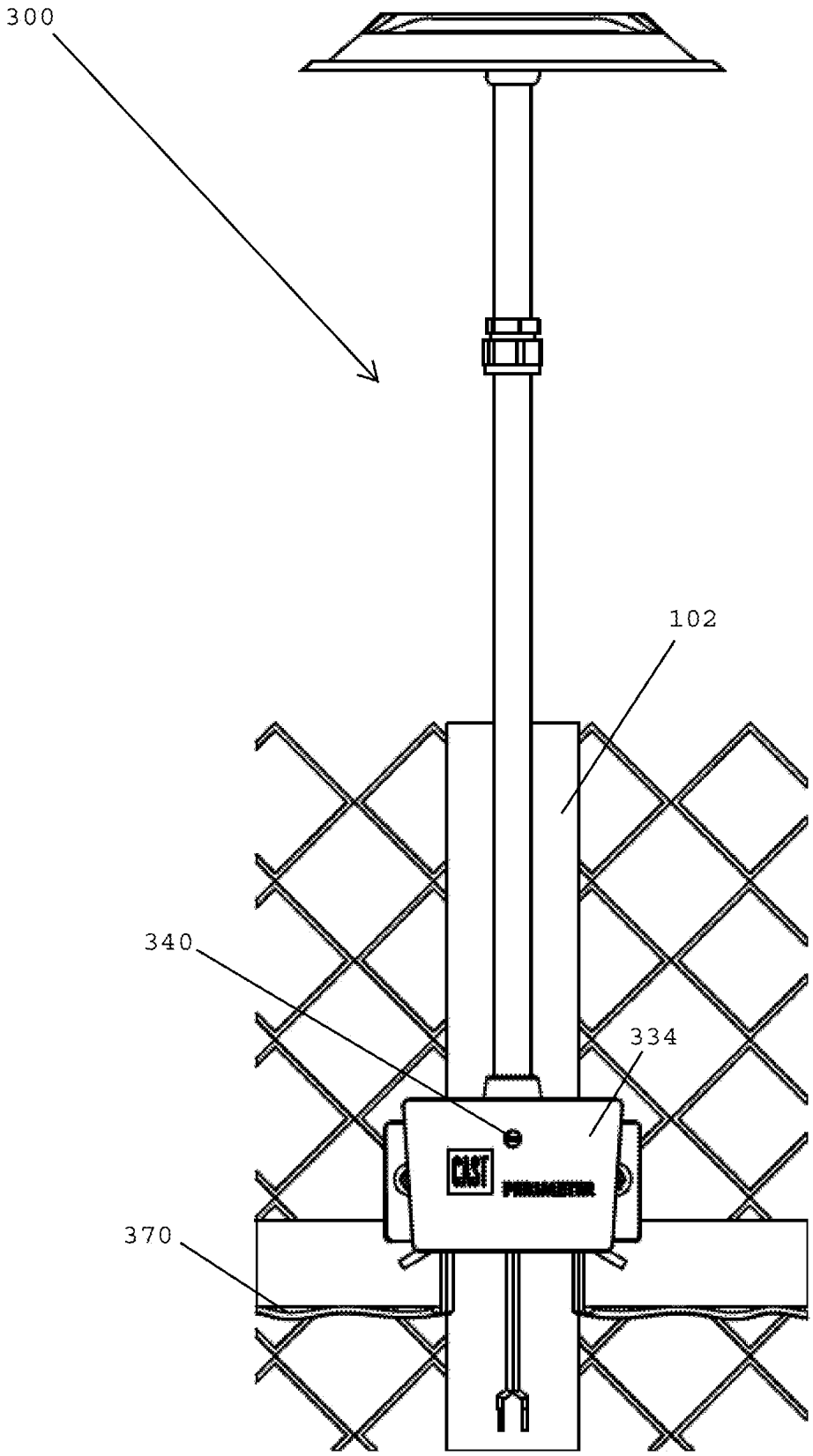
FIG. 20 shows a front view of a security lighting fixture mounted to a vertical pole of a perimeter fence, in accordance with one embodiment of the present patent application.

Referring to FIG. 20, after the security lighting fixture 300 has been mounted on the vertical post 102 and connected with the conductive wires 370 for providing power to the lighting fixture, the front cover plate 334 may be positioned over the front opening of the junction box and held in place using a fastening element 340 such as a thumb screw.

Figure 21:
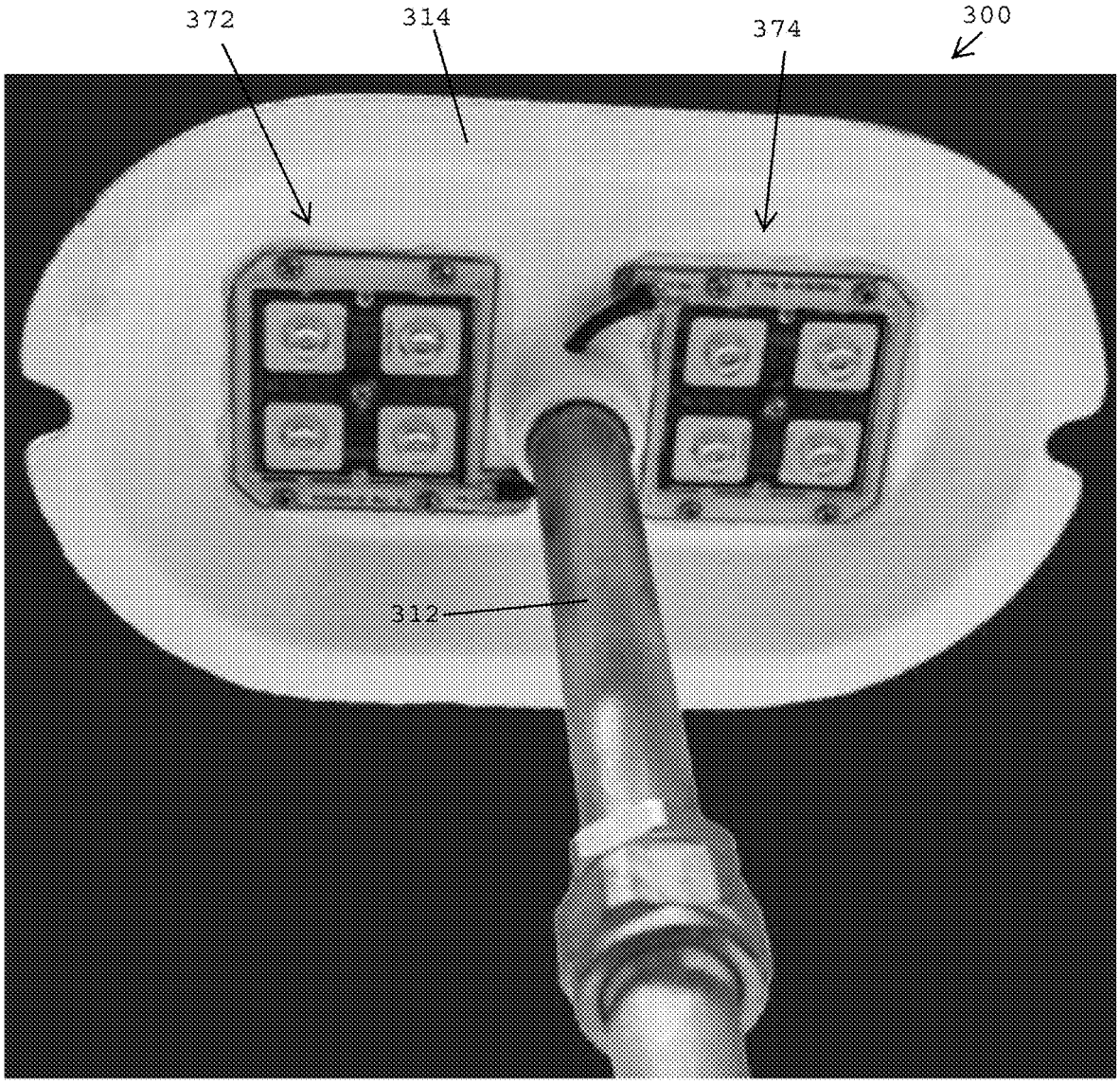
FIG. 21 shows an underside of a glare shroud of a security lighting fixture including a plurality of light emitting diodes mounted to the underside of the glare shroud, in accordance with one embodiment of the present patent application.

Referring to FIG. 21, in one embodiment, a security lighting fixture 300 desirably includes light emitting diodes (LEDs) secured to an underside of the glare shroud 314. The LEDs are controlled by the electronics provided in the junction box. In one embodiment, the light emitting diodes preferably include a first LED matrix 372 secured on one side of the upper pipe section 312 and a second LED matrix 374 secured on an opposite side of the upper pipe section 312. As will be described in more detail herein, the first and second matrices 372, 374 desirably includes optical lenses for propagating the light angle beams.

Figure 22A:
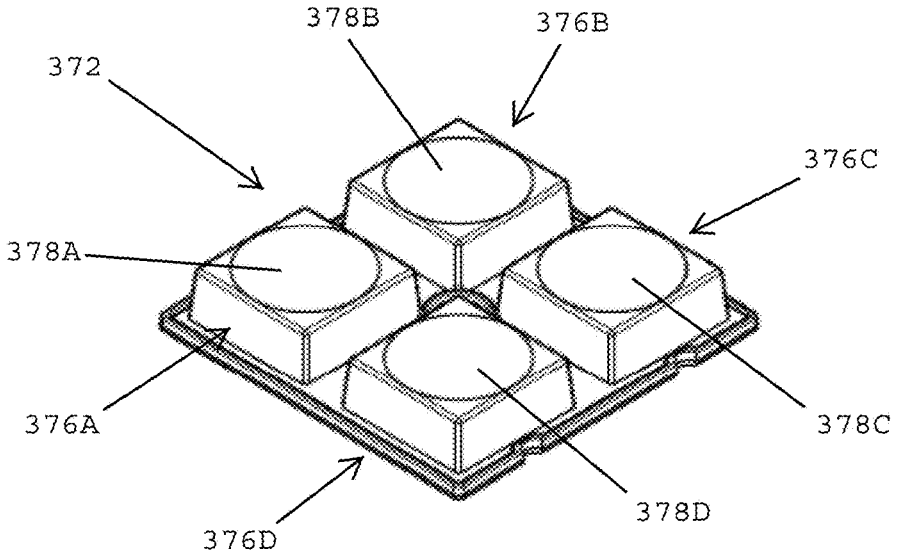
FIG. 22A shows a perspective view of light emitting diodes of a security lighting fixture, in accordance with one embodiment of the present patent application.
Figure 22B:
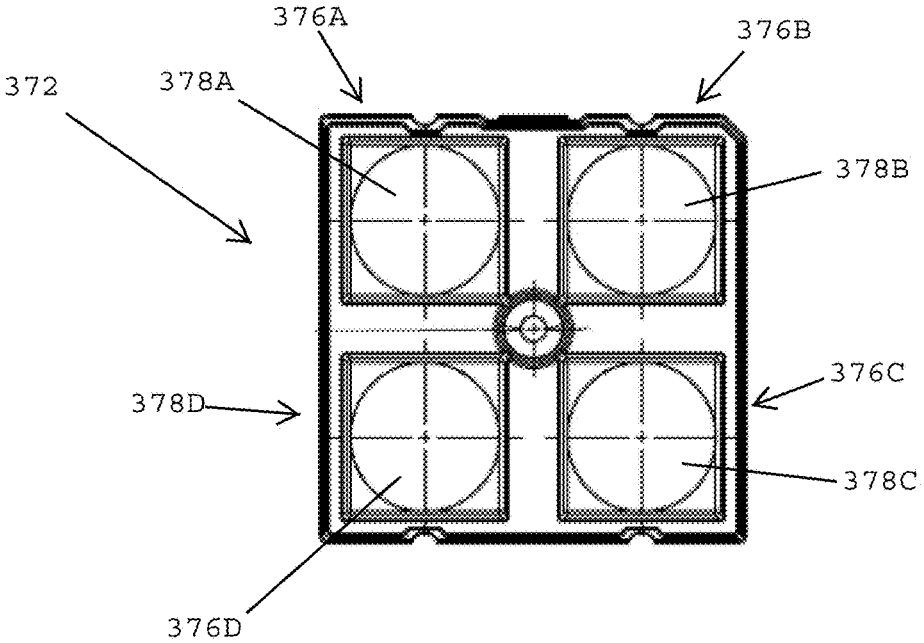
FIG. 22B shows a top plan view of the light emitting diodes of FIG. 22A.
Figure 22C:
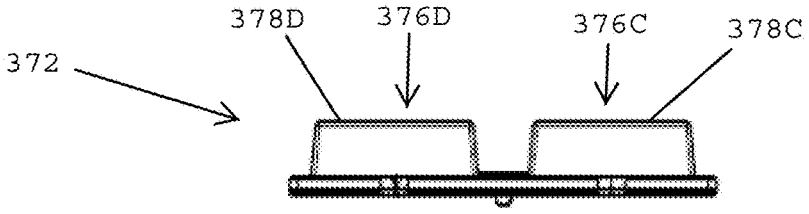
FIG. 22C shows a side elevation view of the light emitting diodes of FIGS. 22A and 22B.

Referring to FIGS. 22A-22C, in one embodiment, the first LED matrix 372 preferably includes a 2×2 matrix of LEDs 376A-376D, each covered by a respective optic or lens 378A-378D that projects light generated by the LEDs at a predetermined light beam angle of between about 137 degrees and 156 degrees. The optic lenses 378A-378D preferably control how the light escapes from the first LED matrix 372 for controlling the angle at which the light projects from the underside of the glare shroud 314 (FIG. 21).

Figure 24:
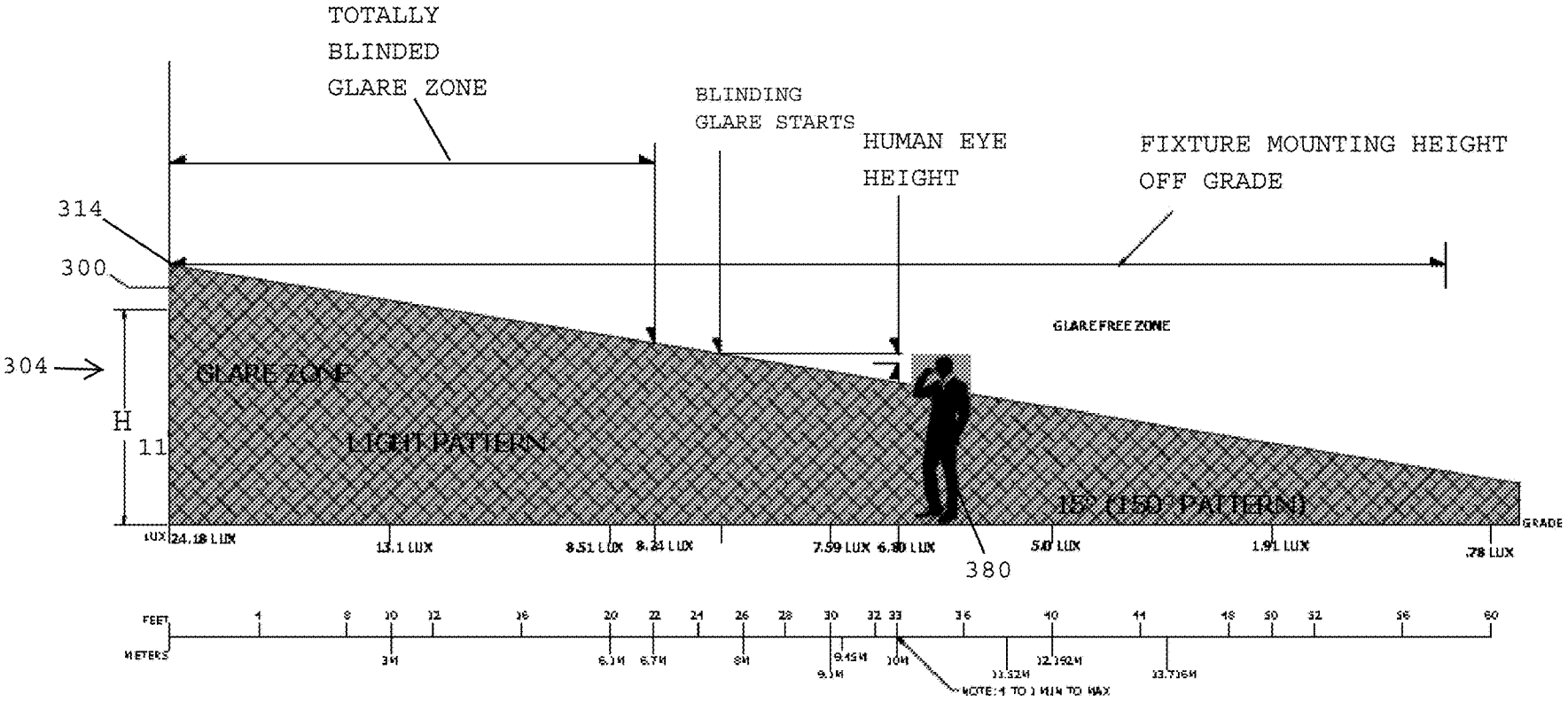
FIG. 24 shows a schematic view of a light pattern generated by a security lighting fixture mounted atop a perimeter fence, in accordance with one embodiment of the present patent application.
Figures 1, 24:
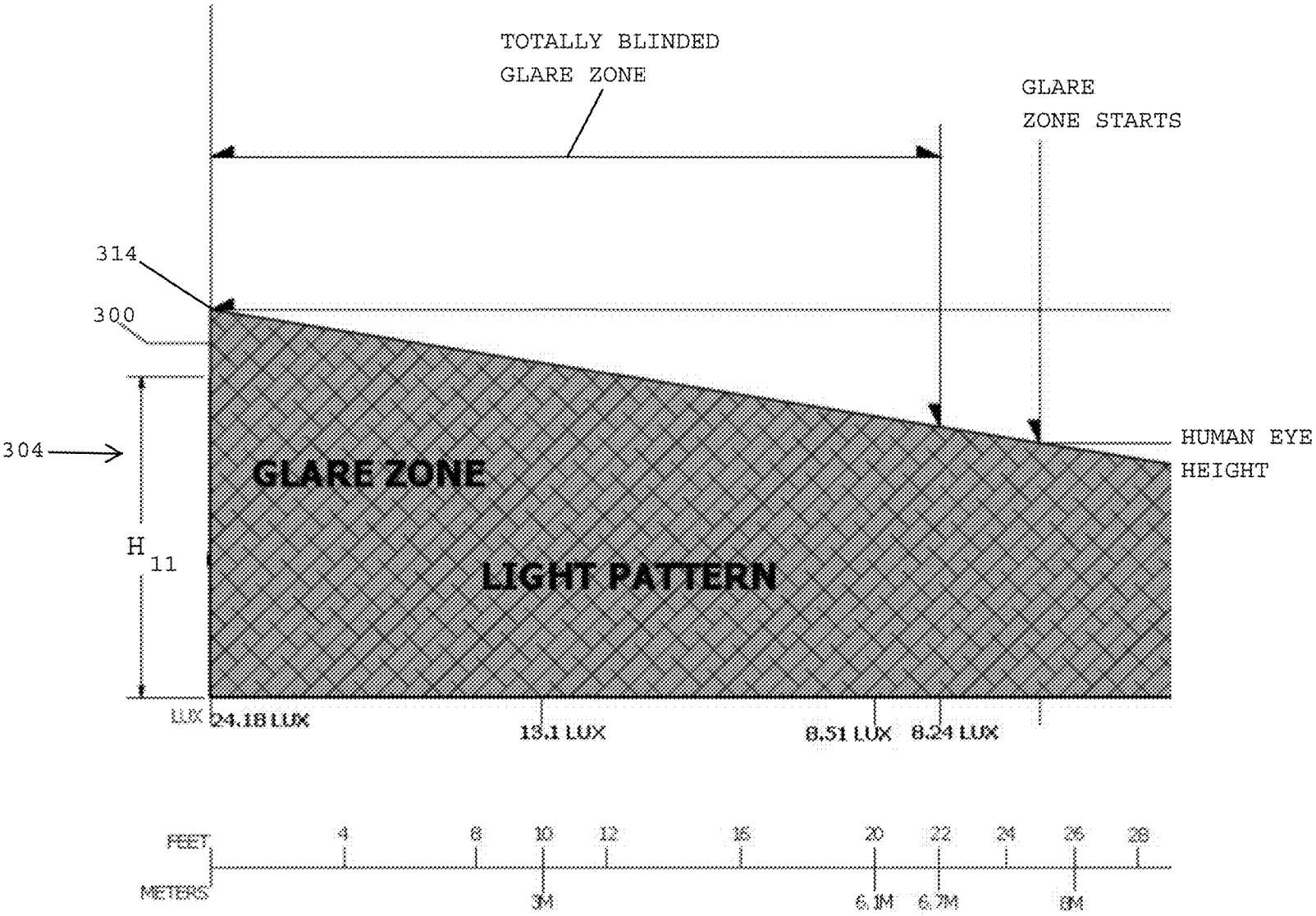
Figures 2, 24:
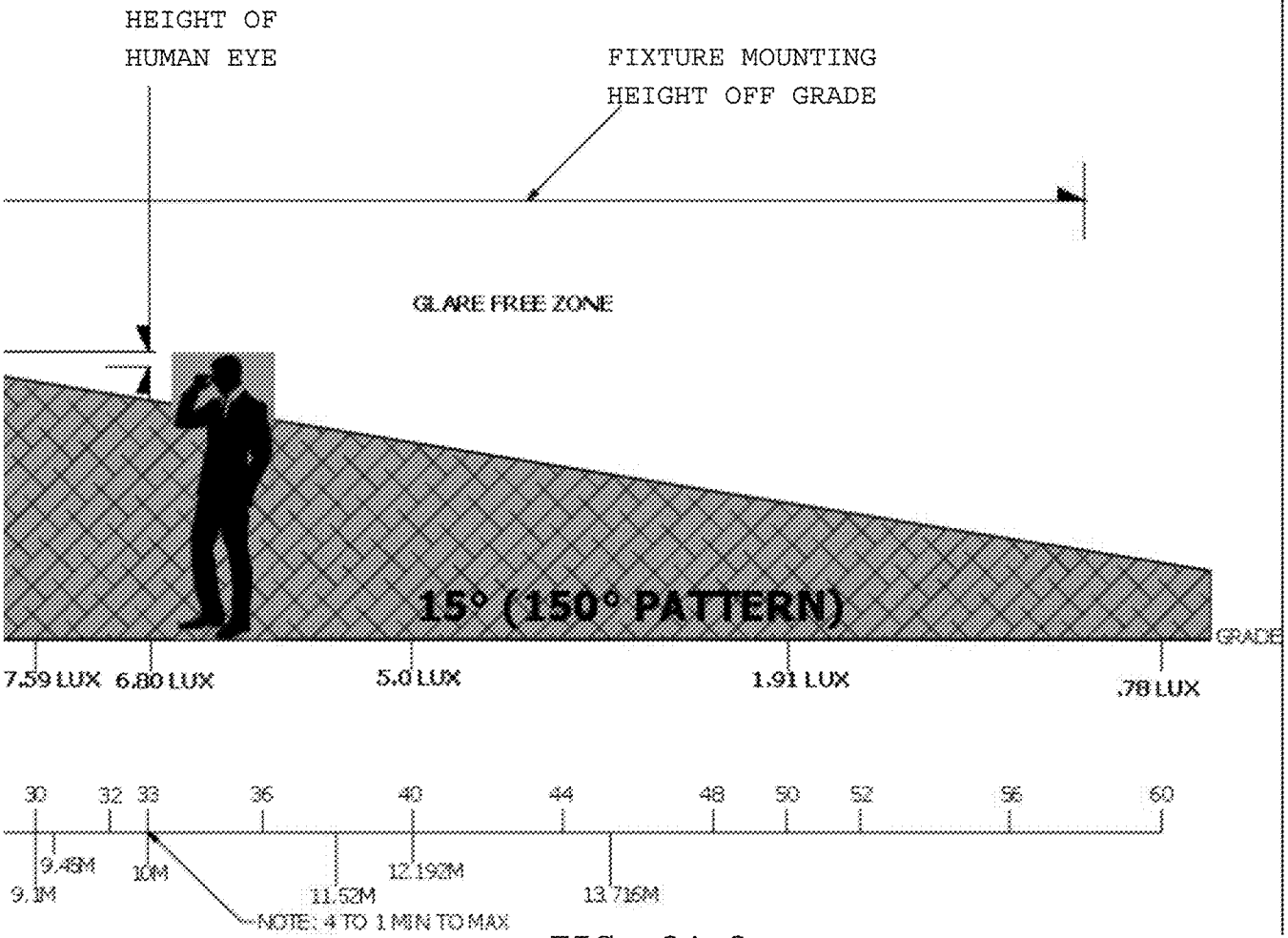

In one embodiment, a security lighting system includes a plurality of security light fixtures that are mounted onto a perimeter fence, whereby each security light fixture uses precision optical beam angles to deliver as even and as wide a light coverage area as possible along the perimeter fence line. By using precision optics, an installer can control the beam angles by mounting the security light fixtures at varying fence heights (e.g., 7', 8', 9', 10', 11', 12' fences). In one embodiment, the precision optics may be used to create "No Glare Zones." By selecting the correct beam angle depending on the mounting height of the light fixture and the fence height, security personnel can operate in the "No Glare Zone" of the lighting, which gives them a tactical advantage by being able to see inside and outside the fence line with their vision not impacted by the direct glare of the fixture. Once an intruder approaches the fence line, as shown in FIG. 24, depending upon the height of the individual, blinding glare produced by the light fixture will start at roughly 25 feet (7 meters) from the fence line. This "Glare Zone" is designed to disable the intruder who will become blinded and unable to assess the approaching security guards and the physical surroundings within the glare zone area. In one embodiment, the "Glare Zone" is designed to occur both inside and outside the fence line. The legacy prior art security lights shown above in FIGS. 1-5 simply cannot deliver this type of target glare, which is a precision designed feature of the security lighting fixtures disclosed herein and is specific to the mounting height of the light fixture and the optical beam angle of the light.

One specific embodiment of this targeted glare feature is the use of a precision optical beam pattern of between 137 degrees and 156 degrees depending upon the specific mounting height of the perimeter security lighting fixture to deliver the targeted glare.

Figure 23:
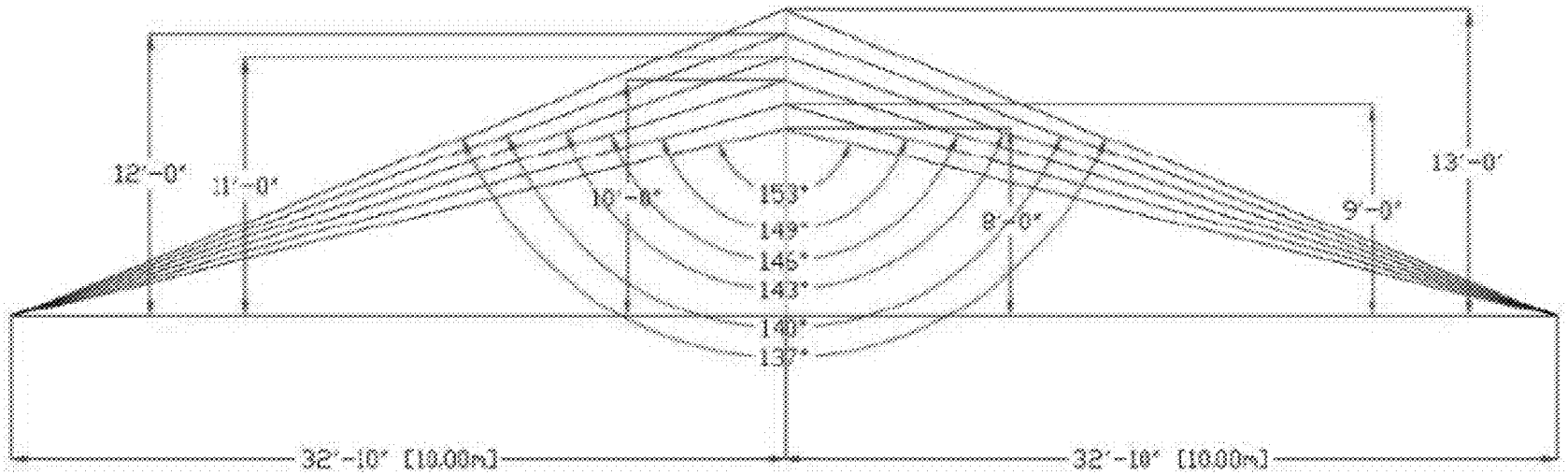
FIG. 23 shows a schematic view of light beam angles generated by the light emitting diodes shown in FIGS. 21 and 22A-22C, in accordance with one embodiment of the present patent application.

Referring to FIG. 23, in one embodiment, an installer may control the angle at which the light projects from the security lighting fixture by modifying the height of the glare shroud off grade and/or by modifying the optic lenses covering the light emitting diodes. An installer may also modify the angle at which the light is emitted from the glare shroud by adjusting the angle of the upper pipe section relative to the lower pipe section and/or rotating the glare shroud relative to the longitudinal axis of the lower pipe section.

Referring to FIG. 23, in one embodiment, when a security lighting fixture is mounted atop an 8 foot fence, the optic lenses generate a light pattern defining an angle of 153 degrees. In one embodiment, when a security lighting fixture is mounted atop a 9 foot fence, the optic lenses generate a light pattern defining an angle of 149 degrees. In one embodiment, when a security lighting fixture is mounted atop a 10 foot fence, the optic lenses generate a light pattern defining an angle of 146 degrees.

In one embodiment, when a security lighting fixture is mounted atop an 11 foot fence, the optic lenses generate a light pattern having an angle of 143 degrees. In one embodiment, when a security lighting fixture is mounted atop a 12 foot fence, the optic lenses generate a light pattern defining an angle of about 140 degrees. In one embodiment, when a security lighting fixture is mounted atop a 13 foot fence, the optic lenses generate a light pattern defining any angle of about 137 degrees. Thus, an installer can control the light beam angle by knowing the light beam spread generated by a particular optical lens and adjusting the height of the light fixture off grade to attain a desired angle at which the light is emitted from the security lighting fixture.

Referring to FIG. 24, in one embodiment, a security lighting fixture 300 is mounted atop a perimeter fence 304 having a height $H_{11}$ of 8 feet. The glare shield 314 is positioned above the top of the perimeter fence 304 and has a height that is about 9'6" above grade. The security lighting fixture 300 contains a plurality of light emitting diodes covered by optic lenses as shown in FIG. 21 for generating light from the underside of the glare shroud 314. In the embodiment shown in FIG. 24, the light pattern extends away from the glare shroud 314 at an angle of 150 degrees on both the inside and the outside of the fence. As shown in the scale provided at the bottom of FIG. 24, the light level directly below the security lighting fixture 300 is greater than the light level further away from the light fixture. As a result, the light level diminishes at a known rate as distance from the fence line increases.

In one embodiment, the angle at which the light moves away from the security lighting fixture 300 may be utilized to provide a "Glare Zone" in which an intruder would be subjected to blinding glare from the light fixture 300. An installer may utilize information related to the height of the light fixture and the angle at which the light is emitted from the light fixture to establish the blinding "Glare Zone" at a desired location. The location of the "Glare Zone" may be adjusted to accommodate local topography and grade by articulating the upper pipe section of a security lighting fixture. As shown in FIG. 24, with the glare shroud 314 at a height of 9'6" above grade, the blinding glare zone for an intruder 380 having a human eye of a height of 5'2" to 5'7" off grade would begin at distance of about 25 feet from the fence line. If the light fixture were positioned at height of 10'6" above grade, the blinding glare zone for the intruder 380 would begin at a distance of 31 feet from the fence line. If the height of the glare shroud of the light fixture were 11'6" above grade, the blinding glare zone would begin at a distance of 38 feet from the fence line. Moreover, if the glare shroud 314 of the light fixture 300 were positioned 12'6" above grade, the blinding glare zone would begin at a distance of 45 feet from the fence line.

FIG. 24 shows a flat grade. If the grade sloped uphill away from the outside of the fence, an installer may adjust the angle of the upper pipe section relative to the lower pipe section to position the beginning of the blinding glare zone at a preferred distance from the fence line. In one embodiment, if the grade sloped down and away from the outside of the perimeter fence 304, then the upper pipe section would be tilted toward the outside of the perimeter fence. If the grade outside the fence sloped upwardly, the upper pipe section would be angled inwardly toward the inside of the fence.

Thus, the security lighting system disclosed in the present patent application enables an installer to select and dial-in a distance from the fence line where the blinding glare zone will begin. In addition, by utilizing lower light levels than are used with conventional security lighting systems, security personnel may see better into the light and not suffer from blinding glare that typically occurs with using excessively bright legacy security lights (e.g., the lights shown in FIGS. 1-5).

FIG. 24 also shows how the light level diminishes as the distance from the fence line increases. Directly below the fence line, the security lighting fixture 300 generates horizontal light at 17.9 lux. At a distance of about 10 feet from the fence line, the recorded light level is 9 lux. At the beginning of the blinding glare zone, the light level is about 6 lux, which is sufficient for security cameras to identify an intruder's face. As noted herein, any light level above 5.0 lux has been shown to provide an ability to identify an intruder's face. At 50 feet from the fence line, the light level is still above 2 lux, which is a sufficient light level for detecting the presence of an intruder.

The light pattern shown in FIG. 24 shows only one-half of the light pattern generated by the light fixture. A similar light pattern is directed to the left of the page for providing light inside the perimeter fence 304.

Figure 25:
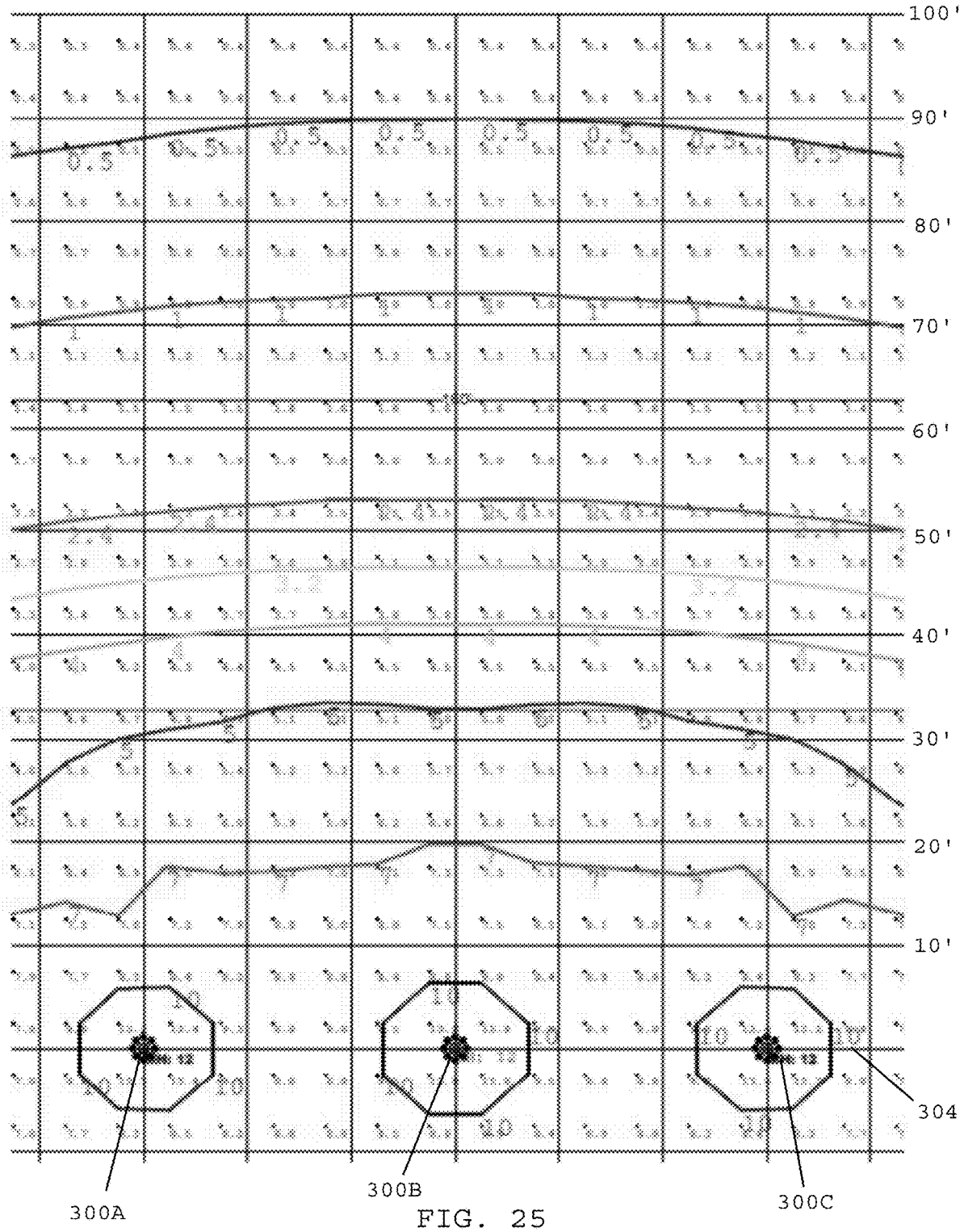
FIG. 25 shows a plot of lux values generated by a security lighting system having spaced security lighting fixtures, in accordance with one embodiment of the present patent application.

FIG. 25 shows a security lighting system having three security lighting fixtures 300A-300C mounted atop a perimeter fence 304. FIG. 25 shows only three security lighting fixtures, however, it is contemplated that a security lighting system for a perimeter fence may include 50, 100, 200 or more security lighting fixtures for providing security lighting around the perimeter of the fence. In the embodiment of FIG. 25, the security lighting fixtures are desirably spaced about 30 feet from one another along the perimeter fence 304. FIG. 25 shows the lux distribution of the security lights at different distances from the epicenter of the lights. In FIG. 25, each square represents a distance of 10'×10'. Directly below the security lights, at the fence line, the light level is about 13 lux. About 20 feet away from the security lights 300A-300C, the light level is about 7 lux. The lights generate a lux level of about 5 lux at a distance of about 33 feet from the security lights. A level of 4 lux is measured about 40 feet away from the perimeter fence 304, and a level of 3.2 lux is measured at a distance of about 47 feet from the perimeter fence 304. A light level of 2.4 lux is measured approximately 50 feet away from the perimeter fence. Thus, the graph of FIG. 25 shows that the light intensity is greatest directly below the light fixtures and diminishes as the distance increases from the fence line of the perimeter fence 304.

Figure 26:
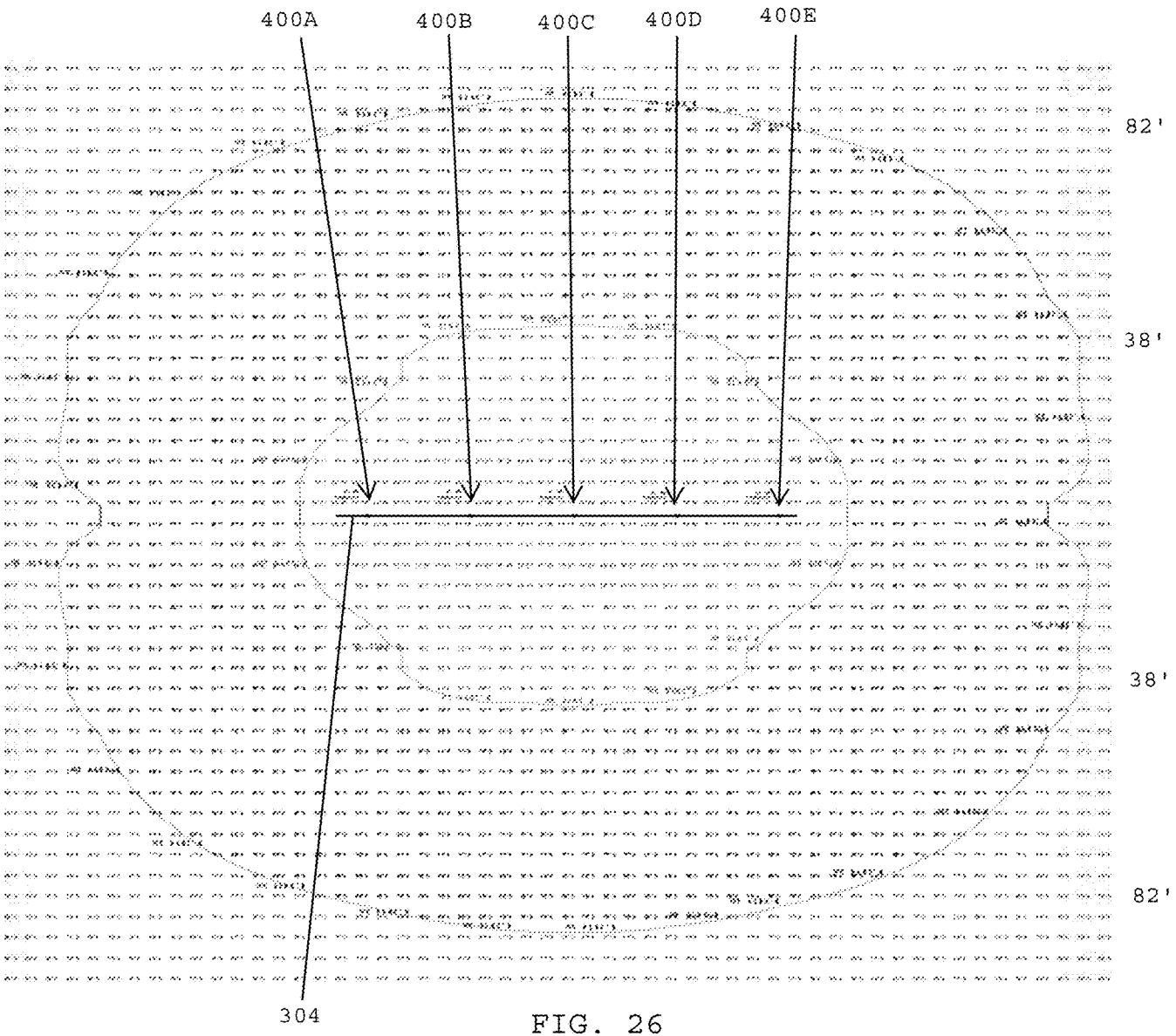
FIG. 26 shows a plot of lux values generated by a security light system having spaced security light fixtures, in accordance with one embodiment of the present patent application.

FIG. 26 shows the light pattern for five security lighting fixtures mounted atop a perimeter fence. Although five security lighting fixtures 400A-400E are shown, other security lighting systems disclosed herein may include 50, 100, 200, or more security lighting fixtures mounted atop a perimeter fence. The light level directly below the light fixtures 400A-400E, provided on each side of the perimeter fence, is about 24.79 lux. As shown in FIG. 26, the light pattern is generally symmetrical on both the outside and the inside of the perimeter fence. At about 38 feet away from the perimeter fence, the light level has diminished to about 6.1975 lux. At about 82 feet away on both sides of the perimeter fence, the light level has diminished to about 0.2074 lux.

Figure 27:
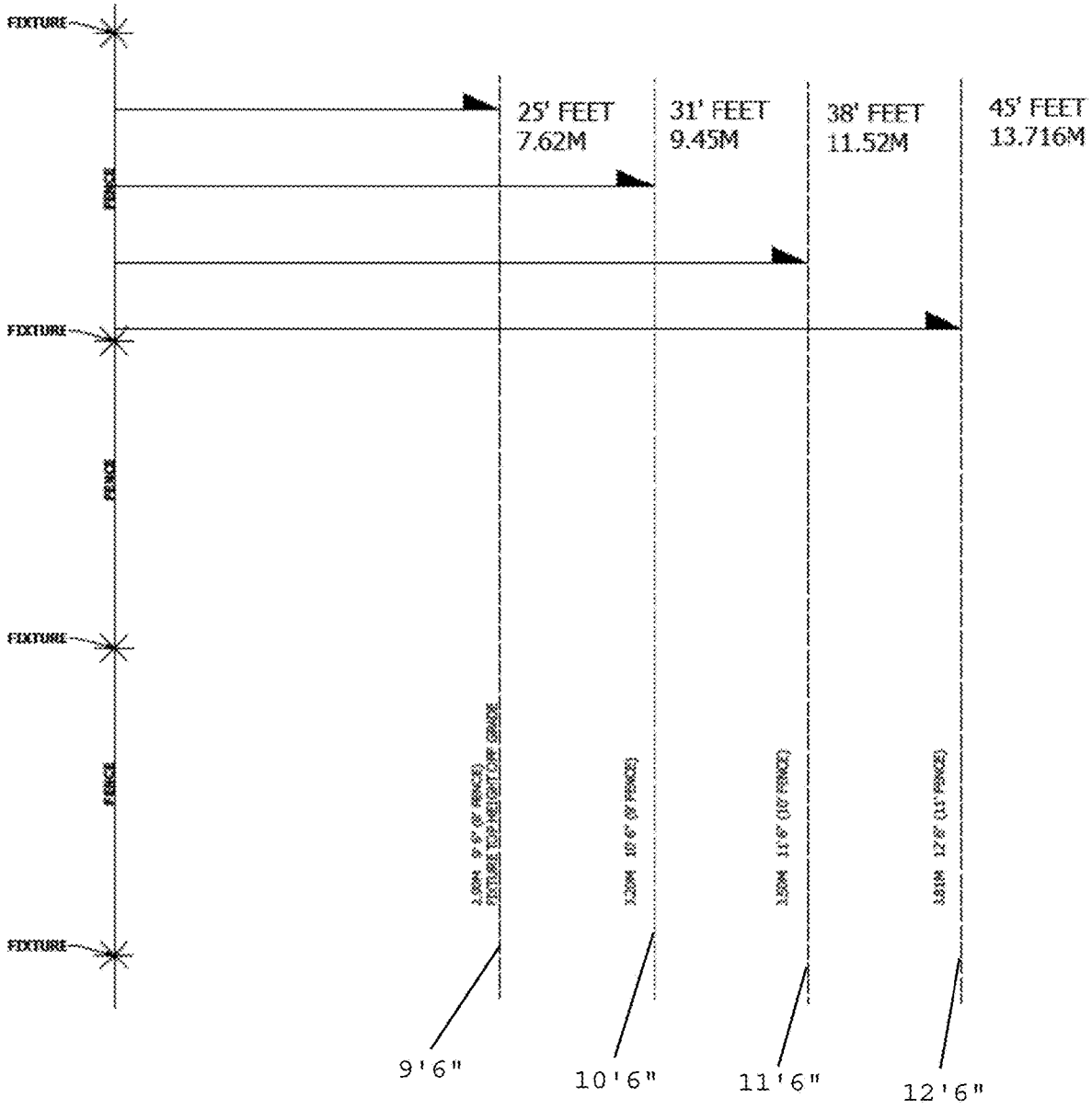
FIG. 27 is a plot of glare zones based upon fixture mounting height off grade, in accordance with one embodiment of the present patent applications.

FIG. 27 is a chart showing where the blinding glare zone begins when a security lighting fixture is positioned at a particular height above grade. In one embodiment, the top of the security lighting fixture is located 9'6" above grade and the blinding "Glare Zone" begins 25 feet from the fence line. In one embodiment, the security lighting fixture is located 10'6" above grade and the blinding "Glare Zone" begins at 31 feet from the fence line. In one embodiment, the security lighting fixture is located 10'6" above grade and the blinding "Glare Zone" begins at a distance of 38 feet from the fence line. In one embodiment, the security lighting fixture is located 12'6" above grade and the blinding "Glare Zone" begins at a distance of 45 feet from the fence line.

In the event the adjustment of the fixture requires a significant adjustment off 90 degrees to project the light pattern down a steep embankment outside a fence line, which would result in unwanted glare on the inside of the fence, a security lighting fixture may be fitted with a glare shroud extender that may be attached to the light fixture for extending the length of the glare shroud of the fixture and adjusted on site to eliminate the glare. In one embodiment, the glare shroud extender may be made of polymers or rubber.

Figure 28A:
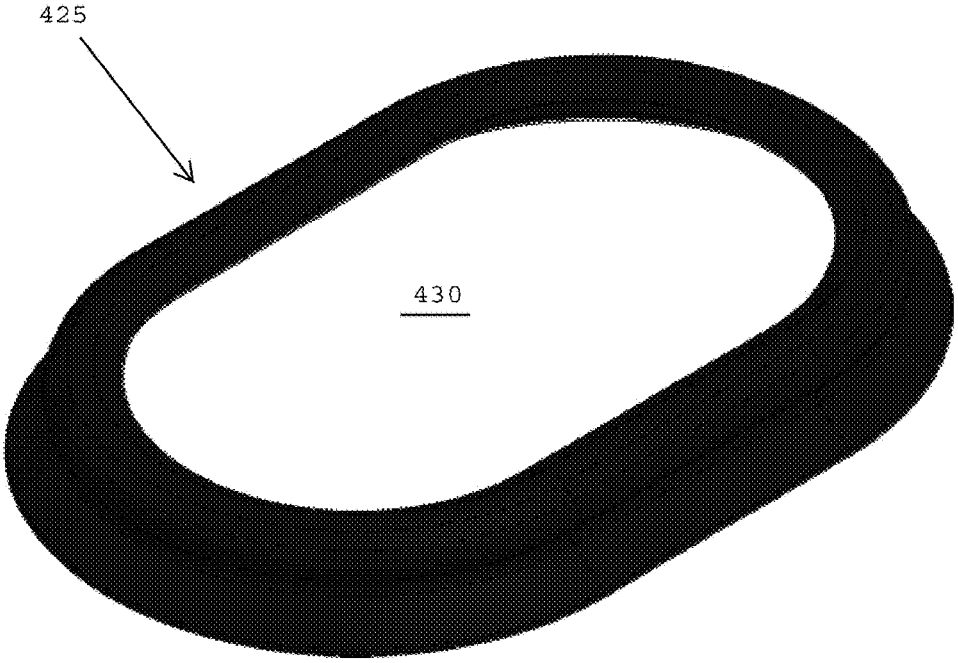
FIG. 28A shows a perspective view of a glare shroud extender for a security lighting fixture, in accordance with one embodiment of the present patent application.

Referring to FIG. 28A, in one embodiment, a glare shroud extender 425 may be secured over an outer perimeter 318 of a glare shroud 314 of a security lighting fixture 300 (FIG. 12A). The glare shroud extender 425 preferably has an oval shape with a central opening 430 adapted to receive the glare shroud 314 (FIG. 12A). The central opening 340 preferably enables the heat fins 322 on the glare shroud 314 to project therethrough for removing heat from the LEDs located on the underside of the glare shroud (FIG. 12).

Figure 28B:
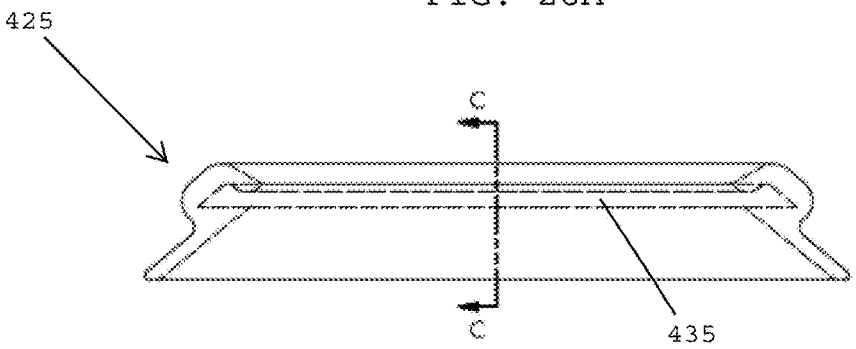
FIG. 28B shows a cross sectional view of the glare shroud extender shown in FIG. 28A.
Figure 28C:
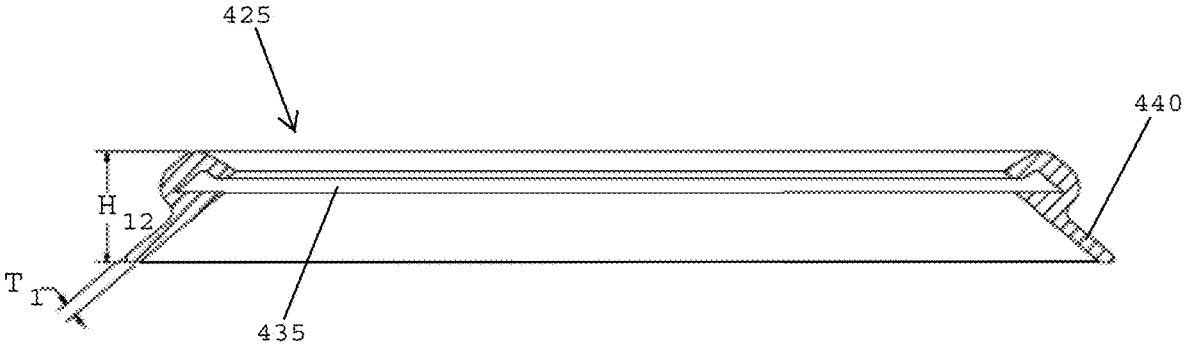
FIG. 28C shows another cross sectional view of the glare shroud extender shown in FIG. 28B.

Referring to FIGS. 28B and 28C, in one embodiment, the glare shroud extender 425 preferably includes an interior groove 435 that extends around the inside perimeter of the glare shroud extender adjacent an upper end thereof. The inner groove 435 is adapted to receive the outer perimeter 318 of the glare shroud 314 for securing the glare shroud extender to the outer perimeter of the glare shroud.

Referring to FIG. 28C, in one embodiment, the glare shroud extender 425 has a height $H_{12}$ of about 1.00-1.50 inches and more preferably about 1.22 inches. In one embodiment, the glare shroud extender 425 has a lower outwardly extending flange 440 having a thickness $T_1$ of about 0.10-0.20 inches and more preferably about 0.15 inches.

Figure 28D:
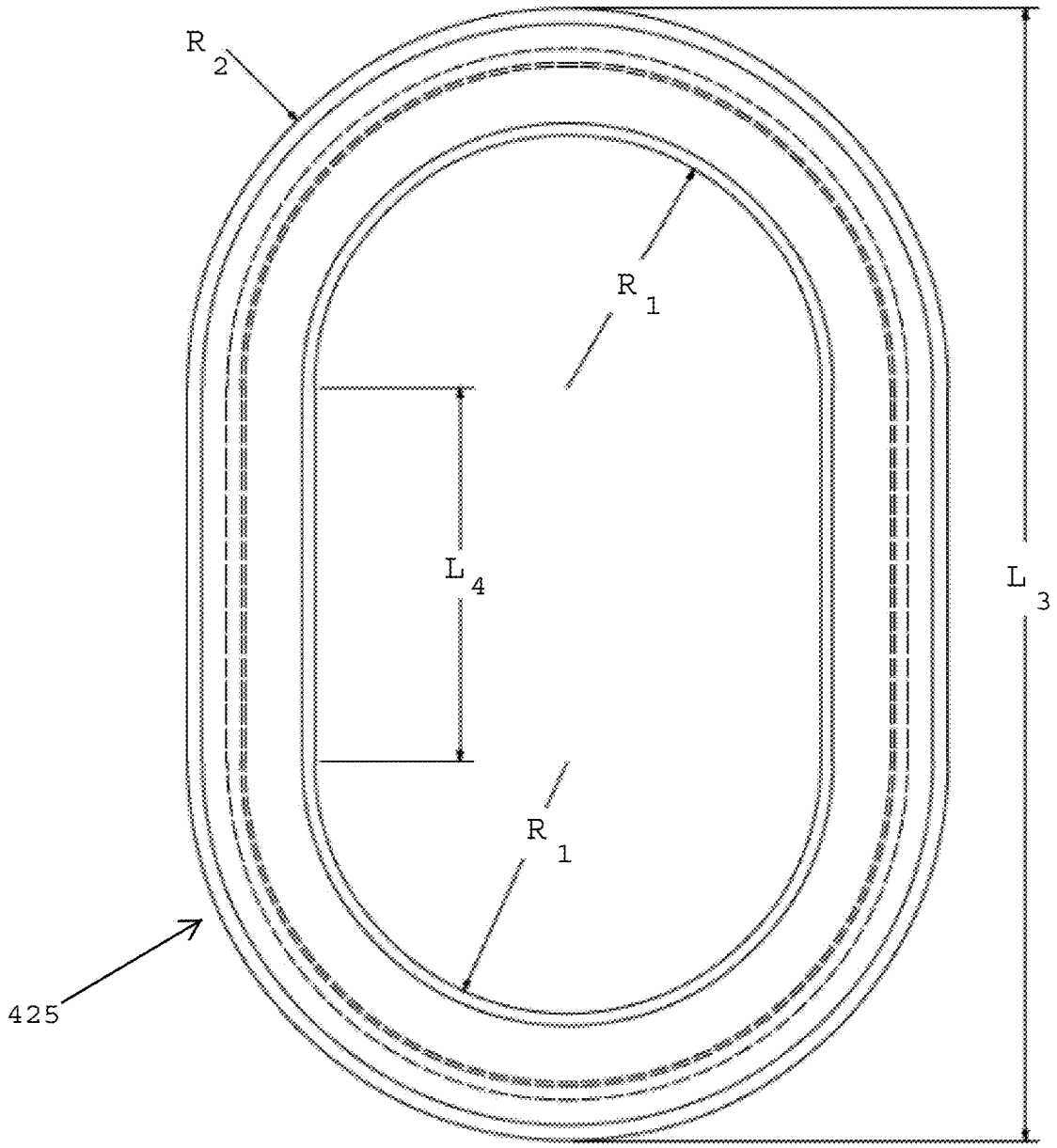
FIG. 28D shows a top plan view of the glare shroud extender shown in FIGS. 28A-28C.

Referring to FIG. 28D, in one embodiment, the glare shroud extender 425 has a length $L_3$ of about 10.5-11.5 inches and more preferably about 10.93 inches. In one embodiment, the glare shroud extender 425 has straight lateral sections having a length $L_4$ of about 3-4 inches and more preferably about 3.61 inches. The glare shroud extender 425 has an inner radius at the curve $R_1$ of about 2.44 inches and an outer radius on the outside of the curve $R_2$ of about 3.66 inches.

In one embodiment, the perimeter security lights disclosed herein are designed to operate off a low voltage transformer, which can be controlled using a switch, photocell, timer or a signal from a third party intrusion detection system such as a microwave, motion sensor, ground sensor, vibration sensor, infrared, camera analytics, or lasers. In one embodiment, a secured area is dark until an intrusion is detected. Once the intrusion is detected, the system turns the lights on at 100% brightness. In one embodiment, the system has a Temporary Bright light zone feature. The operator may set the standard nighttime operating lumen level at about 40% to 50% of the maximum which would operate every night at a run time determined by the end user. Once an event is conveyed to the transformer that there is an intrusion or breach of the fence by using a dry contact or a voltage signal from the intrusion detection system the transformer may be programmed to activate the lights for a set time at 100% of the lumen value with the hope of deterring the intruder and preventing the breach and also notifying security that this zone is under attack. The higher lumen level run time setting that would activate during an intrusion event would be field adjustable by the end user from one second to twelve hours.

In one embodiment, control of a light fixture or grouping of light fixtures may be activated from the transformer via a dry contact closure signal delivered by wire or wireless signal to the low voltage transformer. One embodiment of the control of the transformer that operates the fixtures specifically turns on or off the lights on the secondary side of the transformer not on the primary side of the transformer. When control of a transformer is commenced during a rapid on off cycling a transformer, be it EI or toroidal style, can cause an occurrence referred to as "in-rush surge" which can inadvertently cause the transformer to trick the primary side electrical panel magnetic circuit breaker into detecting an overload or short which will then trip the primary breaker and render the lighting system inoperable. In one embodiment, the system specifically controls the on off control of the lights on the secondary low voltage side of the transformer not the high voltage primary side thus eliminating the possibility of nuisance tripping the primary breaker at the electrical panel supplying power to the transformer and thus controlling the lights.

In one embodiment, a Wi-Fi enabled chip is integrated into each perimeter security light which will allow computers, smart phones and other devices such as intrusion detection systems, security guards, etc. to connect each individual perimeter security light or group of perimeter security lights to the internet or communicate with one another wirelessly along the fence line allowing preprogrammed actions or manually activated actions to occur when specific events happen on the perimeter fence line that are detected by other third party intrusion detection systems, these actions may include strobing, flashing, changing colors, activation on, activation off, dimming, brightening, audio, switching light sources to infrared and a host of other preprogrammed events. The integration of a Wi-Fi chip may involve controlling a single fixture or grouping of fixtures along the perimeter where the event occurred. Such Wi-Fi enabled devices may be integrated with voice activated commands and smart phone applications.

In one embodiment, a perimeter security lighting fixture may employ the use of an accelerometer motion center integrated with the light fixture to detect anyone cutting, climbing and/or lifting a fence, which could be used as a way of activating the lighting response as set by the owner. This detection chip preferably allows preprogrammed actions or manually activated actions to occur when specific events happen on the perimeter fence line. These actions may include strobing, flashing, changing colors, activation on, activation off, dimming, brightening, audio, switching light sources to infrared and a host of other preprogrammed events etc. This intrusion detection feature along with the integration of a Wi-Fi chip may involve controlling a single fixture or grouping of fixtures along the perimeter where the event occurred. Such enabled devices can integrate with voice activated commands and notification and smart phone applications.

The human eye is perhaps the most vital of organs used by criminals to carry out their unscrupulous acts. One feature of this invention is the total disruption of the human eye's operation at night when the criminal attempts to breach a secure perimeter fence line. The human eye will take upwards of one half hour to one hour to completely adjust to low moon light conditions. In other settings where artificial light is operating, the time required for the eye to adjust to the partially illuminated setting could take anywhere from five to fifteen minutes. The point here is that the human eye adjusts without any input from the human. The human eye functions independently of the person.

One feature of this perimeter security lighting system is the ability to integrate with other third party perimeter intrusion detection systems such as lasers, microwave, camera analytics, motion sensors and activate when an intrusion happens. One feature of this system is the ability to turn the lighting system on for an adjustable duration (e.g., two seconds to two minutes) and then turn the light off for an adjustable duration (e.g., two seconds to two minutes). The objective is to cause total disorientation of the human eye function and thus thwart the attack. The cycling from bright to dark takes advantage of the natural time it takes for the rods and cones of a human eye to reset to either the darkness or the brightness and adjust to the present light condition. This cycling from dark to bright disorients and disables the perpetrator as the receptors of the eye become bleached, whereupon the perpetrator will become confused, disoriented and/or unable to operate effectively. In addition to the disorientation of the blinking on and off of the light, the activity of the light cycling in the darkness will also bring attention to the area where the breach is occurring notifying security guards and police.

Zone Warning Areas. By integrating the perimeter security lighting system with an intrusion detection system the end users may map out on the exterior of any secure fence line zones that might look something like this: Zone #1-45 feet from the fence. Zone #2-30 feet from the fence. Zone #3-15 feet from the fence.

At the breach of each zone the perimeter security lights may be activated to perform a certain way completely adjustable by the end user. Below is a example of one setting among the infinite settings available to the end user:

Zone #1 being the outer-most zone, a system may be programmed to flash the lights for two seconds every five seconds for one minute. This gives the perpetrator warning that they have been detected and should retreat or perhaps they mistakenly wandered into the area and should consider leaving.

Zone #2. The perpetrator has been warned in Zone #1 and now the lights go on at full power to clearly identify the perpetrator. The perpetrator has now entered a secure zone.

Zone #3. The perpetrator is now attempting to breach the perimeter and the lights will cycle from full brightness for five seconds to total darkness for five seconds for the next half hour then return to full on for two hours then reset to total darkness.

In one embodiment, an operator may set their own run programs to coincide with their desired lighting of the perimeter fence line (e.g., on or off at night and cycle times and zone lighting settings).

In one embodiment, an owner may also set simple flashing and/or strobing lights in any zone to deter intrusion.

In one embodiment, the system has an operating range from 12 volts to 50 volts AC, and from 12 volts to 50 Volts DC. In one embodiment, the system has an operating range from 12-25 volts AC or 12-25 Volts DC.

Breakaway Bracket. In one embodiment, should an intruder try to use a lighting fixture attached atop a fence post as a hand hold to scale the fence, the light fixture may have a breakaway bracket or a pipe section that would yield under greater human weight of 75 lbs. or greater, thus denying the intruder a hand hold to use when scaling the fence.

In one embodiment, the beam spread of a light fixture may be any radius desired from full 360 degrees to narrow spot lighting configuration, which will allow mounting the fixture head on a wall and projecting out from the wall so as not to create hot spots at the fixture or on the wall where the fixture is mounted.

In one embodiment, communication of sensors mounted in the security light fixtures may be accomplished via a simple hard wire communication or via Wi-Fi communication by radio or signal over power wire.

In one embodiment, the mounting of the light fixture may take place in two stages. During a first stage, a metal threaded "U" bracket wraps around the fence post be it square, round, rectangular, or "I" beam style and a mating fixture mounting bracket nests against the upright post that the light fixture is being attached to. The mounting bracket preferably accepts the U bracket, which may then screw down and compress against the outer diameter of the upright fence post. The mounting bracket has two bottom threaded holes that accept two screw heads that nest in "Mouse Holes" formed in the base of the junction box of the light fixtures for easy attachment of the "Mouse Holes" of the fixture body base (e.g., the junction box), which provides an installer with an easy way of attaching the light fixture with one hand. Once the light fixture is attached on the two base mouse holes, a third pan head screw may be inserted in the center of the junction box. Before all the screws are tightened, the installer may level the light fixture as the play on the three screws allows a final adjustment to level the fixture 5% + or − off 90° to accommodate slight variations in the bracket and post.

Lightning and Fences. Lightning poses a problem for all outdoor lighting fixtures and especially any fixtures mounted to a fence line as the fence may become a conductor of electricity and a path to ground for a lighting strike. In one embodiment, the perimeter security light has a quick connect easily removable low voltage drive circuit that receives electricity from the transformer and delivers DC current to the LED's. The LED driver preferably takes the low voltage power and rectifies the AC power to DC power to drive the LEDs. Not integrating the component as part of the fixture body and making the component removable should damage occur due to lightning damage greatly enhances the user experience should damage to the driver occur during operation caused by lightning and power surges in the power wire.

It is contemplated that any of the security lighting systems and light fixtures disclosed herein may incorporate the technology disclosed in any one of commonly owned U.S. Pat. Nos. 8,845,124; 9,360,197; 9,593,832; 9,648,688; and 9,777,909, and U.S. Published Patent Application Nos. 2014/010831; 2014/0376228, and 2018/0023788, the disclosures of which are hereby incorporated by reference herein.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A light fixture for a security lighting system comprising:

an elongated pipe including a lower pipe section and an upper pipe section;

an articulating joint coupling a lower end of said upper pipe section with an upper end of said lower pipe section for enabling said upper and lower pipe sections to articulate relative to one another;

a junction box secured to the lower end of said lower pipe section;

a clamping element coupled with said junction box;

a glare shroud secured to the upper end of said rigid upper pipe section, said glare shroud having a reflective concave surface that forms an underside of said glare shroud that faces toward said junction box;

one or more LEDs secured to said reflective concave surface of said glare shroud, wherein each said LED has an optical lens configured to pass light having a beam angle of 137-156 degrees.

2. The light fixture as claimed in claim 1, wherein said lower and upper pipe sections are rigid and made of metal.

3. The light fixture as claimed in claim 1, wherein said articulating joint is closer to an upper end of said elongated pipe than a lower end of said elongated pipe.

4. The light fixture as claimed in claim 1, wherein said articulating joint comprises a universal ball joint and a locking element moveable between an unlocked position in which said upper pipe section is free to rotate and articulate relative to said lower pipe section and a locked position in which said for upper pipe section is prevented from rotating and articulating relative to said lower pipe section.

5. The light fixture as claimed in claim 4, wherein said universal ball joint enables said upper pipe section to rotate 360 degrees about a longitudinal axis of said lower pipe section and articulate 40 degrees in either direction off a plumb line that extends along a longitudinal axis of said lower pipe section.

6. The light fixture as claimed in claim 1, wherein said junction box contains electrical components including a microprocessor for controlling operation of said light fixture.

7. The light fixture as claimed in claim 1, further comprising:

a mounting bracket coupled with a rear wall of said junction box, wherein said mounting bracket has first and second spaced openings that extend from a rear face to a front face of said mounting bracket;

said clamping element defining a U-shaped element having first and second free ends that pass through said first and second spaced openings that extend from the rear face to the front face of said mounting bracket; and wherein said junction box has a rear wall having a lower edge with two spaced mouse holes formed therein that are configured for assembling said junction box with said mounting bracket.

8. The light fixture as claimed in claim 1, wherein said reflective concave surface of said glare shroud comprises a flat underside surface that extends outwardly from a center of said glare shroud and a sloping underside surface that slopes outwardly and downwardly toward an outer perimeter edge of said glare shroud.

9. The light fixture as claimed in claim 8, wherein said one or more LEDs comprise:

a first 2×2 LED matrix secured to a first side of said flat underside surface of said glare shroud;

a second 2×2 LED matrix secured to a second side of said flat underside surface of said glare shroud.

10. The light fixture as claimed in claim 1, further comprising:

conductive wiring connected to said light fixture;

a transformer coupled with said conductive wiring, wherein said transformer produces extra low voltage that does not exceed 50 volts, and wherein said light fixture operates on extra low voltage that does not exceed 50 volts.

11. The light fixture as claimed in claim 1, wherein said light fixture is mounted onto a vertical post of a perimeter fence having a fence line, and wherein a distance from the fence line where a glare zone begins is selected by knowing the beam angle of said LED, adjusting the height off grade of the upper end of said security light fixture, and tilting said upper pipe section relative to said lower pipe section.

12. A security lighting system comprising:

a perimeter fence having vertical posts spaced from one another along a fence line, said vertical posts having a height of 8-12 feet off grade;

security lighting fixtures mounted on at least some of said spaced vertical posts, wherein said security lights are spaced 10-30 feet from one another and have upper ends defining a height of 9.5-13.5 feet off grade;

conductive wiring interconnecting said security lighting fixtures;

a transformer coupled with said conductive wiring, wherein said transformer produces extra low voltage that does not exceed 50 volts;

each said security lighting fixture comprising an elongated pipe including a lower pipe section and an upper pipe section, an articulating joint coupling a lower end of said upper pipe section with an upper end of said lower pipe section for enabling said upper and lower pipe sections to articulate relative to one another;

a junction box secured to the lower end of said lower pipe section, a clamping element coupled with said junction box for securing said security lighting fixture to one of said vertical posts, a glare shroud secured to the upper end of said rigid upper pipe section, said glare shroud having a reflective concave surface that forms an underside of said glare shroud and that faces toward said junction box, one or more LEDs secured to said reflective concave surface of said glare shroud, wherein each said LED is adapted to generate light having a beam angle of 137-156 degrees.

13. The security lighting system as claimed in claim 12, wherein said lower and upper pipe sections are rigid and made of metal, and wherein said articulating joint is closer to an upper end of said elongated pipe than a lower end of said elongated pipe.

14. The security lighting system as claimed in claim 13; wherein said articulating joint comprises a universal ball joint and a locking element moveable between an unlocked position in which said rigid upper pipe section is free to rotate and articulate relative to said rigid lower pipe section and a locked position in which said for rigid upper pipe section is locked in place and prevented from rotating and articulating relative to said rigid lower pipe section.

15. The security lighting system as claimed in claim 12, wherein said reflective concave surface of said glare shroud comprises a flat inner surface that extends outwardly from a center of said glare shroud and a sloping outer surface that surrounds said flat inner surface and that slopes outwardly and downwardly toward an outer perimeter edge of said glare shroud.

16. The security lighting system as claimed in claim 15, wherein said glare shroud has a convex top surface including heat fins projecting from said convex top surface and a gutter adjacent the outer perimeter of said glare shroud.

17. The security lighting system as claimed in claim 16, wherein said glare shroud has a first end, a second end, and a longitudinal axis that extends from the first end to the second end, wherein said glare shroud further comprises a first drainage opening located at the first end that intersects with said gutter and a second drainage opening located at the second end that intersects with said gutter.

18. The security lighting system as claimed in claim 12, wherein said one or more LEDs comprise:

a first 2×2 LED matrix secured to a first side of said flat underside surface of said glare shroud;

a second 2×2 LED matrix secured to a second side of said flat underside surface of said glare shroud.

19. The security lighting system as claimed in claim 12, wherein when one of said security light fixtures is mounted onto one of said vertical posts, a distance from the fence line where a blinding glare zone begins is selected by knowing the beam angle of said LED and adjusting the height off grade of the upper end of said security light fixture.

20. The security lighting system as claimed in claim 19, wherein the distance from the fence line where the blinding glare begins is further selected by tilting said upper pipe section relative to said lower pipe section.

21. A security lighting system comprising:

a perimeter fence having vertical posts spaced from one another along a fence line and wire mesh interconnecting said vertical posts, wherein said vertical posts have a height of 8-12 feet off grade;

security lighting fixtures mounted on said spaced vertical posts, wherein said security lights are spaced 10-30 feet from one another and have upper ends positioned at a height of 9.5-13.5 feet off grade;

conductive wiring interconnecting said security lighting fixtures;

a transformer coupled with said conductive wiring, wherein said transformer produces extra low voltage that does not exceed 50 volts, and wherein said security lighting fixtures operate on extra low voltage that does not exceed 50 volts;

each said security lighting fixture comprising an elongated pipe including a lower pipe section and an upper pipe section, an articulating joint coupling a lower end of said upper pipe section with an upper end of said lower pipe section for enabling said upper and lower pipe sections to articulate relative to one another, a junction box secured to the lower end of said lower pipe section, a clamping element coupled with said junction box for securing said security lighting fixture to one of said vertical posts, a glare shroud secured to the upper end of said rigid upper pipe section and defining the upper end of said security lighting fixture;

one or more LEDs secured to an underside of said glare shroud, wherein each said LED is adapted to generate light having a beam angle of 137-156 degrees.

22. The security lighting system as claimed in claim 21, wherein the underside of said glare shroud forms a reflective concave surface that faces toward said junction box.

23. The security lighting system as claimed in claim 21, wherein said glare shroud has an outer perimeter, and wherein said system further comprises a glare shroud extender that is attachable to the outer perimeter of said glare shroud for expanding an outer dimension of said glare shroud.

24. The security lighting system as claimed in claim 21, wherein said lower and upper pipe sections are rigid and made of metal, and wherein said articulating joint is closer to an upper end of said elongated pipe than a lower end of said elongated pipe.

25. The security lighting system as claimed in claim 21 wherein said articulating joint comprises a universal ball joint moveable between an unlocked position in which said upper pipe section is free to rotate and articulate relative to said lower pipe section and a locked position in which said for upper pipe section is prevented from rotating and articulating relative to said lower pipe section.

26. The security lighting system as claimed in claim 21, further comprising:

a central processing unit for controlling operation of said system; and a motion sensor in communication with said central processing unit for generating alert signals that are transmitted to said central processing unit.

27. The security lighting system as claimed in claim 26, wherein each said security lighting fixture includes a programmable IP addressable chip that enables said security lighting fixture to communicate wirelessly, via Wi-Fi, by signal over power line, and wherein said programmable IP addressable chips are in communication with said central processing unit.

28. The security lighting system as claimed in claim 21, further comprising a pin style cable insulator jacket piercing connecting for coupling one of said security lighting fixtures with said conductive wiring.

29. The security lighting system as claimed in claim 21, wherein when one of said security light fixtures is mounted onto one of said vertical posts, a distance from the fence line where a blinding glare zone begins is selected by knowing the beam angle of said one or more LEDs and adjusting the height off grade of the upper end of said security light fixture.

30. The security lighting system as claimed in claim 29, wherein the distance from the fence line where the blinding glare zone begins is further selected by tilting said upper pipe section relative to said lower pipe section.

* * * * *